US005529894A

United States Patent [19]

Mihayashi et al.

[11] Patent Number: 5,529,894

[45] Date of Patent: *Jun. 25, 1996

[54] SILVER HALIDE PHOTOGRAPHIC MATERIAL CONTAINING A COUPLER CAPABLE OF RELEASING A PLURALITY OF PHOTOGRAPHICALLY USEFUL GROUPS OR PRECURSORS THEREOF

[75] Inventors: Keiji Mihayashi; Atsuhiro Ohkawa, both of Kanagawa, Japan

[73] Assignee: Fuji Photo Film Co., Ltd., Kanagawa, Japan

[ * ] Notice: The term of this patent shall not extend beyond the expiration date of Pat. No. 5,350,666.

[21] Appl. No.: 208,042

[22] Filed: Mar. 9, 1994

Related U.S. Application Data

[63] Continuation of Ser. No. 778,354, Oct. 17, 1991, abandoned.

[30] Foreign Application Priority Data

Oct. 17, 1990 [JP] Japan ..... 2-278080

[51] Int. Cl.[6] ..... G03C 7/305

[52] U.S. Cl. ..... 430/544; 430/549; 430/558; 430/955; 430/956; 430/957; 430/958; 430/959; 430/960

[58] Field of Search ..... 430/544, 558, 430/957, 549, 955, 956, 958, 959, 960

[56] References Cited

U.S. PATENT DOCUMENTS

| | | | |
|---|---|---|---|
| 5,063,145 | 11/1991 | Sakanoue | 430/505 |
| 5,118,597 | 6/1992 | Mihayashi et al. | 430/544 |
| 5,350,666 | 9/1994 | Motoki et al. | 430/544 |
| 5,403,703 | 4/1995 | Mihayashi et al. | 430/544 |

FOREIGN PATENT DOCUMENTS

| | | | |
|---|---|---|---|
| 0383623 | 8/1990 | European Pat. Off. | 430/957 |
| 3304254 | 12/1988 | Japan | 430/544 |
| 1154057 | 6/1989 | Japan | 430/544 |

*Primary Examiner*—Lee C. Wright

*Attorney, Agent, or Firm*—Sughrue, Mion, Zinn, Macpeak & Seas

[57] ABSTRACT

Disclosed is a silver halide color photographic material which comprises a support having thereon at least one photosensitive silver halide emulsion layer, a pyrazoloazole based magenta coupler, and a coupler which contains a plurality of photographically useful groups or precursors thereof. The photograhically useful groups or precursors thereof are capable of being released when the coupler undergoes a coupling reaction with the oxidized product of a color developing agnet.

15 Claims, No Drawings

SILVER HALIDE PHOTOGRAPHIC MATERIAL CONTAINING A COUPLER CAPABLE OF RELEASING A PLURALITY OF PHOTOGRAPHICALLY USEFUL GROUPS OR PRECURSORS THEREOF

This is a Continuation of application Ser. No. 07/778,354 filed Oct. 17, 1991, now abandoned.

FIELD OF THE INVENTION

This invention concerns silver halide photographic materials, and more precisely photosensitive materials which contain novel timing DIR couplers and pyrazoloazole based magenta couplers. The materials have excellent color reproduction properties, sharpness, graininess and de-silvering properties and result in low production costs.

BACKGROUND OF THE INVENTION

In recent years a demand has arisen for silver halide sensitive materials, and especially camera color sensitive materials, which have excellent graininess and sharpness at high photographic speed and which also have excellent de-silvering properties as typified by ISO speed 100 and ISO speed 400 sensitive materials which have a high image quality (Super-HG-400).

Methods in which photographically useful groups are bonded to the coupling position of a coupler via a timing group and in which the photographically useful groups are released imagewise at the appropriate time during development processing are known as an elementary means of improving image quality. Examples of these methods have been disclosed in U.S. Pat. No. 4,409,323 and JP-A-60-218645. (The term "JP-A" as used herein signifies an "unexamined published Japanese patent application".)

The methods of these disclosures involve the release of one molecule of photographically useful group from one molecule of coupler.

However, when these couplers are added in large amounts to a film of a photosensitive material, the film's thickness is increased, sharpness becomes poorer and the cost is increased.

Furthermore, couplers which release two molecules of a photographically useful group from one carbon atom on a timing group have been proposed in JP-A-1-154057. But as a result of their inter-layer effect, these couplers do not provide satisfactory color reproduction, and improvement of the side absorptions of the colored dyes is required.

Pyrazolotriazole type magenta couplers which have little side absorption have been suggested as such couplers in JP-B-47-27411 for example, and they do provide the desired color reproduction, but it has still not been possible to achieve truly satisfactory color reproduction. (The term "JP-B" as used herein signifies an "examined Japanese patent publication").

Attempts have been made to achieve remarkable effects by using combinations of the techniques outlined above instead of using these techniques individually.

For example, combinations of pyrazoloazole based magenta couplers and various development inhibitor releasing couplers (compounds) have been suggested in JP-A-60-262158, JP-A-62-151850, JP-A-63-74058, JP-A-64-77056 and JP-A-1-251032. Some beneficial effect has been achieved, but a satisfactory level of graininess, sharpness, color reproduction and de-silvering properties has not been achieved.

Furthermore, combinations of so-called timing DIR couplers and bleaching accelerator releasing compounds have been suggested, for example, in JP-A-63-216048, JP-A-2-39146, JP-A-2-44338 and JP-A-2-44339. There is some improvement in color reproduction, de-silvering properties, graininess and sharpness, but they are still not satisfactory.

Moreover, the development inhibitor releasing couplers (compounds) disclosed in the patented combinations described above only release one molecule of a development inhibitor from one molecule of compound. Further, they have to be added in large amounts and there is also a problem in that the cost is high.

SUMMARY OF THE INVENTION

An object of this present invention is to provide low cost silver halide photographic materials which have excellent sharpness, graininess, color reproduction and de-silvering properties.

This and other objects have been realized by a silver halide color photographic material comprising a support, having thereon at least one photosensitive silver halide emulsion layer and a pyrazoloazole based magenta coupler. The material also includes a coupler which has a plurality of photographically useful groups or precursors thereof on an atomic-grouping which forms a timing group, the photographically useful groups or precursors thereof being capable of being released from the timing group by a coupling reaction with the oxidized product of a color developing agent.

DETAILED DESCRIPTION OF THE INVENTION

The couplers disclosed, for example, in JP-A-1-154057 can be cited as couplers which release a plurality of photographically useful groups from the same atom on a timing group among the compounds of this present invention, but the use of couplers which release photographically useful groups from different atoms on the timing group are preferred in this present invention. Those which can be represented by general formula [I] are the preferred couplers of this present invention.

General Formula (I)

$$A\text{-}(L_1)_l\text{-}(L_2)m\text{-}[(L_1)_n\text{-}PUG]_s$$

In this formula, A represents a coupler residual group, $L_1$ represents a divalent timing group, $L_2$ represents a timing group with a bond valency of 3 or more and PUG represents a photographically useful group. Moreover, l and n each individually represents 0, 1 or 2, m represents 1 or 2, and s represents a number obtained by subtracting 1 from the valency of $L_2$, being an integer of at least 2. Furthermore, when there is a plurality of $L_1$ groups within the molecule, these may be the same or different. Furthermore, the plurality of PUGs may be the same or different.

The compounds which can be represented by general formula (I) are described in detail below.

In general formula (I), A represents a coupler residual group. For example, A represents a yellow coupler residual group (of the open chain ketomethylene type for example), a magenta coupler residual group (of the 5-pyrazolone type, pyrazoloimidazole type or pyrazolotriazole type for example), a cyan coupler residual group (of the phenol type or naphthol type for example) or a non-color forming coupler residual group (of the indanone type or acetophenone type for example). Furthermore, A may be a coupler residual group of the heterocyclic type disclosed in U.S. Pat. No. 4,315,070, 4,183,752, 3,961,959 or 4,171,223.

Preferred examples of A can be represented by the general formulae (Cp-1), (Cp-2), (Cp-3), (Cp-4), (Cp-5), (Cp-6), (Cp-7), (Cp-8), (Cp-9) or (Cp-10) in shown below. These couplers have a high coupling rate and are preferred.

General Formula (Cp-1):

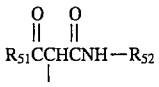

General Formula (Cp-2):

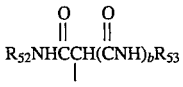

General Formula (Cp-3):

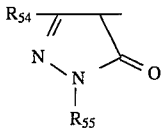

General Formula (Cp-4):

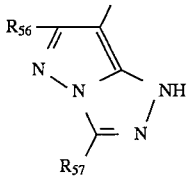

General Formula (Cp-5):

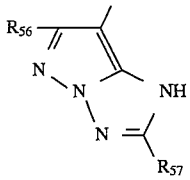

General Formula (Cp-6):

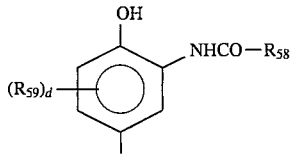

General Formula (Cp-7):

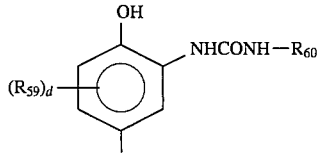

General Formula (Cp-8):

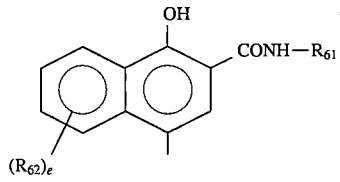

General Formula (Cp-9):

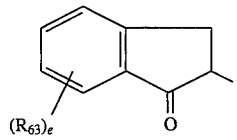

-continued

General Formula (Cp-10):

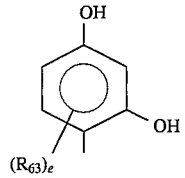

The free bond depending from the coupling position in these formulae indicates the location of the bond with the coupling leaving group.

In those cases where $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ or $R_{63}$ in these formulae includes a ballast group it is selected so that the total number of carbon atoms is from 8 to 40, and preferably from 10 to 30, and in other cases the total number of carbon atoms is preferably not more than 15. In the case of bis, telomeric or polymeric type couplers, any of the above mentioned substituent groups may represent a divalent group which links the repeating units together. In this case, the range for the number of carbon atoms may be outside that specified above.

$R_{51}$–$R_{63}$, b, d and e are defined in detail below. In these definitions, $R_{41}$ represents an aliphatic group, an aromatic group or a heterocyclic group, $R_{42}$ represents an aromatic group or a heterocyclic group, and $R_{43}$, $R_{44}$ and $R_{45}$ individually represent hydrogen atoms, aliphatic groups, aromatic groups or heterocyclic groups.

$R_{51}$ represents a group which has the same meaning as $R_{41}$. Moreover, b represents 0 or 1. $R_{52}$ and $R_{53}$ each represents groups of the same meaning as $R_{42}$. $R_{54}$ represents a group which has the same meaning as $R_{41}$, an

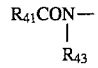

group, an

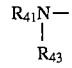

group, an

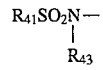

group, an $R_{41}S$— group, an $R_{43}O$— group, an

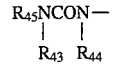

group or an N≡C— group. $R_{55}$ represents a group which has the same meaning as $R_{41}$. $R_{56}$ and $R_{57}$ each represents a group which has the same meaning as $R_{43}$, an $R_{41}S$— group, an $R_{43}O$— group, an

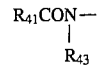

group or an

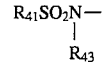

group. $R_{58}$ represents a group which has the same meaning as $R_{41}$. $R_{59}$ represents a group which has the same meaning as $R_{41}$, an $$R_{41}CON(R_{43})-$$

group, an $$R_{41}OCON(R_{43})-$$

group, an $$R_{41}SO_2N(R_{43})-$$

group, an $$R_{43}N(R_{44})CON(R_{45})-$$

group, an $R_{41}O$— group, an $R_{41}S$— group, a halogen atom or an $$R_{41}N(R_{43})-$$

group. Moreover, d represents an integer from 0 to 3. When d is 2 or 3, the $R_{59}$ groups may be the same or different substituent groups. Furthermore, the $R_{59}$ groups may be divalent groups which are joined together to form ring structures. Typical examples of the ring structures formed by the plurality of $R_{59}$ groups include the

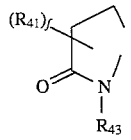

group and the

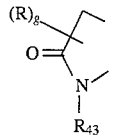

group. Here f represents an integer of 0 to 4, and g represents an integer of 0 to 2. $R_{60}$ represents a group which has the same meaning as $R_{41}$. $R_{61}$ represents a group which has the same meaning as $R_{41}$, and $R_{62}$ represents a group which has the same meaning as $R_{41}$, an $R_{41}OCONH$— group, an $R_{41}SO_2NH$— group, an $$R_{43}N(R_{44})CON(R_{45})-$$

group, an $$R_{43}N(R_{44})SO_2N(R_{45})-$$

group, an $R_{43}O$— group, an $R_{41}S$— group, a halogen atom or an $$R_{41}N(R_{43})-$$

group.

$R_{63}$ represents a group which has the same meaning as $R_{41}$, an $$R_{43}CON(R_{45})(R_{45})-$$

group, an $$R_{43}NCO(R_{44})-$$

group, an $$R_{44}SO_2N(R_{44})-$$

an $$R_{43}NCO(R_{44})-$$

group, an $$R_{41}SO_2N(R_{44})-$$

group, an $$R_{43}NSO_2(R_{43})-$$

group, an $R_{43}$—$SO_2$— group, a halogen atom, a nitro group, a cyano group or an $R_{43}CO$— group. Moreover, e represents an integer of 0 to 4. When there is a plurality of $R_{62}$ or $R_{63}$ groups, these may be the same or different.

The aliphatic groups represented by $R_{41}$ to $R_{45}$ are saturated or unsaturated, chain-like or cyclic, linear chain or branched, substituted or unsubstituted aliphatic hydrocarbyl groups which have from 1 to 32, and preferably from 1 to 22, carbon atoms. Typical examples include methyl, ethyl, propyl, iso-propyl, butyl, tert-butyl, iso-butyl, tert-amyl, hexyl, cyclohexyl, 2-ethylhexyl, octyl, 1,1,3,3-tetramethylbutyl, decyl, dodecyl, hexadecyl and octadecyl groups.

The aromatic groups are substituted or unsubstituted naphthyl groups or substituted or unsubstituted phenyl groups which preferably have from 6 to 20 carbon atoms.

The heterocyclic groups are preferably three to eight membered substituted or unsubstituted heterocyclic groups which have from 1 to 20, and preferably from 1 to 7, carbon atoms and in which the hetero atoms are selected from among nitrogen, oxygen and sulfur atoms. Typical examples of the heterocyclic groups include 2-pyridyl, 2-thienyl, 2-furyl, 1,3,4-thiadiazol-2-yl, 2,4-dioxo-1,3-imidazolidin-5-yl, 1,2,4-triazol-2-yl and 1-pyrazolyl groups.

Typical substituent groups in those cases where the aforementioned aliphatic groups, aromatic groups and heterocyclic groups have substituent groups include halogen atoms, $R_{47}O$— groups, $R_{46}S$— groups, $R_{47}CON(R_{48})$— groups, $R_{47}NCO(R_{48})$— groups, $R_{46}OCON(R_{47})$— groups, $R_{46}SO_2N(R_{47})$— groups, $R_{47}NSO_2(R_{48})$— groups, $R_{46}SO_2$— groups, $R_{47}OCO$— groups, $R_{47}NCON(R_{48})(R_{49})$— groups, groups which have the same significance as $R_{46}$,

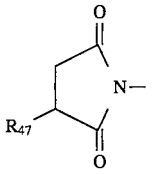

groups, $R_{46}COO$— groups, $R_{47}OSO_2$— as groups, cyano groups and nitro groups. Here, $R_{46}$ represents an aliphatic group, an aromatic group or a heterocyclic group, and $R_{47}$, $R_{48}$ and $R_{49}$ each represents an aliphatic group, an aromatic group, a heterocyclic group or a hydrogen atom. The meaning of the aliphatic groups, aromatic groups and heterocyclic groups is the same as that defined earlier for the $R_{41}$ to $R_{45}$ groups.

The preferred ranges for $R_{51}$–$R_{63}$, d and e are described below.

$R_{51}$ is preferably an aliphatic group or an aromatic group. $R_{52}$, $R_{53}$ and $R_{55}$ are preferably aromatic groups. $R_{54}$ is preferably an $R_{41}CONH$— group or an $R_{41}N(R_{43})$— group. $R_{56}$ and $R_{57}$ are preferably aliphatic groups, aromatic groups, $R_{41}O$— groups or $R_{41}S$— groups. $R_{53}$ is preferably an aliphatic group or an aromatic group. In general formula (Cp-6), $R_{59}$ is preferably a chlorine atom, an aliphatic group or an $R_{41}CONH$— group. Moreover, d is preferably 1 or 2. $R_{60}$ is preferably an aromatic group. In general formula (Cp-7), $R_{59}$ is preferably an $R_{41}CONH$— group, and d is preferably 1. $R_{61}$ is preferably an aliphatic group or an aromatic group. In general formula (Cp-8), e is preferably 0 or 1. $R_{62}$ is preferably an $R_{41}OCONH$— group, an $R_{41}CONH$— group or an $R_{41}SO_2NH$— group, and these are preferably located at the 5-position of the naphthol ring. In general formula (Cp-9), $R_{63}$ is preferably an $R_{41}CONH$— group, an $R_{41}SO_2NH$— group, an $R_{41}NSO_2(R_{43})$— group, an $R_{41}SO_2$— group, an $R_{41}NCO(R_{43})$— group, a nitro group or a cyano group.

In general formula (Cp-10), $R_{63}$ is preferably an $R_{43}NCO(R_{43})$— group, an $R_{43}OCO$— group or an $R_{43}CO$— group.

Typical examples of the $R_{51}$–$R_{63}$ groups are described below.

$R_{51}$ may be a tert-butyl, 4-methoxyphenyl, phenyl, 3-{2-(2,4-di-tert-amylphenoxy)butanamido}phenyl or methyl group. $R_{52}$ and $R_{53}$ may be phenyl, 2-chloro-5-ethoxy, 2-chloro-5-dodecyloxycarbonylphenyl, 2-chloro-5-hexadecylsulfonamidophenyl, 2-chloro-5-tetradecanamidophenyl, 2-chloro-5-{4-(2,4-di-tert-amylphenoxy)butanamido}phenyl, 2-chloro-5-{2-(2,4-di-tert-amylphenoxy)butanamido}phenyl, 2-methoxyphenyl, 2-methoxy-5-tetradecyloxycarbonylphenyl, 2-chloro-5-(1-ethoxycarbonylethoxycarbonyl)phenyl, 2-pyridyl, 2-chloro-5-octyloxycarbonylphenyl, 2,4-dichlorophenyl, 2-chloro-5-(1-dodecyloxycarbonylethoxycarbonyl)phenyl, 2-chlorophenyl or 2-ethoxyphenyl group.

$R_{54}$ may be a butanoylamino, 2-chloro-3-propanoylaminoanilino, 3-{2-(2,4-di-tert-amylphenoxy) butanamido}-benzamido, 3-{4-(2,4-di-tert-amylphenoxy) butanamido}-benzamido, 2-chloro-5-tetradecanamidoanilino, 5-(2,4-di-tert-amylphenoxyacetamido)benzamido, 2-chloro-5-dodecenylsuccinimidoanilino, 2-chloro-5-{2-( 3-tert-butyl-4-hydroxyphenoxy)tetradecanamido}anilino, 2,2-dimethylpropanamido, 2-(3-pentadecylphenoxy) butanamido, pyrrolidino or N,N-dibutylamino group. $R_{55}$ may be a 2,4,6-trichlorophenyl, 2-chlorophenyl, 2,5-dichlorophenyl, 2,3-dichlorophenyl, 2,6-dichloro-4-methoxyphenyl, 4-{2-(2,4-di-tert-amylphenoxy) butanamido}phenyl or 2,6-dichloro-4-methanesulfonylphenyl group. $R_{56}$ may be a methyl, ethyl, isopropyl, methoxy, ethoxy, methylthio, ethylthio, 3-phenylureido or 3-(2,4-di-tert-amylphenoxy)propyl group. $R_{57}$ may be a 3-(2,4-di-tert-amylphenoxy)propyl, 3-[4-{2-[4-(4-hydroxyphenylsulfonyl)-phenoxy] tetradecanamido}phenyl]propyl, methoxy, methylthio, ethylthio, methyl, 1-methyl-2-(2-octyloxy-5-[2-octyloxy-5-(1,1,3,3-tetramethylbutyl)phenylsulfonamido]-phenylsulfonamido)ethyl, 3-{4-(4-dodecyloxyphenylsulfonamido)phenyl}propyl, 1,1,-dimethyl- 2-(2-octyloxy-5-(1,1,3,3-tetramethylbutyl)phenylsulfonamidoethyl or dodecylthio group. $R_{58}$ may be a 2-chlorophenyl, pentafluorophenyl, heptafluoropropyl, 1-(2,4-di-tert-amylphenoxy)propyl, 3-(2,4-di-tert-amylphenoxy)propyl, 2,4-di-tert-amylmethyl or furyl group. $R_{59}$ may be a chlorine atom or a methyl, ethyl, propyl, butyl, isopropyl, 2-(2,4-di-tert-amylphenoxy)butanamido, 2-(2,4-di-tert-amylphenoxy) hexanamido, 2-(2,4-di-tert-octylphenoxy)octanamido, 2-( 2-chlorophenoxy)tetradecanamido, 2-(4-(4-hydroxyphenylsulfonyl)phenoxy}tetradecanamido or 2-{2-(2,4-di-tert-amylphenoxyacetamido)phenoxy}butanamido group. $R_{60}$ may be a 4-cyanophenyl, 2-cyanophenyl, 4-butylsulfonylphenyl, 4-propylsulfonylphenyl, 4-chloro-3-cyanophenyl, 4-ethoxy-carbonylphenyl or 3,4-dichlorophenyl group. $R_{61}$ may be a propyl, 2-methoxyphenyl, dodecyl, hexadecyl, cyclohexyl, 3-(2,4-di-tert-amylphenoxy)propyl, 4-(2,4-di-tert-amylphenoxy)-butyl, 3-dodecyloxypropyl, tert-butyl, 2-methoxy-5-dodecyloxycarbonylphenyl or 1-naphthyl group. $R_{62}$ may be an isobutyloxycarbonylamino, ethoxycarbonylamino, phenylsulfonylamino, methanesulfonamido, benzamido, trifluoroacetamido, 3-phenylureido, butoxycarbonylamino or acetamido group. $R_{63}$ may be a 2,4-di-tert-amylphenoxyacetamido, 2-(2,4-di-tert-amylphenoxy)butanamido, hexadecylsulfonamido, N-methyl-N-octadecylsulfamoyl, N,N-dioctylsulfamoyl, 4-tert-octylbenzoyl, dodecyloxycarbonyl group, a chlorine atom, or a nitro, cyano, N-{4-(2,4-di-tert-amylphenoxy)butyl}carbamoyl, N-3-3(2,4-di-tert-amylphenoxy)propylsulfamoyl, methanesulfonyl or hexadecylsulfonyl group.

The groups shown below are preferred for the $L_1$ groups in general formula [I].

(1) Groups with which a Hemi-acetal Cleavage Reaction Occurs:

The groups disclosed, for example, in U.S. Pat. No. 4,146,396, JP-A-60-249148 and JP-A-60-249149, and the groups represented by the general formula (T-1) shown below. Here, * indicates the position which is bonded to A, $L_1$ or $L_2$ of the compound represented by general formula [I], and ** indicates the position which is bonded to $L_1$, $L_2$ or PUG.

General Formula (T-1)

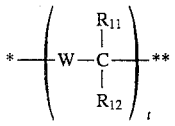

In this formula, W represents an oxygen atom, a sulfur atom or an

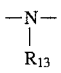

group, $R_{11}$ and $R_{12}$ each represent hydrogen atoms or substituent groups, $R_{13}$ represents a substituent group and t represents 1 or 2. When t is 2 the two

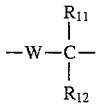

groups may be the same or different. Typical examples of the substituent groups represented by $R_{11}$, $R_{12}$ and $R_{13}$ include $R_{15}$, $R_{15}CO$—, $R_{15}SO_2$—,

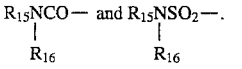

Here, $R_{15}$ represents an aliphatic group, an aromatic group or a heterocyclic group, and $R_{16}$ represents a hydrogen atom, an aliphatic group, an aromatic group or a heterocyclic group. Those cases in which at least two of $R_{11}$, $R_{12}$ and $R_{13}$ each represents divalent groups which are joined together to form ring structures are also included. Specific examples of groups represented by general formula (T-1) are shown below:

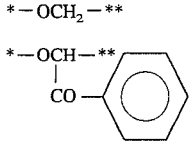

(1)

(2)

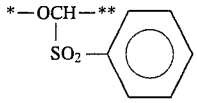

(3)

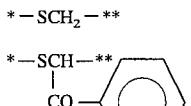

(4)

(5)

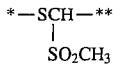

(6)

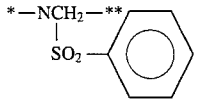

(7)

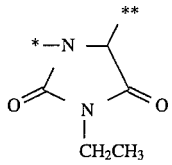

(8)

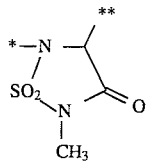

(9)

(2) Groups with which a Cleavage Reaction Occurs Via an Intramolecular Nucleophilic Substitution Reaction:

For example, the timing groups disclosed in U.S. Pat. No. 4,248,292 can be represented by the following general formula (T-2):

General Formula (T-2)

* -Nu-Link-E- **

In this formula, Nu represents a nucleophilic group, with oxygen and sulfur atoms being examples of the nucleophilic species; E represents an electrophilic group, which group is subjected to nucleophilic attack by Nu and with which the bond marked ** can be cleaved; and Link is a linking group which enables Nu and E to have a steric arrangement such that an intramolecular nucleophilic substitution reaction can occur. Specific examples of groups represented by general formula (T-2) are shown below.

(1)

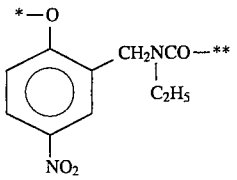

(2)

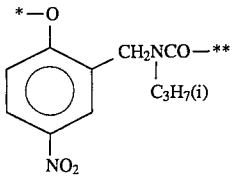

(3)

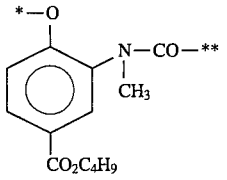

(4)

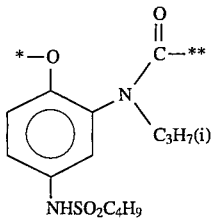

(5)

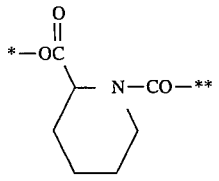

(6)

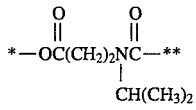

(7)

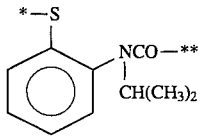

(8)

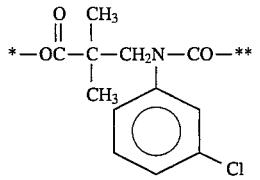

(3) Groups in which a Cleavage Reaction Occurs Via an Electron Transfer Reaction along a Conjugated System:

Such groups include those disclosed in U.S. Pat. Nos. 4,409,323 and 4,421,845, JP-A-57-188035, JP-A-58-98728, JP-A-58-209736, JP-A-58-209737 and JP-A-58-209738, and the groups represented by the general formula (T-3):

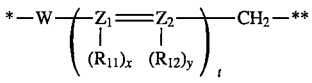

General Formula (T-3)

In this formula, *, **, W, $R_{11}$, $R_{12}$ and t all have the same meaning as described in connection with (T-1). However, $R_{11}$ and $R_{12}$ may be joined together to form a benzene ring or a structural element of a heterocyclic ring. Further, $R_{11}$ or $R_{12}$ and W may be joined together to form a benzene ring or a heterocyclic ring. Furthermore, $Z_1$ and $Z_2$ each independently represents a carbon atom or a nitrogen atom, and x and y represent 0 or 1. Thus, x is 1 when $Z_1$ is a carbon atom, and x is 0 when $Z_1$ is a nitrogen atom. The relationship between $Z_2$ and y is the same as that between $Z_1$ and x. Furthermore, t represents 1 or 2, and when t is 2 the two

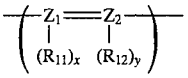

groups may be the same or different.

Specific examples of (T-3) are shown below:

(1)

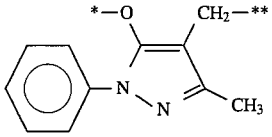

(2)

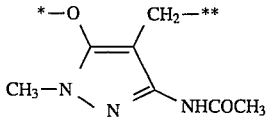

(3)

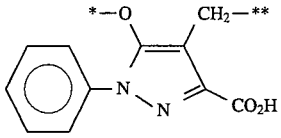

(4)

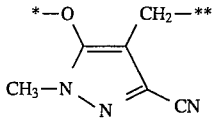

(5)

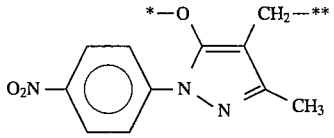

(6)

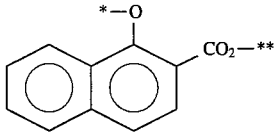

(7)

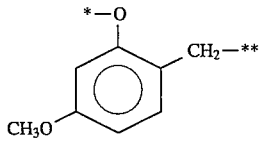

-continued (8)

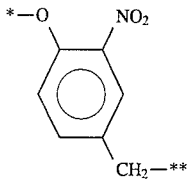

(9)

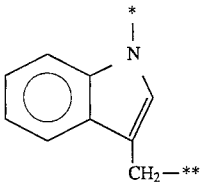

(10)

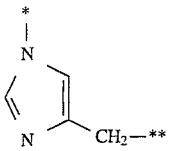

(11)

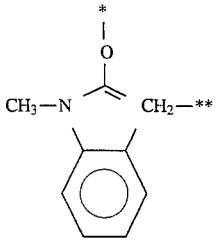

(12)

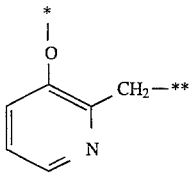

(13)

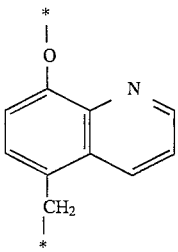

(14)

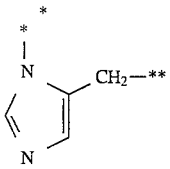

(15)

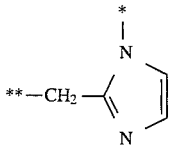

-continued (16)

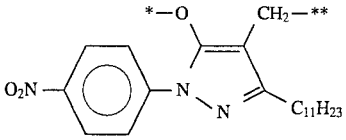

(17)

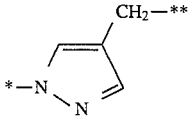

(4) Groups with which a Cleavage Reaction due to Ester Hydrolysis Occurs:

For example, the linking groups disclosed in West German Patent Laid Open 2,626,315, and the groups indicated below. In these formulae, * and ** have the same meaning as described in connection with general formula (T-1).

General Formula (T-4)

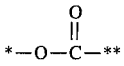

General Formula (T-5)

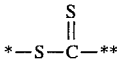

(5) Groups with which an Iminoketal Cleavage Reaction Occurs:

For example, the linking groups disclosed in U.S. Pat. No. 4,546,073, and the groups represented by the general formula (T-6) indicated below.

General Formula (T-6)

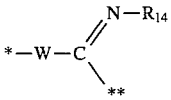

In this formula, *, ** and W have the same meaning as described in connection with general formula (T-1) and $R_{14}$ has the same meaning as $R_{13}$.

Specific examples of groups represented by general formula (T-6) are shown below:

(1)

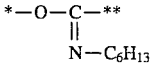

(2)

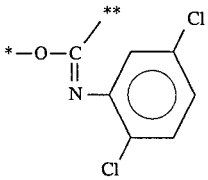

(3)

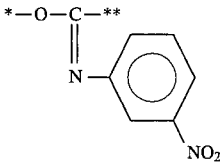

The groups represented by (T-1) to (T-5) are preferred for $L_1$, and those represented by (T-1) and (T-4) are especially desirable.

Moreover, l is preferably 0 or 1.

Moreover, n is preferably 0 or 1, and it is most desirably 0.

The groups represented by $L_2$ in general formula (I) are electron transfer type timing groups of a valency of at least 3, and the groups which can be represented by the general formula (T-$L_2$) shown below are preferred.

General Formula (T-$L_2$):

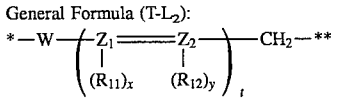

In this formula, W, $Z_1$, $Z_2$, $R_{11}$, $R_{12}$, x, y and t have the same meaning as those described in connection with general formula (T-3). Furthermore, * indicates the position which is bonded to A-$(L_1)_l$- in general formula [I], and ** indicates the position which is bonded to -$(L_1)$n-PUG. However, at least one of the plurality of $R_{11}$ and $R_{12}$ groups represent —$CH_2$-$(L_1)$-PUG.

Those cases in which W is a nitrogen atom are preferred for (T-$L_2$), those cases in which W and $Z_2$ are bonded together to form a five membered ring are more desirable, and those cases in which an imidazole ring or an pyrazole ring is formed are especially desirable.

Specific examples of (T-$L_2$) are indicated below, but the invention is not limited to these examples:

(1)

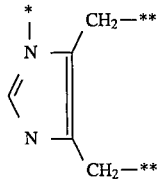

(2)

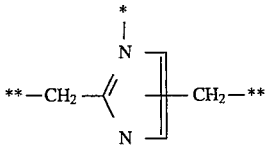

(3)

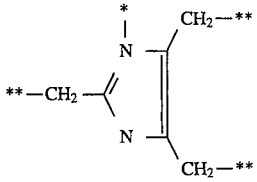

(4)

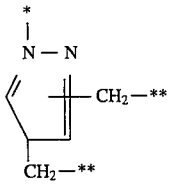

-continued (5)

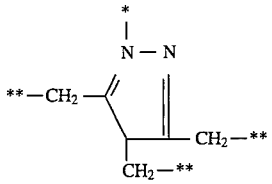

(6)

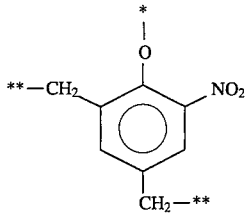

(7)

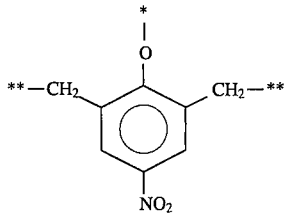

(8)

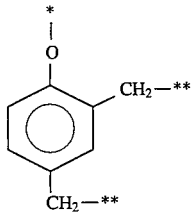

(9)

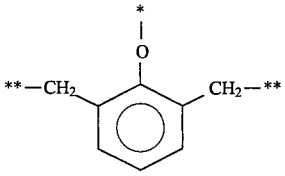

(10)

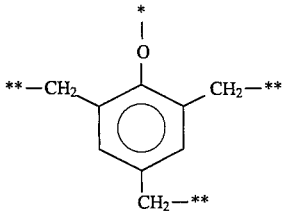

(11)

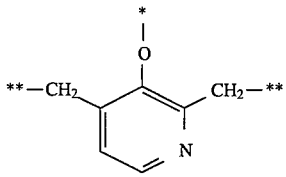

-continued (12)

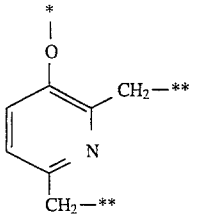

(13)

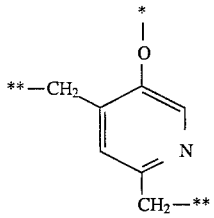

(14)

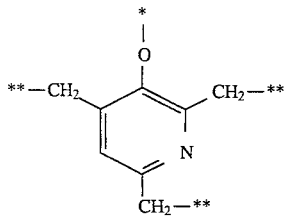

(15)

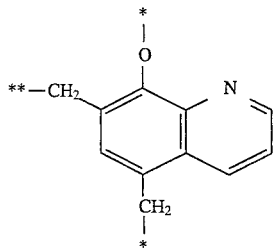

Moreover, the groups cited as specific examples may be further substituted, and examples of such substituent groups include alkyl groups (for example, methyl, ethyl, isopropyl, t-butyl, hexyl, methoxymethyl, methoxyethyl, chloroethyl, cyanoethyl, nitroethyl, hydroxypropyl, carboxyethyl, dimethylaminoethyl, benzyl, phenethyl), aryl groups (for example, phenyl, naphthyl, 4-hydroxyphenyl, 4-cyanophenyl, 4-nitrophenyl, 2-methoxyphenyl, 2,6-dimethylphenyl, 4-carboxyphenyl, 4-sulfophenyl), heterocyclic groups (for example 2-pyridyl, 4-pyridyl, 2-furyl, 2-thienyl, 2-pyrrolyl ), halogen atoms (for example, chloro, bromo), a nitro group, alkoxy groups (for example, methoxy, ethoxy, isopropoxy), aryloxy groups (for example, phenoxy), alkylthio groups (for example, methylthio, isopropylthio, tertbutylthio), arylthio groups (for example, phenylthio), amino groups (for example, amino, dimethylamino, diisopropylamino), acylamino groups (for example, acetylamino, benzoylamino), sulfonamido groups (for example, methanesulfonamido, benzenesulfonamido), a cyano group, a carboxyl group, alkoxycarbonyl groups (for example, methoxycarbonyl, ethoxycarbonyl), aryloxycarbonyl groups (for example, phenoxycarbonyl), and carbamoyl groups (for example, N-ethylcarbamoyl, N-phenylcarbamoyl).

Among these substituent groups, the alkyl groups, a nitro group, alkoxy groups, alkylthio groups, amino groups, acylamino groups, sulfonamido groups, alkoxycarbonyl groups and carbamoyl groups are preferred.

The photographically useful groups represented by PUG in general formula (I) are development inhibitors, dyes, fogging agents, developing agents, couplers, bleaching accelerators or fixing accelerators, for example. Examples of preferred photographically useful groups include those disclosed in U.S. Pat. No. 4,248,962 (those represented by the general formula PUG in that specification), the dyes disclosed in JP-A-62-49353 (the leaving group parts which are released from the coupler in that specification), the development inhibitors disclosed in U.S. Pat. No. 4,477,563 and the bleaching accelerators disclosed in JP-A-61-201247 and Japanese Patent Application 62-248131 (the leaving group parts which are released from the coupler in that specifications). In the present invention, development inhibitors are the most desirable photographically useful groups.

The groups represented by the general formulae (INH-1) to (INH-13) shown below are preferred as PUG development inhibitors:

(INH-1)

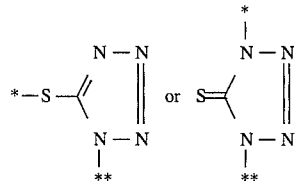

(INH-2)

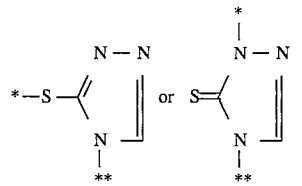

(INH-3)

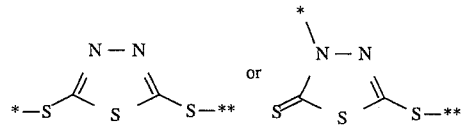

(INH-4)

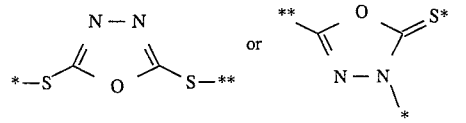

(INH-5)

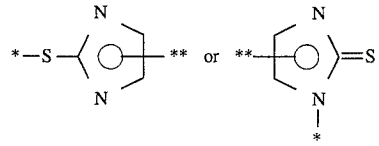

(INH-6)

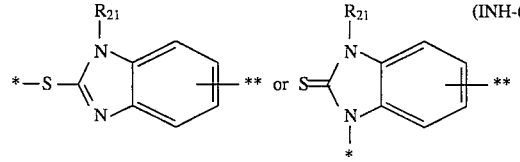

In these formulae, $R_{21}$ represents a hydrogen atom or a substituted or unsubstituted $C_1$–$C_{10}$ hydrocarbyl group (for example, methyl, ethyl, propyl, phenyl).

(INH-7)

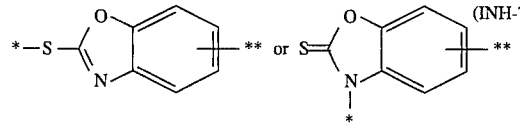

-continued

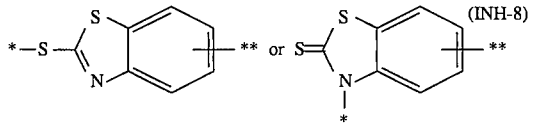

(INH-8)

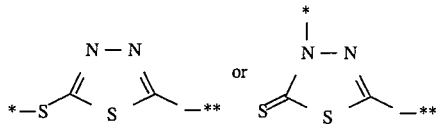

(INH-9)

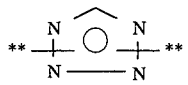

(INH-10)

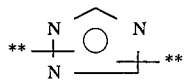

(INH-11)

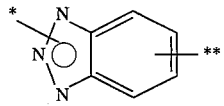

(INH-12)

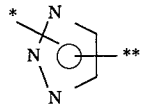

(INH-13)

In these formulae, * indicates the position which is bonded to the group represented by $L_1$ or $L_2$ of the compound represented by general formula (I).

Furthermore, ** indicates the position at which a substituent group is bonded, and the substituent group may be, for example, a substituted or unsubstituted alkyl group, aryl group or heterocyclic group, and a group which is degraded in the processing bath during photographic processing is preferable among in these substituent groups.

In practice, examples of the alkyl groups include methyl, ethyl, propyl, butyl, hexyl, decyl, isobutyl, tert-butyl, 2-ethylhexyl, benzyl, 4-methoxybenzyl, phenethyl, propyloxycarbonylmethyl, 2-(propyloxycarbonyl)ethyl, butyloxycarbonylmethyl, pentyloxycarbonylmethyl, 2-cyanoethyloxycarbonylethyl, 2,2-dichloroethyloxycarbonylmethyl, 3-nitropropyloxycarbonylmethyl, 4-nitrobenzyloxycarbonylmethyl and 2,5-dioxo-3,6-octadecyl groups. Furthermore, examples of the aryl groups include phenyl, naphthyl, 4-methoxycarbonylphenyl, 4-ethoxycarbonylphenyl, 3-methoxycarbonylphenyl and 4-(2-cyanoethyloxycarbonyl) phenyl groups.

Furthermore, examples of the heterocyclic groups include 4-pyridyl, 3-pyridyl, 2-pyridyl, 2-furyl and 2-tetrahydropyranyl groups.

Among these formula, ( INH-1), ( INH-2), (INH-3), (INH-4), ( INH-9) and (INH-12) are preferred for INH, and (INH-1), (INH-2) and (INH-3) are especially desirable.

Specific examples of the PUC-releasing couplers of this invention are shown below, but the invention is not limited by these examples.

Illustrative Compounds (1)

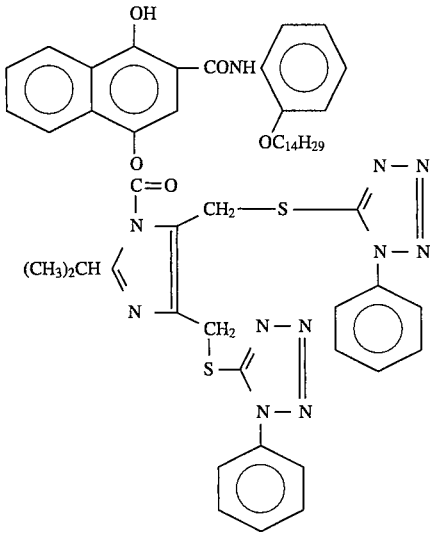

(2)

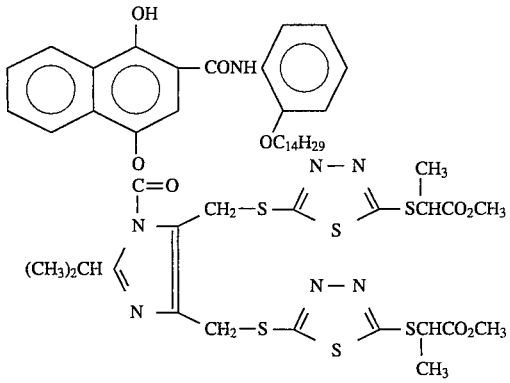

-continued
Illustrative Compounds
(3)
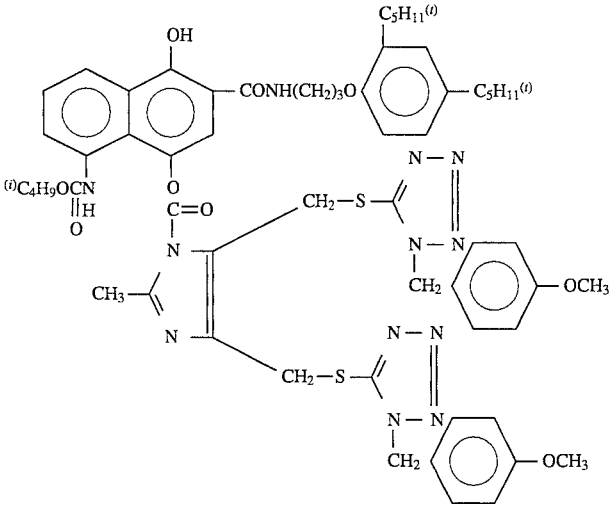
(4)
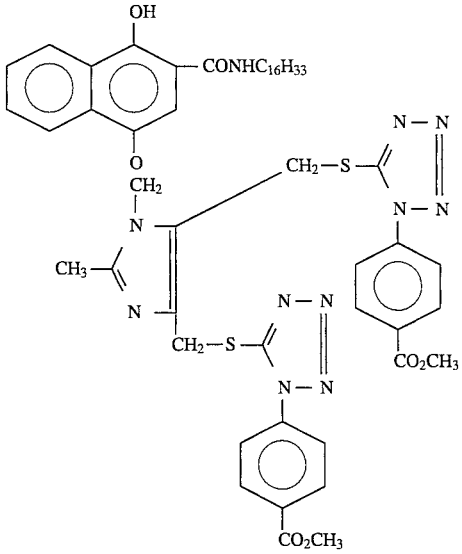
(5)
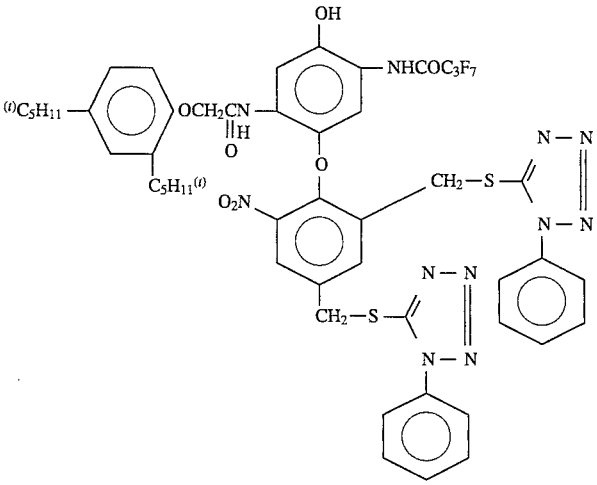

-continued
Illustrative Compounds
(6)
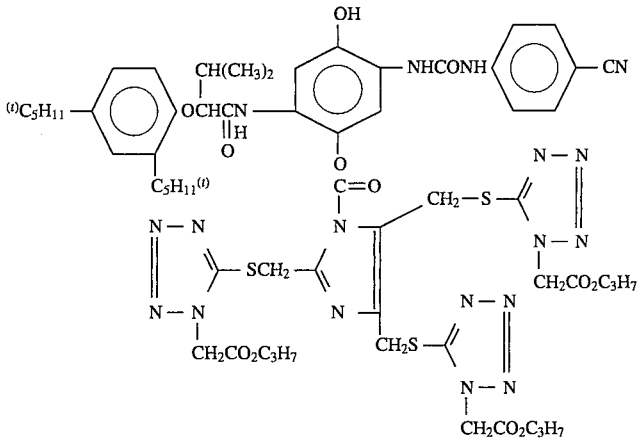
(7)
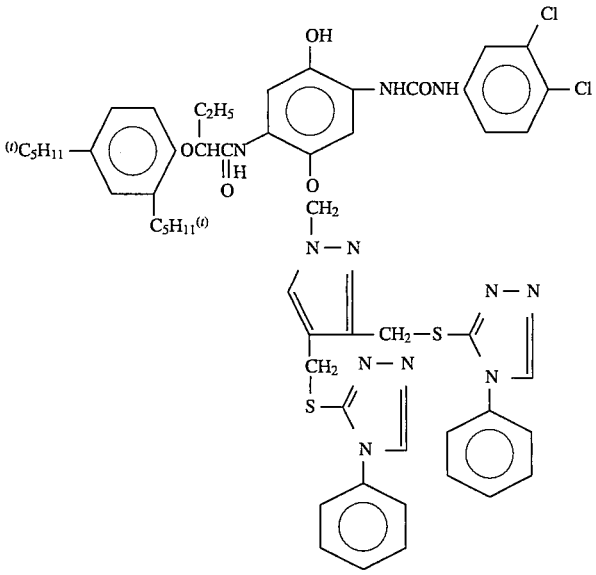
(8)
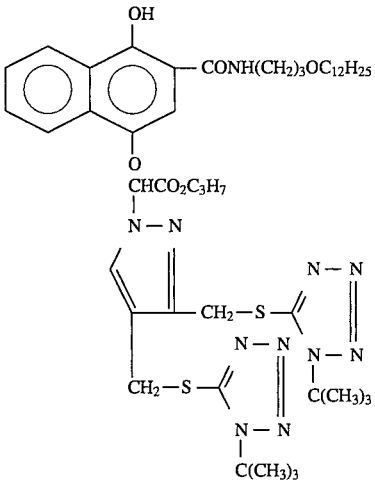
(9)
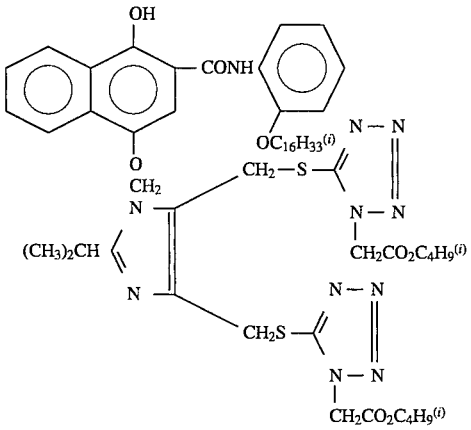

-continued
Illustrative Compounds
(10)
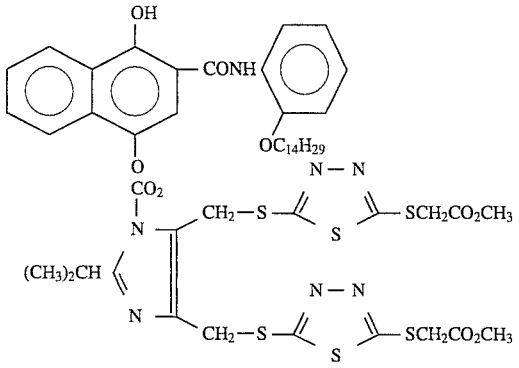
(11)
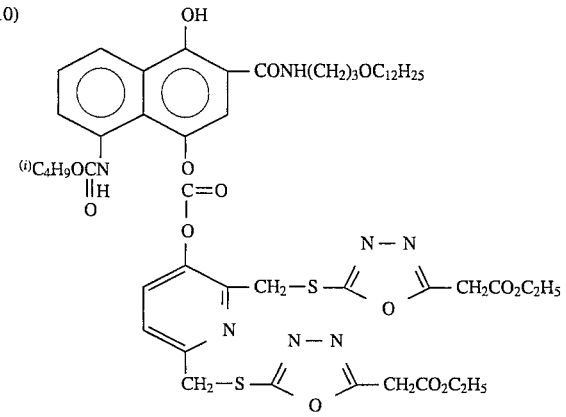
(12)
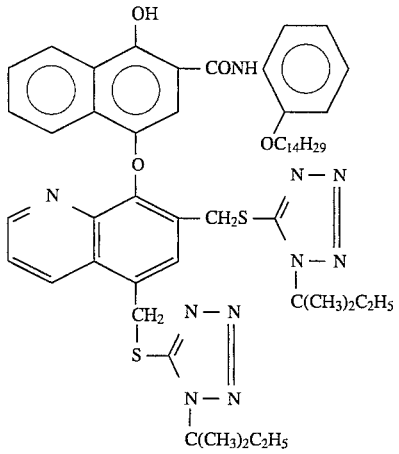
(13)
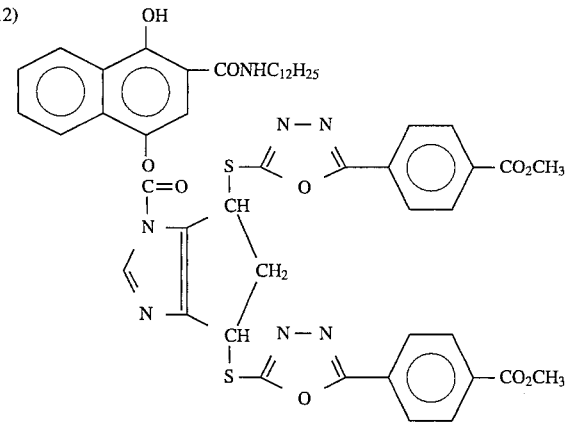
(14)
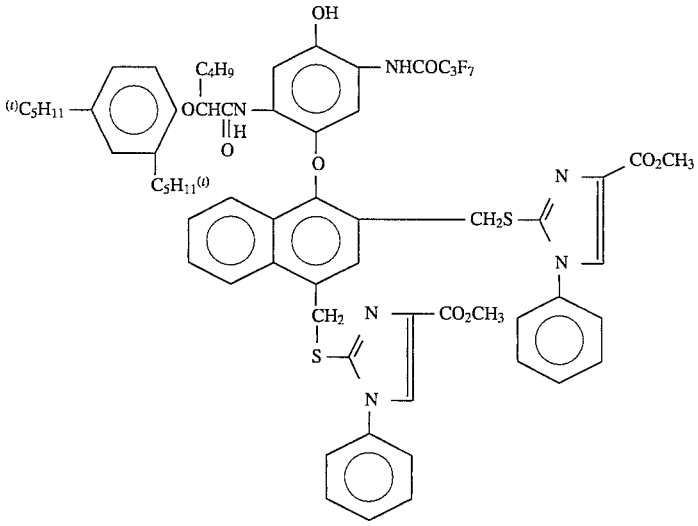

-continued
Illustrative Compounds
(15)
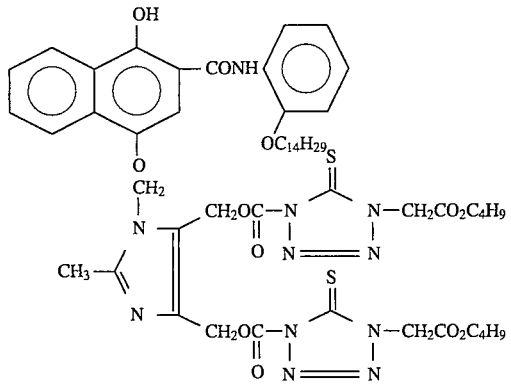
(16)
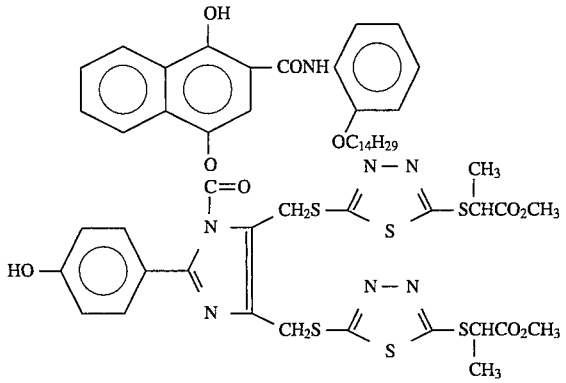
(17)
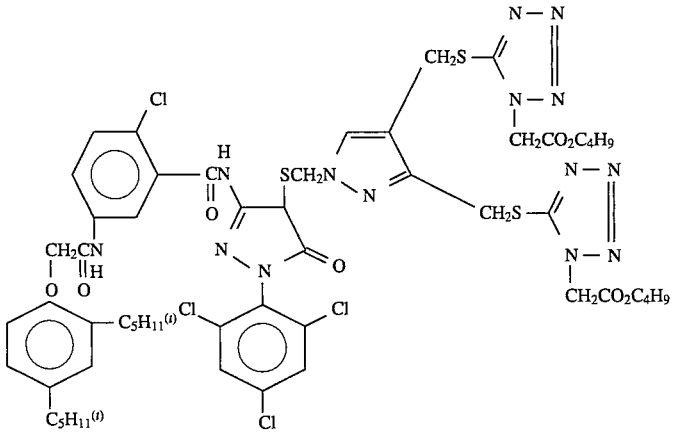
(18)
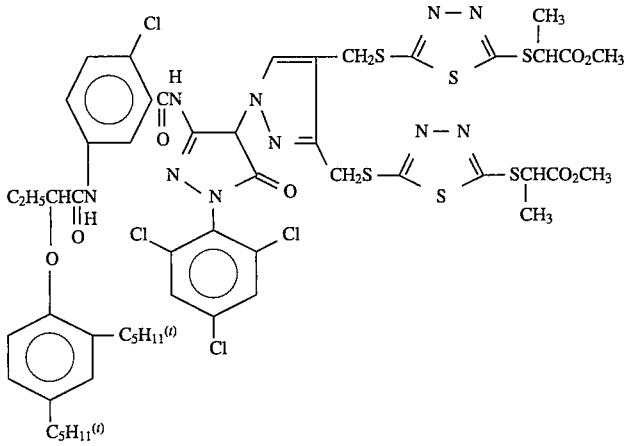

-continued
Illustrative Compounds
(19)
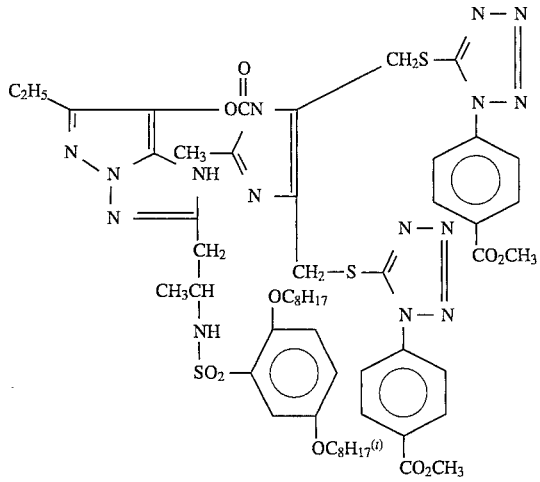
(20)
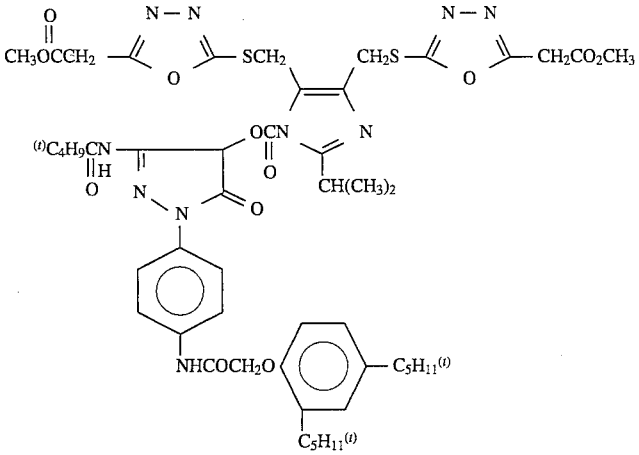
(21)
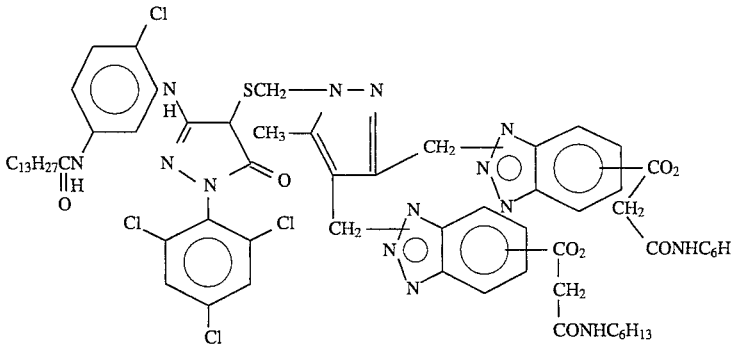
(22)
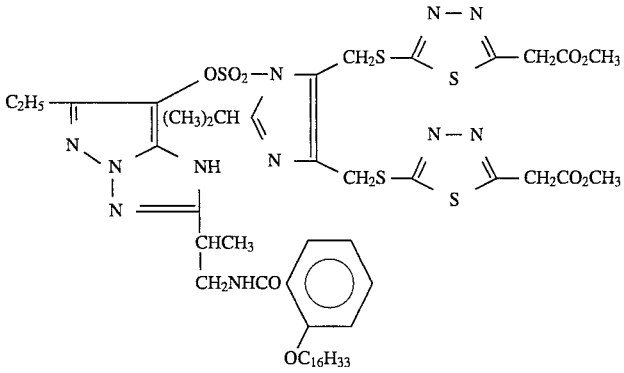

-continued
Illustrative Compounds
(23)
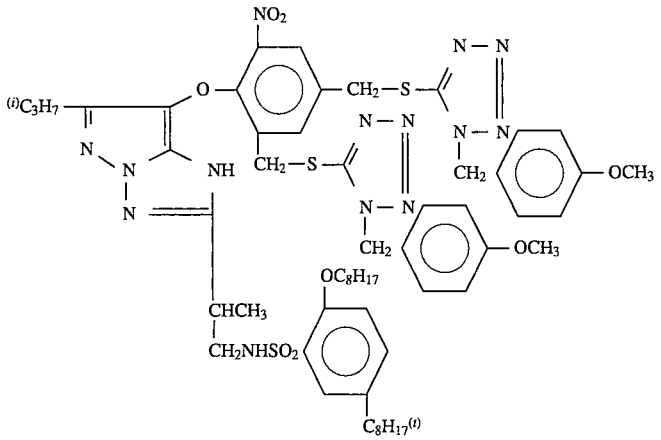
(24)
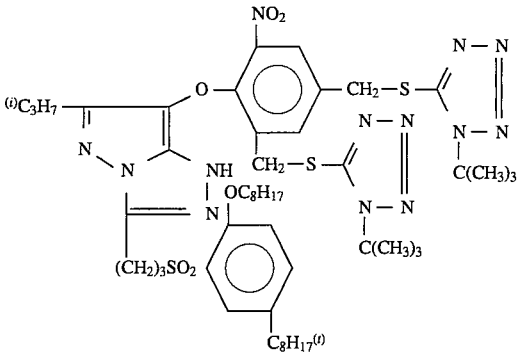
(25)
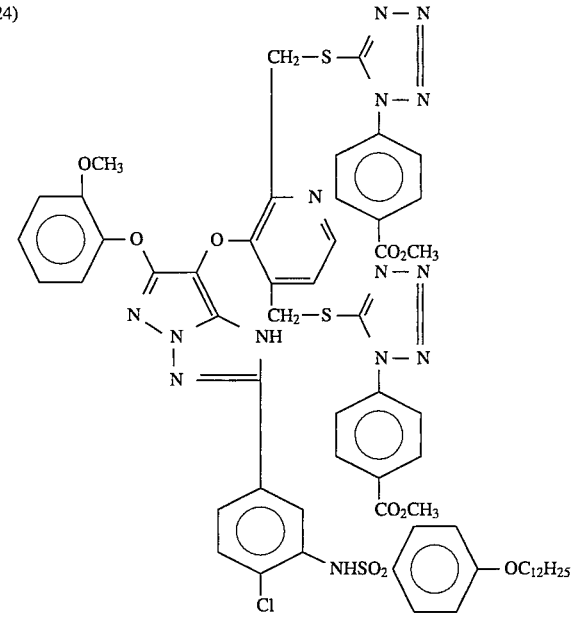
(26)
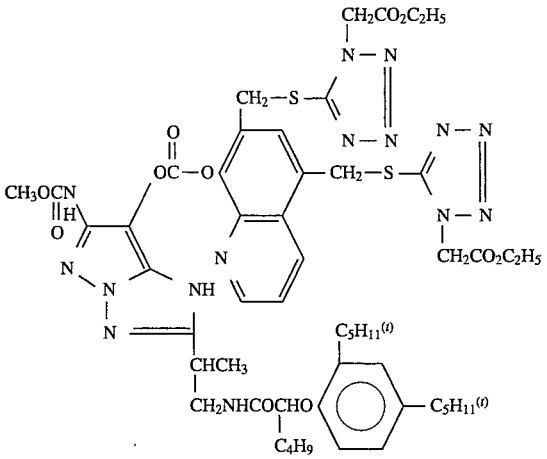

-continued
Illustrative Compounds
(27)
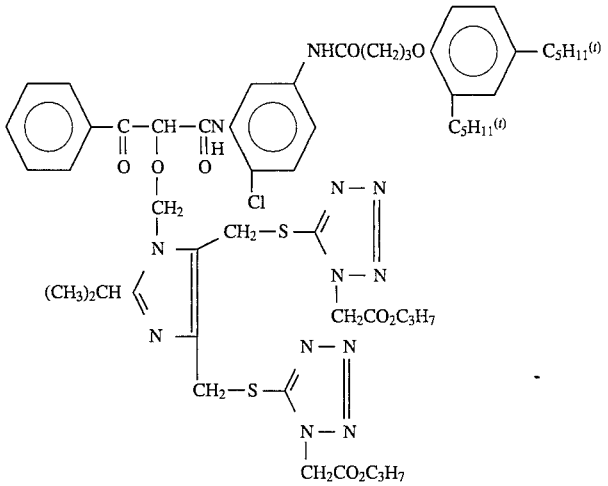
(28)
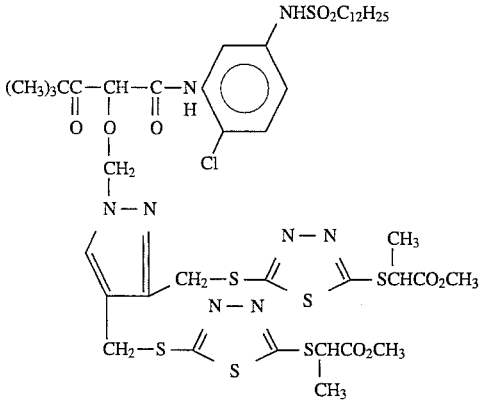
(29)
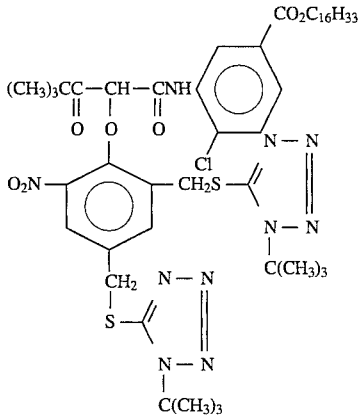
(30)
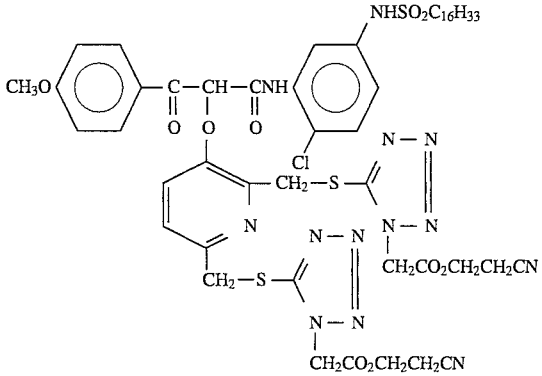

-continued
Illustrative Compounds
(31)
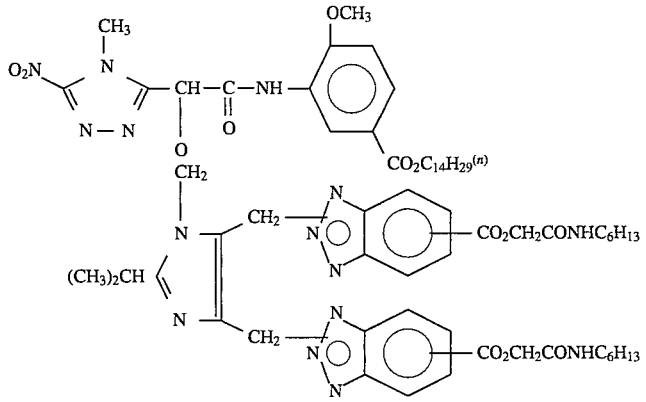
(32)
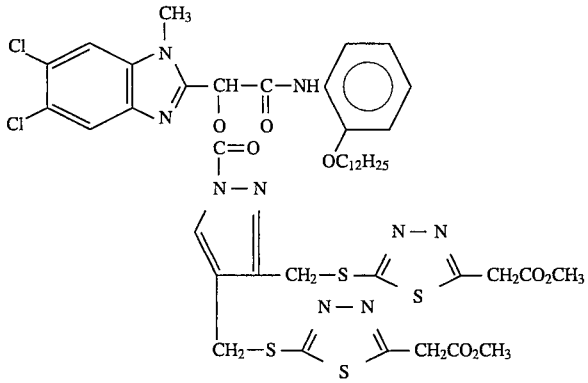
(33)
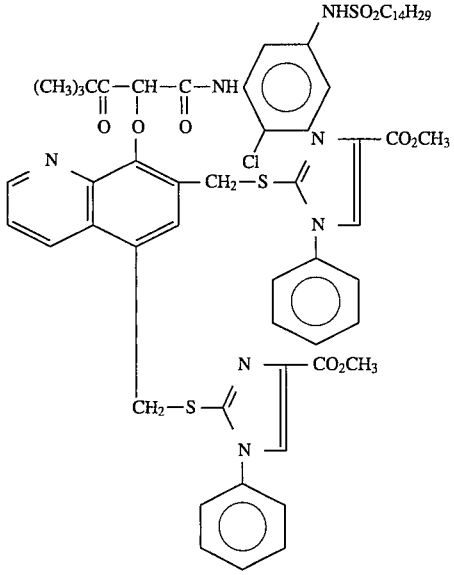
(34)
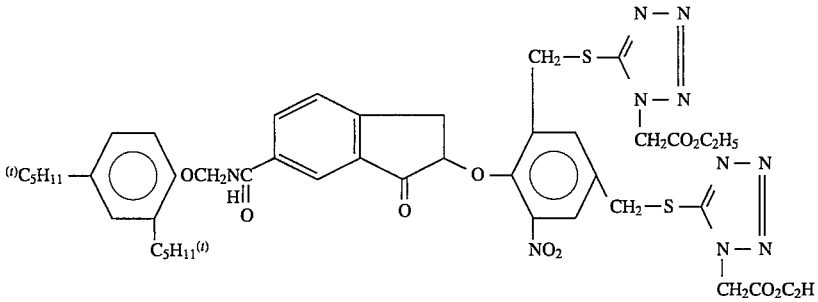

-continued
Illustrative Compounds
(35)
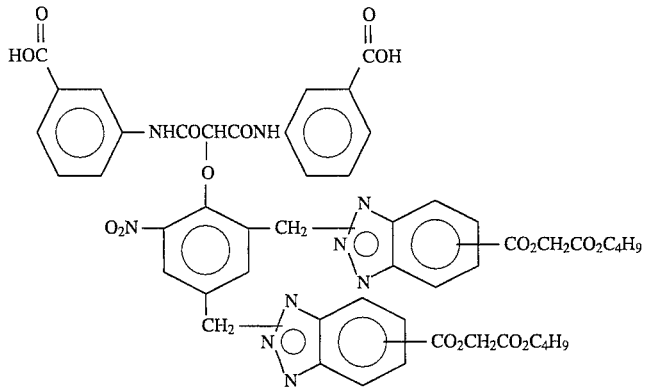
(36)
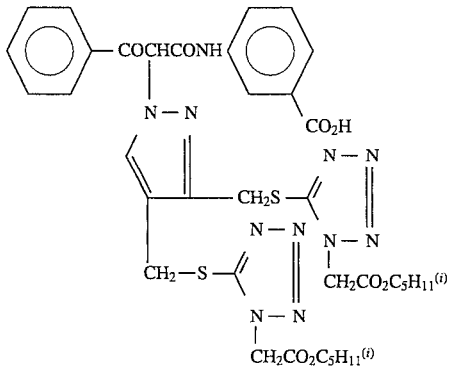
(37)
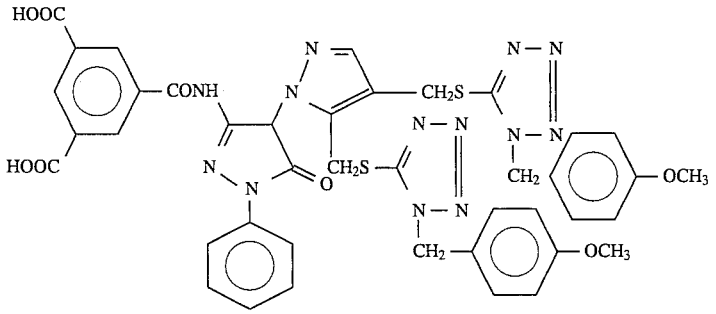

-continued
Illustrative Compounds
(38)
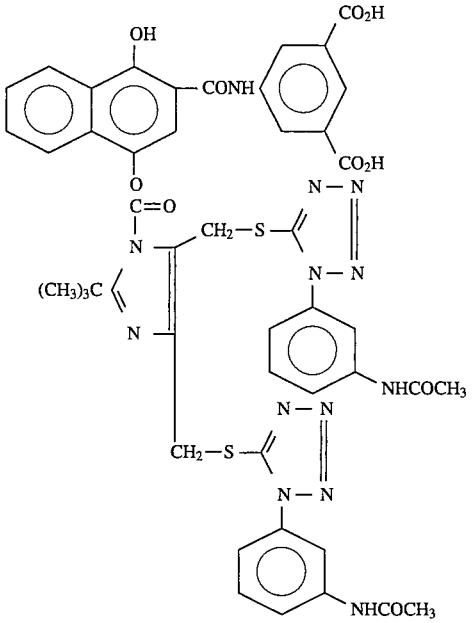
(39)
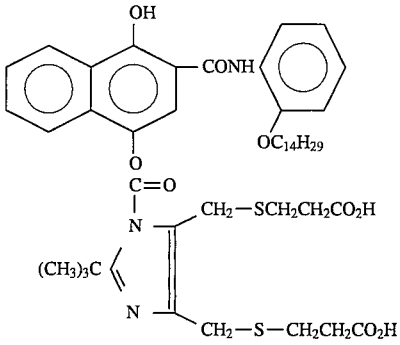
(40)
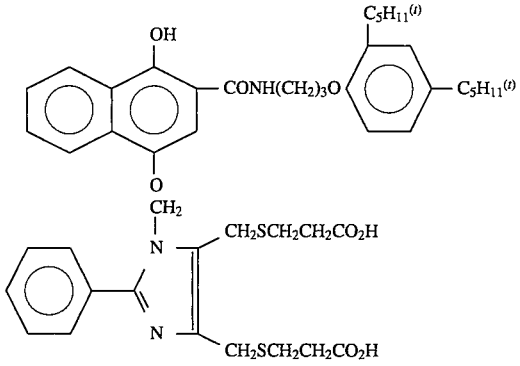
(41)
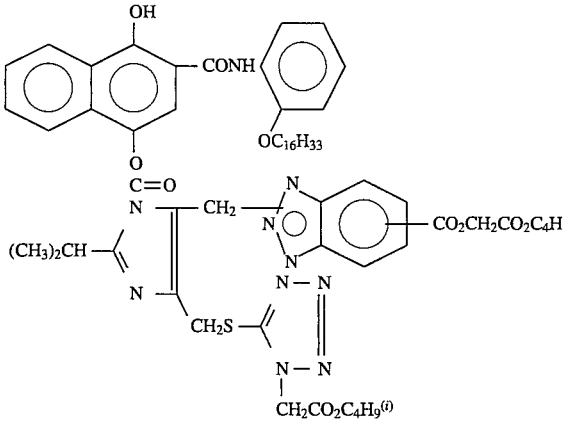

-continued
Illustrative Compounds
(42)
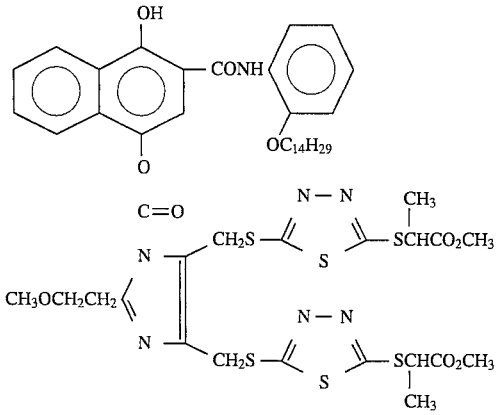
(43)
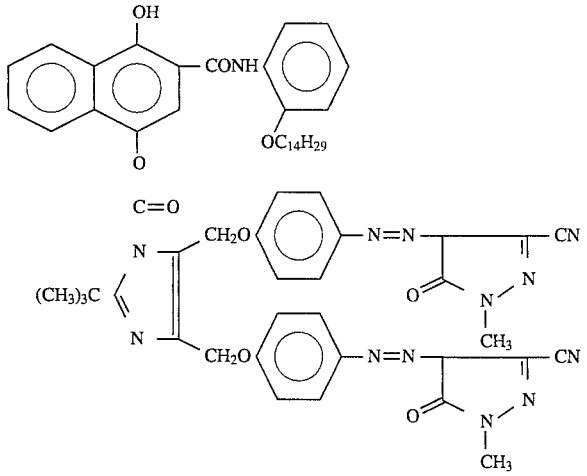
(44)
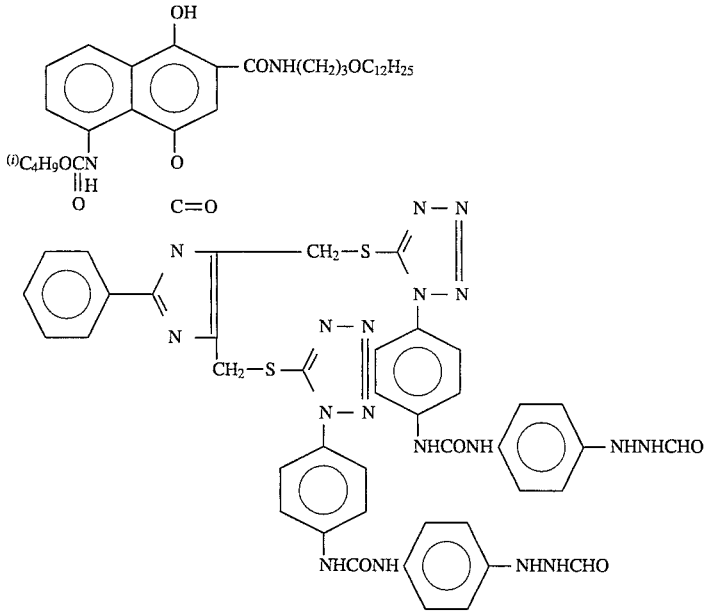

-continued
Illustrative Compounds
(45)
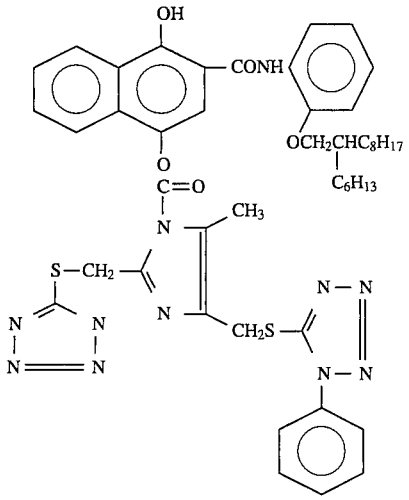
(46)
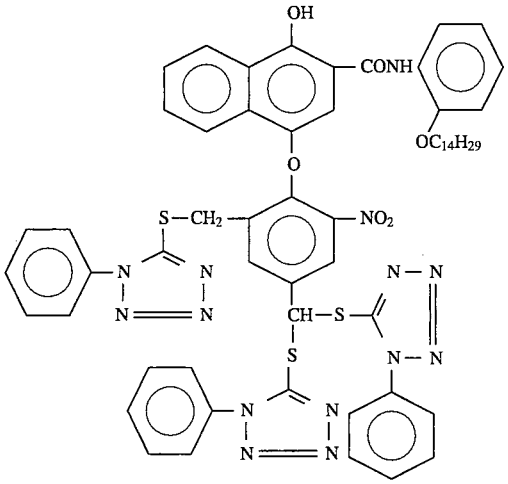
(47)
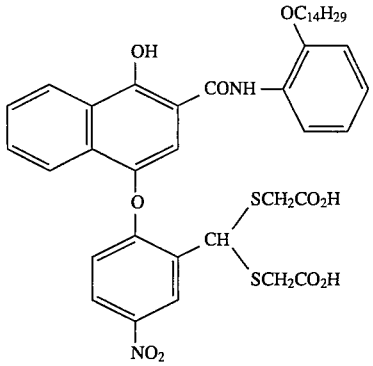
(48)
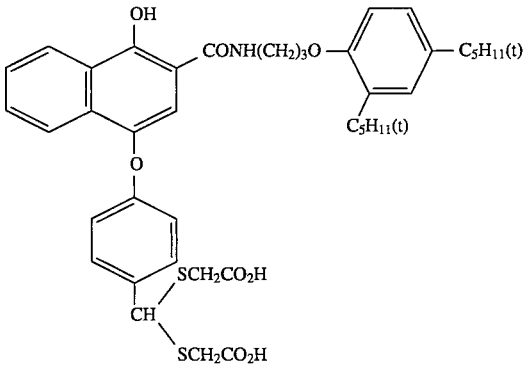
(49)
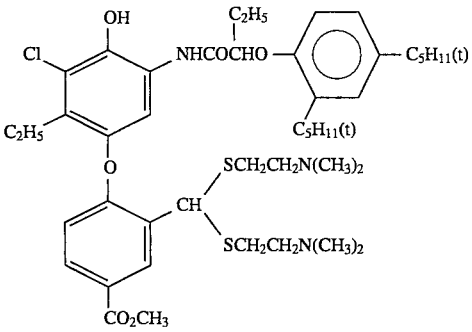
(51)
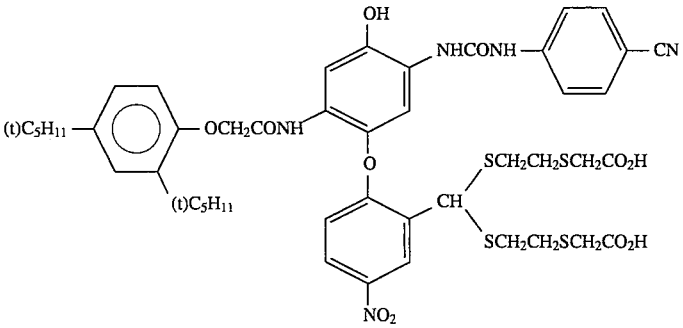

-continued
Illustrative Compounds
(50)
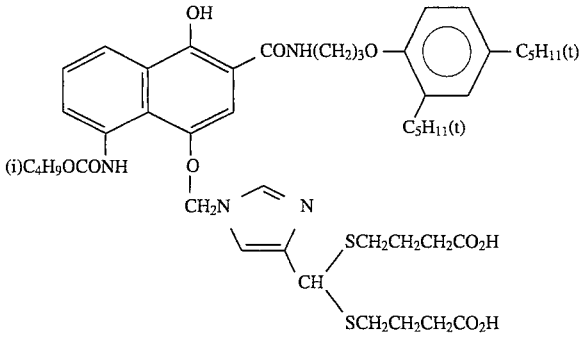
(53)
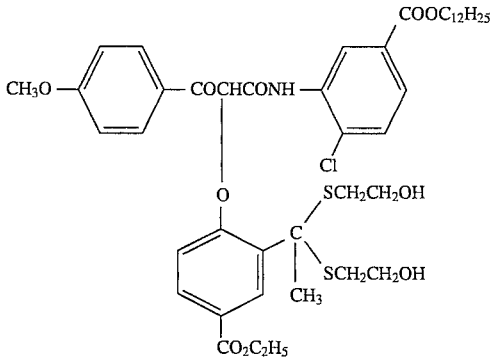
(52)
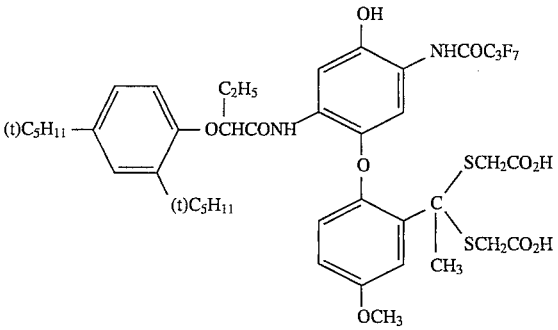
(54)
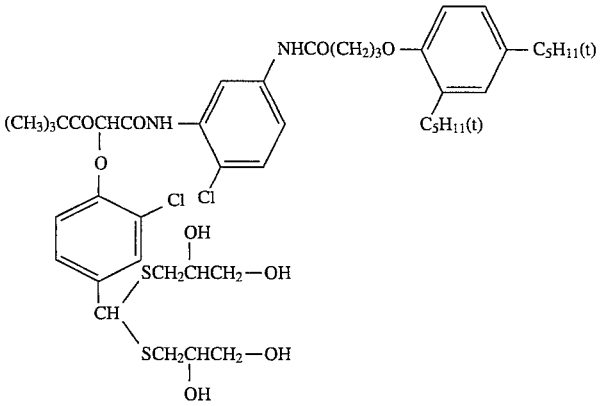

-continued
Illustrative Compounds
(55)
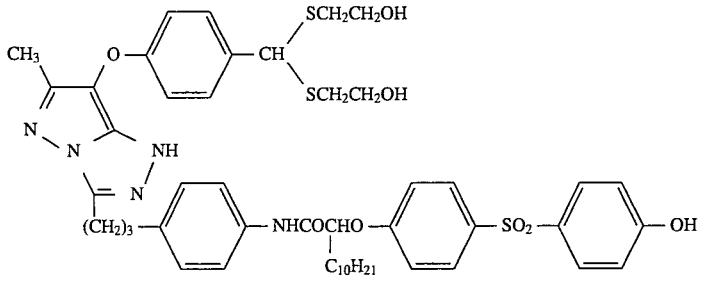
(56)
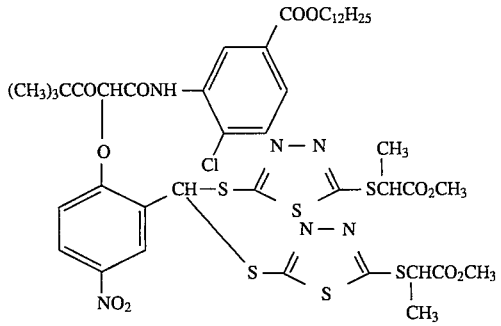
(57)
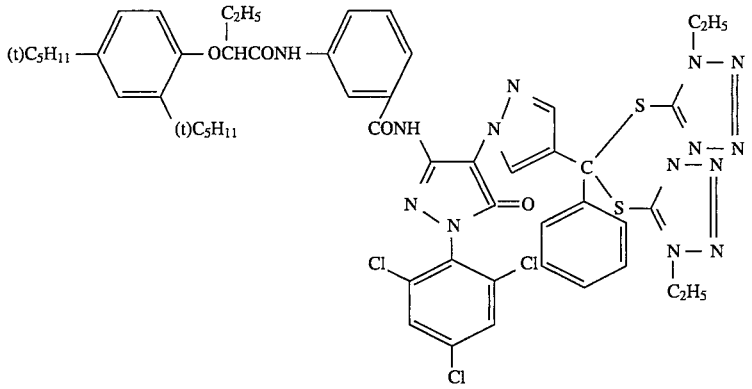
(58)
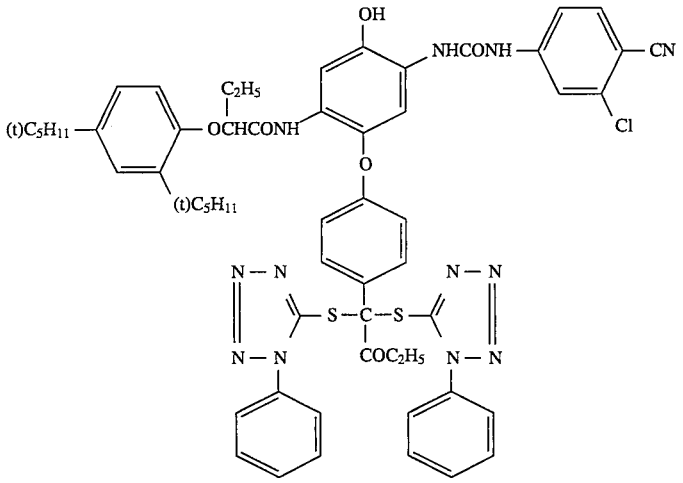

-continued
Illustrative Compounds
(59)
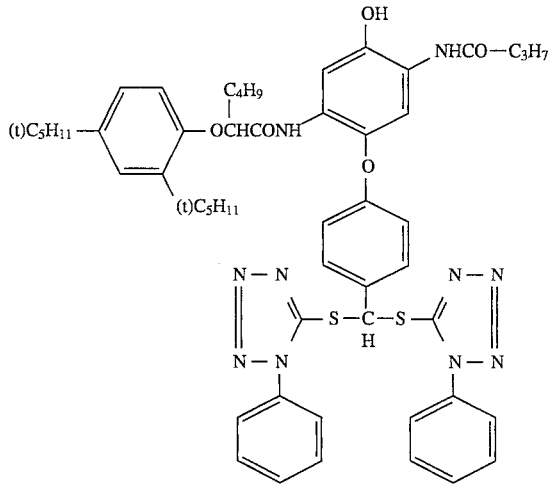
(60)
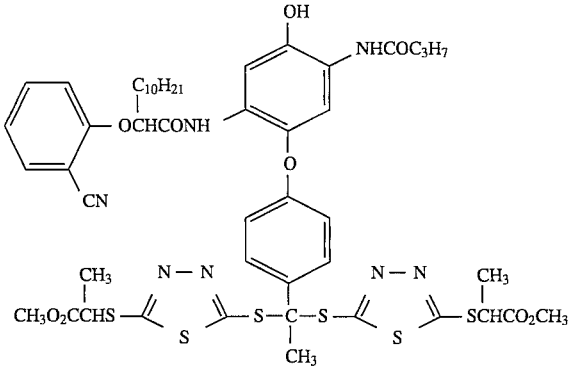
(61)
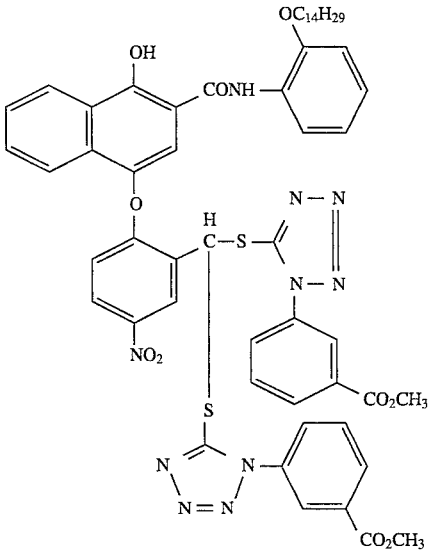
(62)
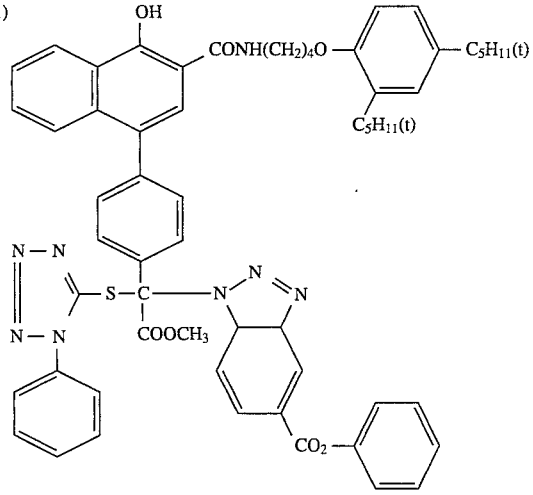

-continued
Illustrative Compounds
(63)
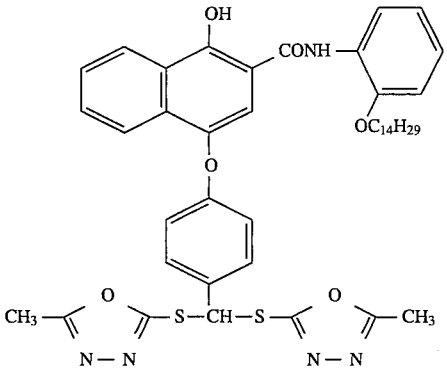
(64)
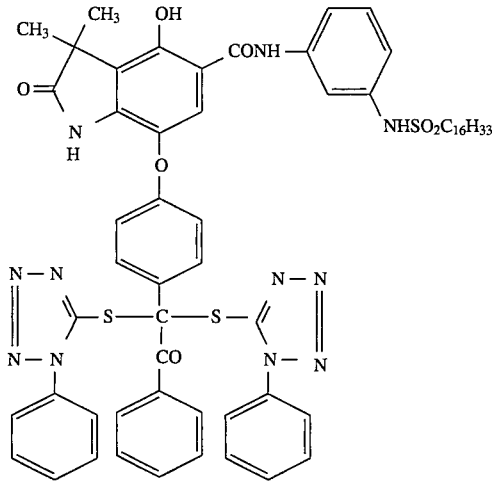
(65)
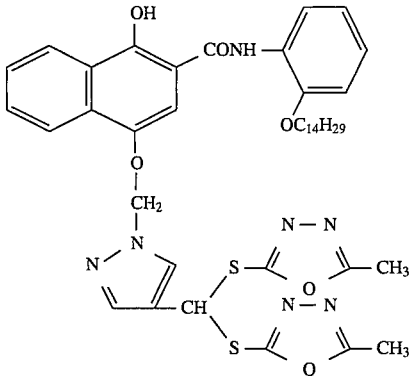
(66)
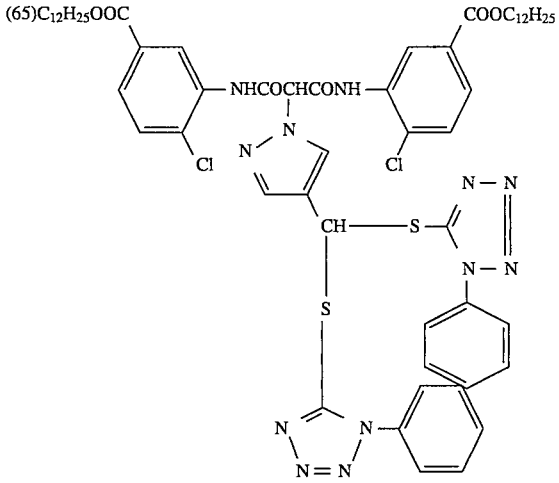
(67)
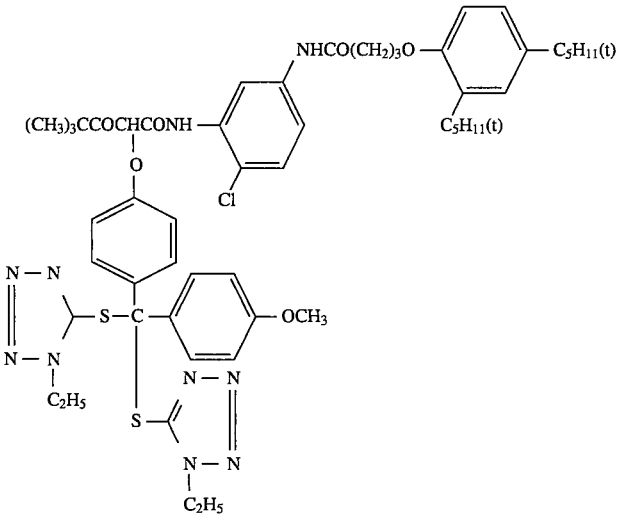

-continued

Illustrative Compounds

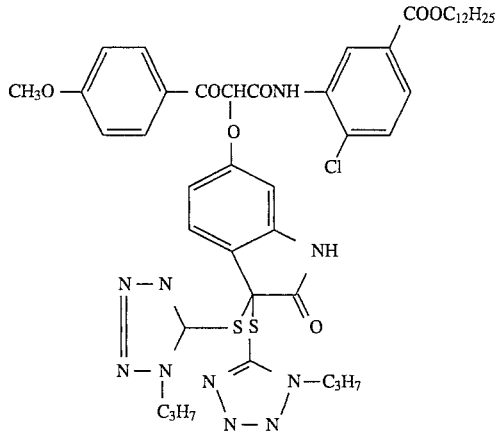

(68)

The compounds of this invention can be prepared using the methods as disclosed, for example, in JP-A-60-218645 and JP-B-63-39889 (U.S. Pat. No. 4,409,323). The actual preparation of illustrative compound (1) is described as a typical example.

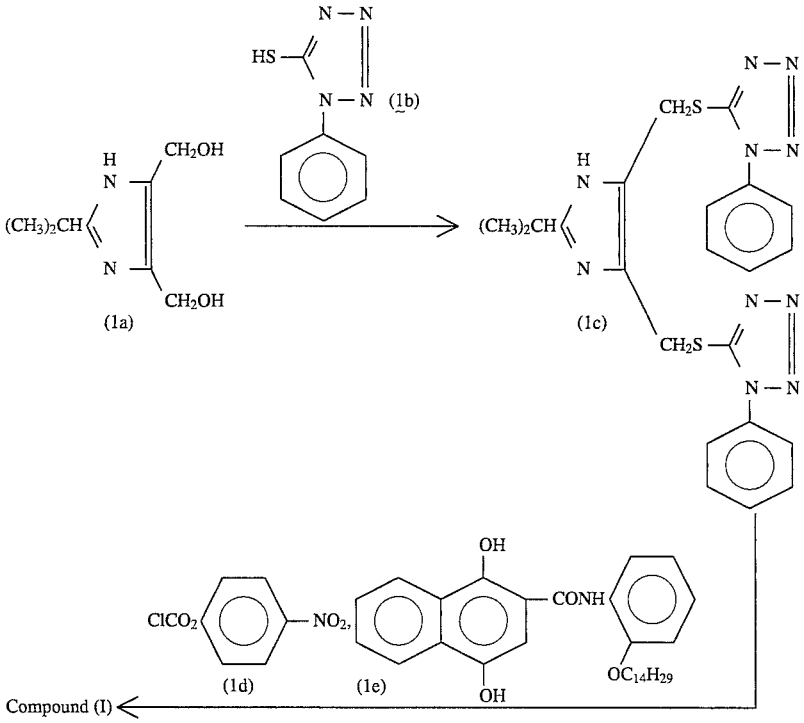

(1a) (3.40 grams) was reacted for 1 hour at 60° C. in thionyl chloride (30 ml) and then the excess thionyl chloride was removed by distillation under reduced pressure. The residue was added to a dimethylformamide solution of (1b) (7.84 grams) and diisopropylethylamine (10.5 ml) (0° C.) and the mixture was stirred for 1 hour. Subsequently, the solution was poured into water (500 ml), the crystals which formed were recovered by filtration and 9.8 grams of crude (1c) crystals was obtained. The structure was confirmed using NMR.

(1c) (3.20 grams) and (1d) (1.38 grams) were reacted for 1 hour in 1,2-dichloroethane (30 ml). Next, an ethyl acetate (20 ml) solution of 1e (3.20 grams) was added with ice cooling and then diisopropylethylamine (4.5 ml) was added and the mixture was stirred for 1 hour.

The reaction was terminated with 1N hydrochloric acid and the reaction mixture was diluted with the addition of chloroform (30 ml). Subsequently, the reaction mixture was washed three times with water and then the organic layer was dried over sodium sulfate. The organic solvent was then removed by distillation and the oily material so obtained was refined using silica gel column chromatography (ethyl acetate/hexane=1:5) and 1.20 grams of Illustrative Compound (1) was obtained. The structure was confirmed by NMR.

Compounds of this invention release a plurality of PUGs during development processing. The reaction mechanism for this process is illustrated below for the case in which two molecules of PUG are released.

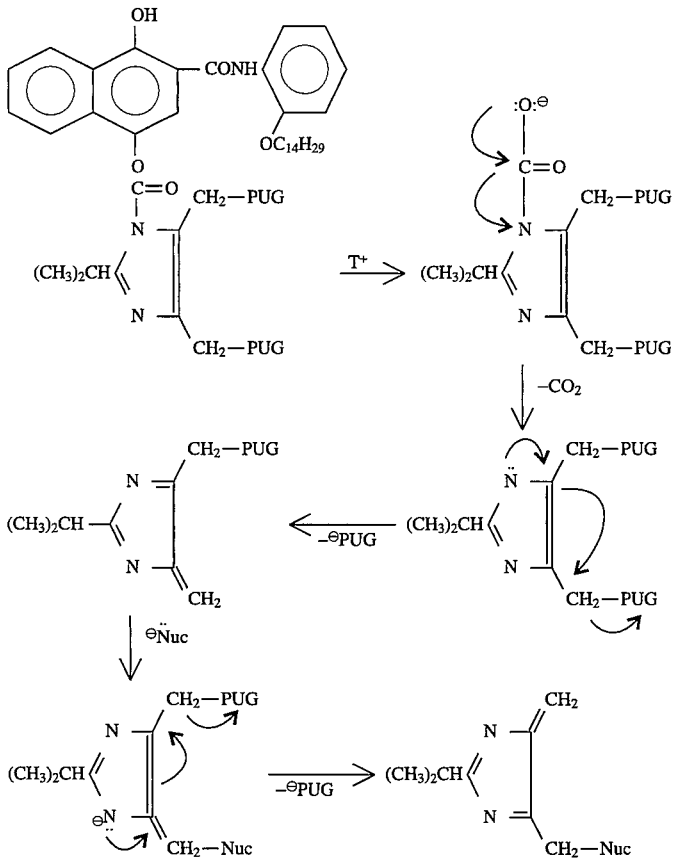

In these formulae, PUG is the same as used in general formula (I). $T^+$ represents the oxidized form of a developing agent. $^{\ominus}$Nuc represents a nucleophile which is contained in the development processing bath and in practice this is a hydroxyl ion, a sulfite ion or a hydroxylamine, for example.

As shown by the reaction equations above, a compound of this invention releases a plurality of PUGs in stages from one molecule of the compound. That is to say, the PUG-releasing compound of this invention in principle doubles the action of the photographically useful group and considerably improves photographic properties by extending the period of time over which the plurality of PUGs is released.

The PUG-releasing compounds represented by general formula (I) of this invention may be used in any layer in the photosensitive material, but they are preferably used in a photosensitive silver halide emulsion layer or in a layer adjacent thereto, and they are most desirably added to a photosensitive silver halide emulsion layer. The amount of these compounds added to a photosensitive material is generally from $1\times10^{-7}$ to $5\times10^{-4}$ mol/m$^2$, preferably from $1\times10^{-6}$ to $2\times10^{-4}$ mol/m$^2$, and most desirably from $5\times10^{-6}$ to $1\times10^{-4}$ mol/m$^2$.

The compounds represented by general formula (I) of this invention can be added in the same way as the magenta couplers described hereinafter.

The pyrazoloazole based magenta couplers of this invention can be represented by the formula (M):

Formula (M):

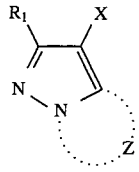

Here, $R_1$ represent a hydrogen atom or a substituent group. Z represents a group of non-metal atoms which is required to form a five-membered azole ring which has two or three nitrogen atoms, and the azole ring may have substituent groups (including condensed rings). X represents a hydrogen atom or a group which can be eliminated at the time of a coupling reaction with the oxidized form of a developing agent.

The couplers represented by formula (M) are described in detail below. The preferred skeletons from among the coupler skeletons represented by formula (M) are 1H-imidazo[1,2-b]-pyrazole, 1H-pyrazolo[1,5-b]-[1,2,4]triazole, 1H-pyrazolo[5,1-c][1,2,4]-triazole and 1H-pyrazolo[1,5-d]-tetrazole, and these can be represented by the formulae (M-I), (M-II), (M-III) and (MI-IV).

(M-I):

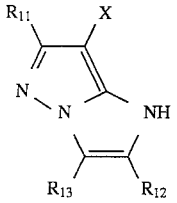

(M-II):

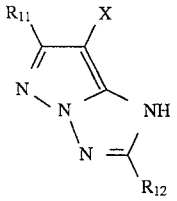

(M-III):

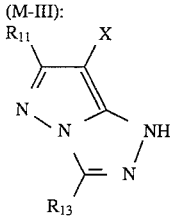

(M-IV):

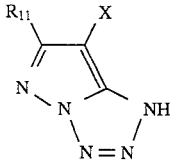

The substituent groups $R_{11}$, $R_{12}$, $R_{13}$ and X in these formulae are described in detail below.

$R_{11}$ represents a hydrogen atom, a halogen atom, an alkyl group, an aryl group, a heterocyclic group, a cyano group, a hydroxy group, a nitro group, a carboxy group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group or an azolyl group, and bis forms may be formed with $R_{11}$ as a divalent group.

More precisely, the $R_{11}$ groups each represent a hydrogen atom, a halogen atom (for example, chlorine, bromine), an alkyl group (for example, a linear chain or branched chain alkyl group, aralkyl group, alkenyl group, alkynyl group or cycloalkyl group which has from 1 to 32 carbon atoms and, more precisely, for example, methyl, ethyl, propyl, isopropyl, tert-butyl, tridecyl, 2-methanesulfonylethyl, 3-(3-pentadecylphenoxy)propyl, 3-{4-{2-[4-(4-hydroxyphenylsulfonyl)phenoxy]dodecanamido}-phenyl}propyl, 2-ethoxytridecyl, trifluoromethyl, cyclopentyl, 3-(2,4-di-tert-amylphenoxy)propyl), an aryl group (for example, phenyl, 4-tert-butylphenyl, 2,4-di-tert-amylphenyl, 4-tetradecanamidophenyl), a heterocyclic group (for example, 2-furyl, 2-thienyl, 2-pyrimidyl, 2-benzothiazolyl), a cyano group, a hydroxy group, a nitro group, a carboxy group, an amino group, an alkoxy group (for example, methoxy, ethoxy, 2-methoxyethoxy, 2-dodecylethoxy, 2-methanesulfonylethoxy), an aryloxy group ( for example, phenoxy, 2-methylphenoxy, 4-tert-butylphenoxy, 3-nitrophenoxy, 3-tertbutyloxycarbamoylphenoxy, 3-methoxycarbamoyl), an acylamino group (for example, acetamido, benzamido, tetradecanamido, 2-(2,4-di-tert-amylphenoxy)butanamido, 4-(3-tert-butyl-4-hydroxyphenoxy)butanamido, 2-{4-(4-hydroxyphenyl-sulfonyl) phenoxy}decanamido), an alkylamino group (for example, methylamino, butylamino, dodecylamino, diethylamino, methylbutylamino), an aniline group (for example, phenylamino, 2-chloroanilino, 2-chloro-5-tetradecanaminoanilino, 2-chloro-5-dodecyloxycarbonylanilino, N-acetylanilino, 2-chloro-5-{α-(3-tert-butyl-4-hydroxyphenoxy)dodecanamido}anilino), a ureido group (for example, phenylureido, methylureido, N,N-dibutylureido), a sulfamoylamino group (for example, N,N-dipropylsulfamoylamino, N-methyl-N-decylsulfamoylamino), an alkylthio group (for example, methylthio, octylthio, tetradecylthio, 2-phenoxyethylthio, 3-phenoxypropylthio, 3-(4-tert-butylphenoxy)propylthio), an arylthio group (for example, phenylthio, 2-butoxy-5-tert-octyl-phenylthio, 3-pentadecylphenylthio, 2-carboxyphenylthio, 4-tetradecanamido-phenylthio), an alkoxycarbonylamino group (for example, methoxycarbonylamino, tetra decyloxycarbonylamino), a sulfonamido group (for example, methanesulfonamido, hexadecane-sulfonamido, benzene-sulfonamido, p-toluenesulfonamido, octadecanesulfonamido, 2-methyloxy-5-tert-butylbenzene-sulfonamido), a carbamoyl group (for example, N-ethylcarbamoyl, N,N-dibutylcarbamoyl, N-(2-dodecyloxyethyl)carbamoyl, N-methyl-N-dodecylcarbamoyl, N-{3-(2,4-di-tert-amylphenoxy)-propyl}carbamoyl), a sulfamoyl group (for example, N-ethyl-sulfamoyl, N,N-dipropylsulfamoyl, N-(2-dodecyloxyethyl)-sulfamoyl, N-ethyl-N-dodecylsulfamoyl, N,N-diethylsulfamoyl), a sulfonyl group (for example, methanesulfonyl, octanesulfonyl, benzenesulfonyl, toluenesulfonyl), an alkoxycarbonyl group (for example, methoxycarbonyl, butoxycarbonyl, dodecyloxycarbonyl, octadecyloxycarbonyl), a heterocyclic oxy group (for example, 1-phenyltetrazole-5-oxy, 2-tetrahydropyranyloxy), an azo group (for example, phenylazo, 4-methoxyphenylazo, 4-pivaloylaminophenylazo, 2-hydroxy-4-propanoylphenylazo), an acyloxy group (for example, acetoxy), a carbamoyloxy group (for example, N-methylcarbamoyloxy, N-phenylcarbamoyloxy), a silyloxy group (for example, trimethylsilyloxy, dibutylmethylsilyloxy), an aryloxycarbonylamino group (for example, phenoxycarbonylamino), an imido group (for example, N-succinimido, N-phthalimido, 3-octadecenylsuccinimido), a heterocyclic thio group (for example, 2-benzothiazolylthio, 2,4-di-phenoxy-1,3,5-triazolyl-6-thio, 2-pyridylthio), a sulfinyl group (for example, dodecanesulfinyl, 3-pentadecylphenylsulfinyl, 3-phenoxypropylsulfinyl), a phosphonyl group (for example, phenoxyphosphonyl, octyloxyphosphonyl, phenylphosphonyl), an aryloxycarbonyl group (for example, phenoxycarbonyl), an acyl group for example, acetyl, 3-phenylpropanoyl, benzoyl, 4-dodecyloxybenzoyl) or an azolyl group (for example, imidazolyl, pyrazolyl, 3-chloropyrazol-1-yl, triazolyl). Those of the above groups which can have further substituent groups may have organic substituent groups or halogen atoms bonded to a carbon atom, an oxygen atom, a nitrogen atom or a sulfur atom.

Among these groups, the alkyl groups, aryl groups, alkoxy groups, aryloxy groups, alkylthio groups, ureido groups, urethane groups and acylamino groups are preferred for $R_{11}$.

$R_{12}$ is a group which is the same as the substituent groups as disclosed for $R_{11}$, and it is preferably a hydrogen atom, an alkyl group, an aryl group, a heterocyclic group, an alkoxycarbonyl group, a carbamoyl group, a sulfamoyl group, a sulfinyl group, an acyl group or a cyano group.

Furthermore, $R_{13}$ is a group which is the same as the substituent groups as disclosed for $R_{11}$, and it is preferably a hydrogen atom, an alkyl group, an aryl group, a heterocyclic group, an alkoxy group, an aryloxy group, an alkylthio group, an arylthio group, an alkoxycarbonyl group, a carbamoyl group or an acyl group, and it is most desirably an alkyl group, an aryl group, a heterocyclic group, an alkylthio group or an arylthio group.

X represents a hydrogen atom or a group which can be eliminated in a reaction with the oxidized product of a primary aromatic amine color developing agent. More precisely, this leaving group is, for example, a halogen atom, an alkoxy group, an aryloxy group, an acyloxy group, an alkyl or aryl sulfonyloxy group, an acylamino group, an alkyl or aryl sulfonamido group, an alkoxycarbonyloxy group, an aryloxycarbonyloxy group, an alkyl, aryl or heterocyclic thio group, a carbamoylamino group, a five- or six-membered nitrogen containing heterocyclic group, an imido group or an arylazo group. These groups may be further substituted with the groups which are suitable as substituent groups for $R_{11}$.

More precisely, these X groups include halogen atoms (for example, fluorine, chlorine, bromine), alkoxy groups (for example, ethoxy, dodecyloxy, methoxyethylcarboylmethoxy, carboxypropyloxy, methylsulfonylethoxy, ethoxycarbonylmethoxy), aryloxy groups (for example, 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), acyloxy groups (for example, acetoxy, tetradecanoyloxy, benzoyloxy), alkyl or aryl sulfonyloxy groups (for example, methanesulfonyloxy, toluene-sulfonyloxy), acylamino groups (for example, dichloroacetyl-amino, pentafluorobutylamino), alkyl or aryl sulfonamido groups (for example, methanesulfonamino, trifluoromethanesulfonamino, p-toluene-sulfonamino), alkoxycarbonyloxy groups (for example, ethoxycarbonyloxy, benzyloxycarbonyloxy), aryloxycarbonyloxy groups (for example, phenoxycarbonyloxy), alkyl, aryl or heterocyclic thio groups (for example, dodecylthio, 1-carboxydodecylthio, phenylthio, 2-butoxy-5-tert-octylphenyl-thio, tetrazolylthio), carbamoylamino groups (for example, N-methylcarbamoylamino, N-phenylcarbamoylamino), five- or six-membered nitrogen containing heterocyclic groups (for example, imidazolyl, pyrazolyl, triazolyl, tetrazolyl, 1,2-dihydro-2-oxo-1-pyridyl), imido groups (for example, succinimido, hydantoinyl) and arylazo group (for example, phenylazo, 4-methoxyphenylazo). There are also cases in which the product of a bis-type coupler obtained by condensing four equivalent couplers with an aldehyde or a ketone with X as a leaving group which is bonded via a carbon atom rather than these are adopted. Furthermore, X may contain a photographically useful group such as a development inhibitor or a development accelerator. X is preferably a halogen atom, an alkoxy group, an aryloxy group, an alkyl or aryl thio group or a five or six membered nitrogen containing heterocyclic group which is bonded to the coupling position via a nitrogen atom.

Illustrative magenta couplers which can be represented by formula (M) are shown below, but these compounds are not limited by these examples:

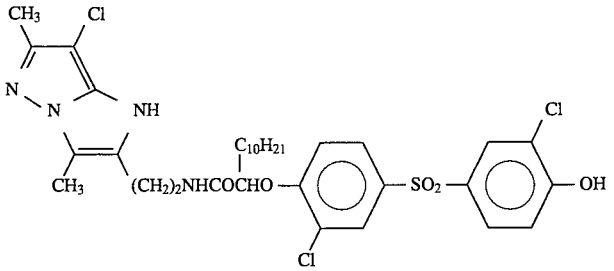

(M-1)

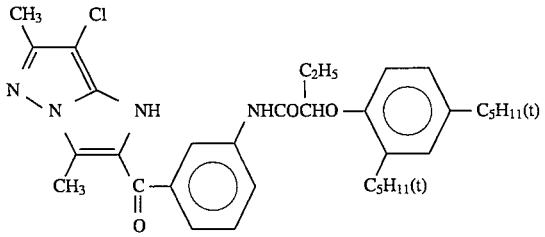

(M-2)

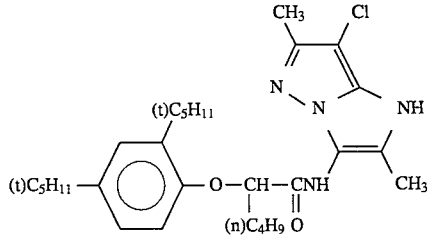

(M-3)

-continued
(M-4)
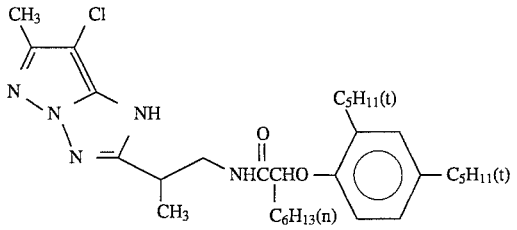
(M-5)
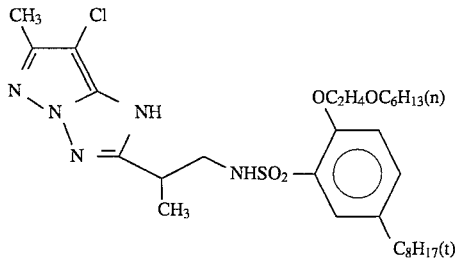
(M-6)
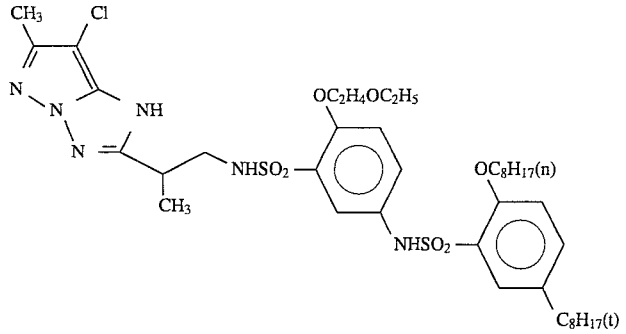
(M-7)
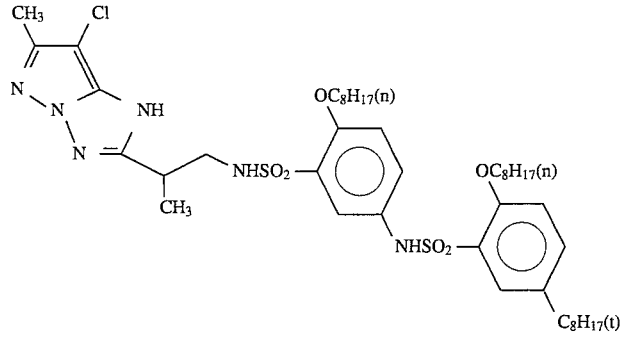
(M-8)
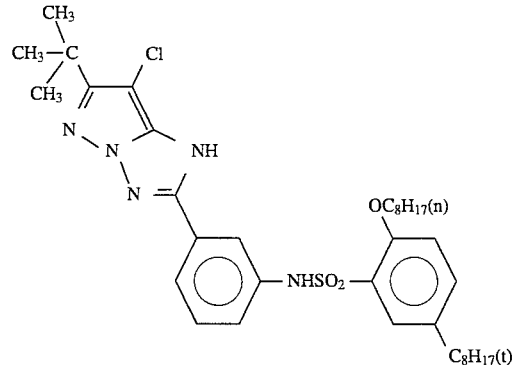

-continued
(M-9)
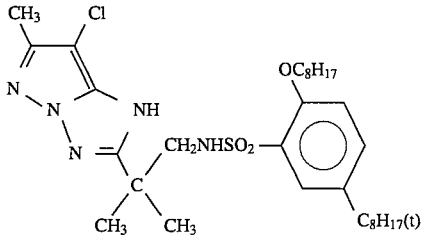
(M-10)
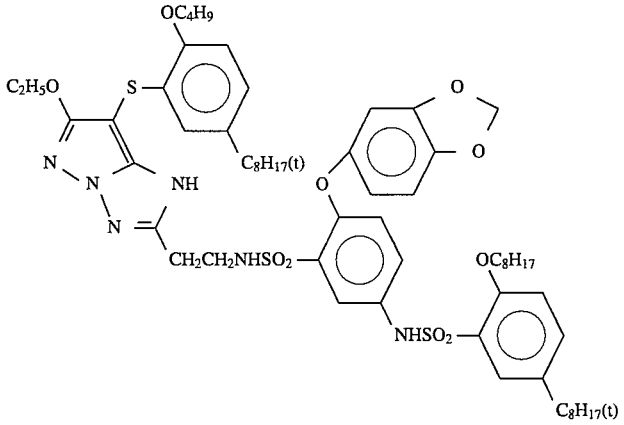
(M-11)
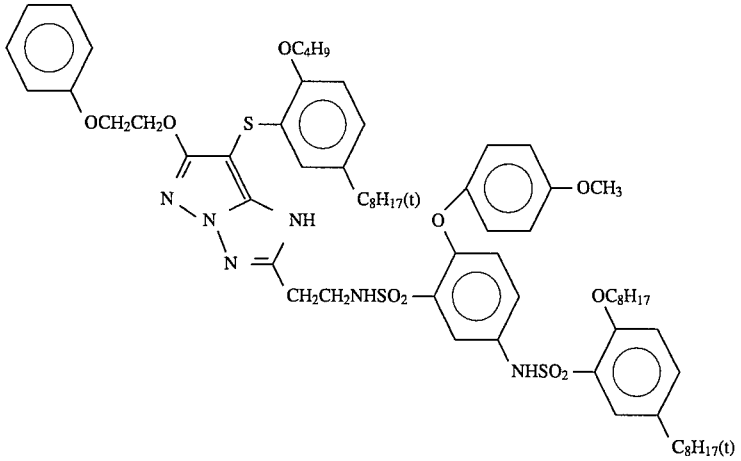
(M-12)
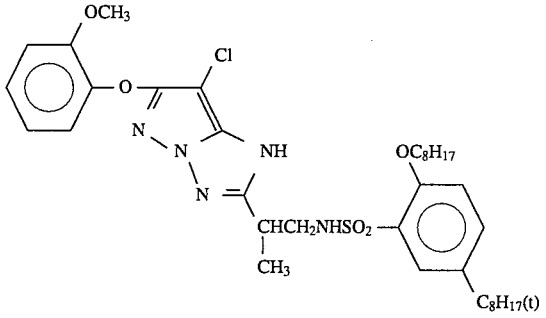

-continued
(M-13)
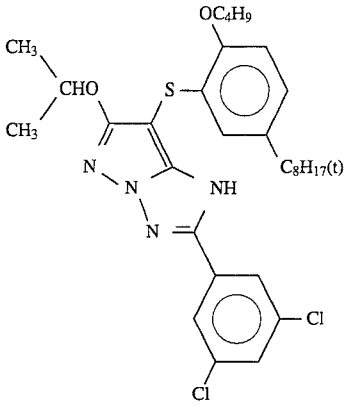
(M-14)
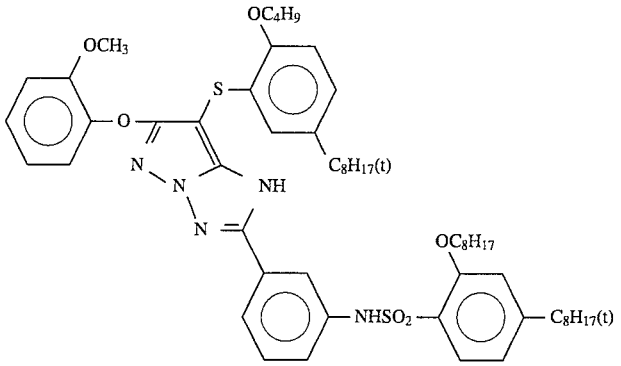
(M-15)
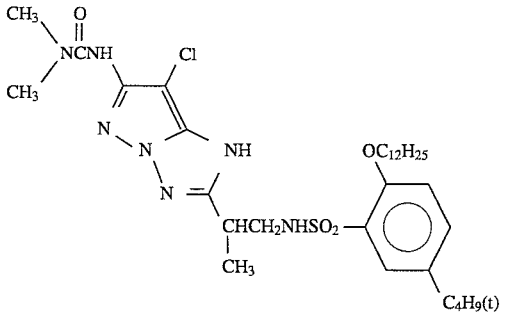
(M-16)
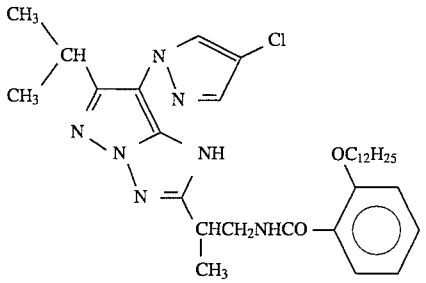
(M-17)
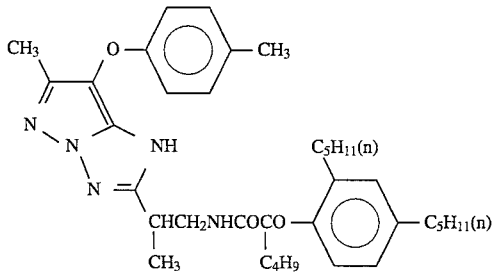

-continued
(M-18)
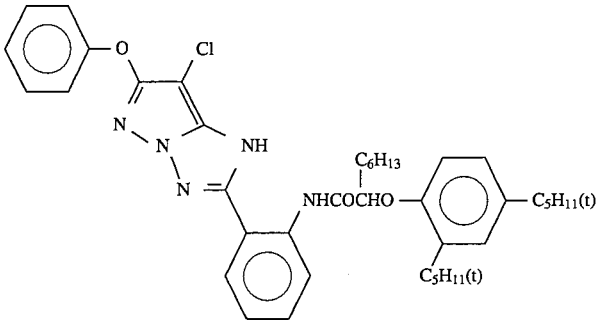
(M-19)
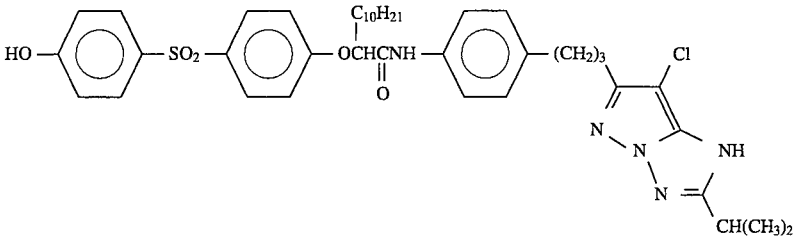
(M-20)
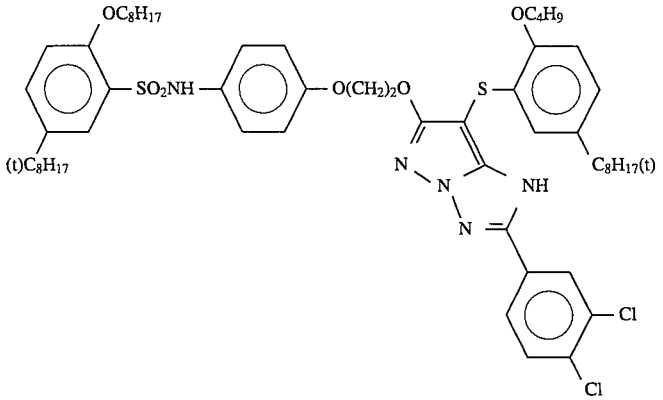
(M-21)
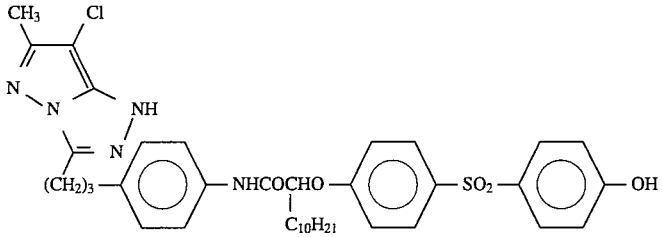
(M-22)
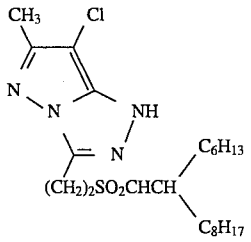
(M-23)
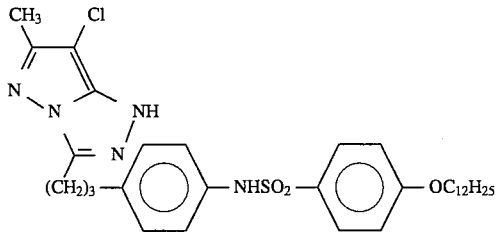

-continued
(M-24)
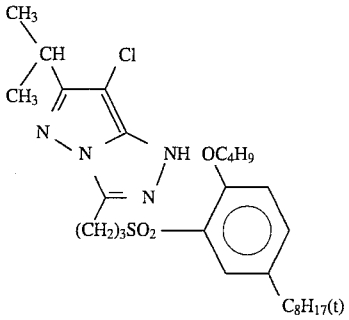
(M-25)
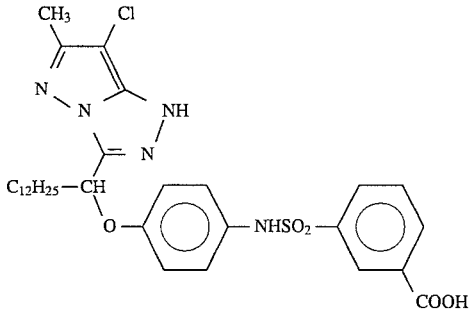
(M-26)
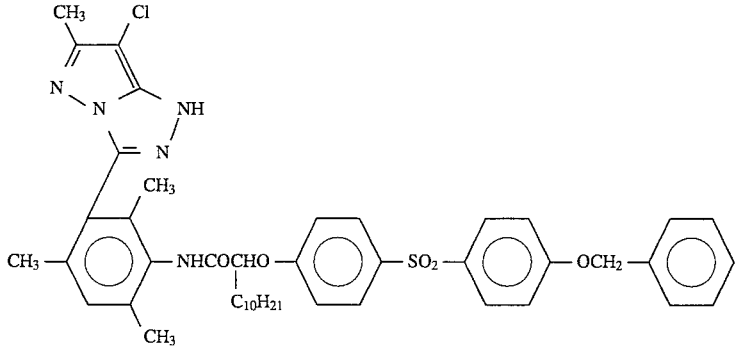
(M-27)
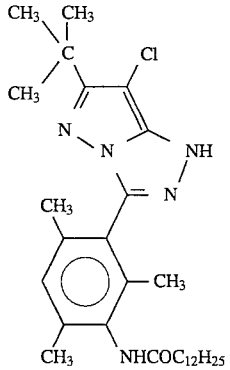
(M-28)
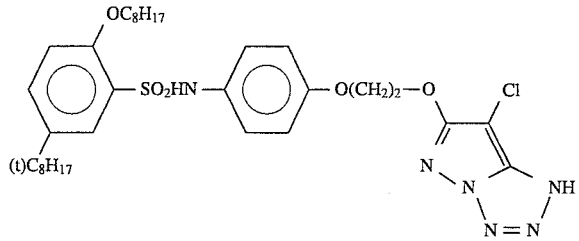

-continued

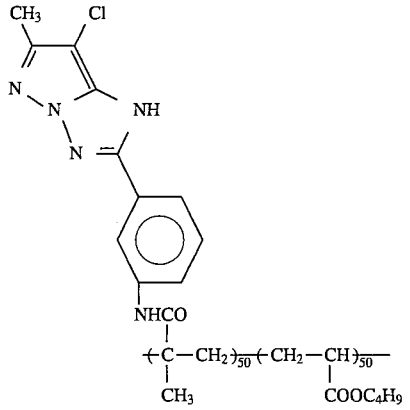

(M-29)

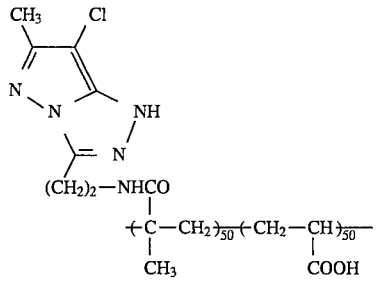

(M-30)

Literature references in which methods for the preparation of couplers which can be represented by formula (M) have been disclosed are indicated below.

Compounds of formula (M-I) can be prepared using the method disclosed, for example, in U.S. Pat. No. 4,500,630; compounds of formula (M-II) can be prepared using the methods disclosed, for example, in U.S. Pat. Nos. 4,540,654 and 4,705,863, JP-A-61-65345, JP-A-62-209457 and JP-A-62-249155; compounds of formula (M-III) can be prepared using the methods disclosed, for example, in JP-B-47-27411 and U.S. Pat. No. 3,725,067; and compounds of formula (M-IV) can be prepared using the methods disclosed, for example, in JP-A-60-33552.

Compounds which release bleaching accelerators are preferably used conjointly in order to improve further the graininess, color reproduction, sharpness and de-silvering properties in this invention. The preferred bleaching accelerating compounds can be represented by general formula (B):

General Formula (B):

$$A\text{-}(L_1)_l\text{-}Z$$

A represents a group which reacts with the oxidized form of a developing agent and cleaves $(L_1)_l$-Z, $L_1$ represents a group which cleaves Z after cleavage of the bond with A, l represents 0 or 1, and Z represents a bleaching accelerator.

Compounds which can be represented by general formula (B) are described below.

In general formula (B), A, $L_1$ and l have the same significance as those described in connection with general formula (I).

In general formula (B), A is preferably a coupler residual group.

In general formula (B), the group represented by Z is more precisely a known bleaching accelerator residual group. For example, it may be a mercapto compound as disclosed in U.S. Pat. No. 3,893,858, British Patent 1,138,842 and JP-A-53-141623, a compound which has a disulfide bond as disclosed in JP-A-53-95630, a thiazolidine derivative as disclosed in JP-B-53-9854, an isothiourea derivative as disclosed in JP-A-53-94927, a thiourea derivative as disclosed in JP-B-45-8506 and JP-B-49-26586, a thioamido compound as disclosed in JP-A-49-42349, a dithiocarbamic acid salt as disclosed in JP-A-55-26506 or an arylenediamine compound as disclosed in U.S. Pat. No. 4,552,834. These compounds preferably bond with A-$(L_1)_l$- in general formula (B) at a substitutable hetero atom which is contained within the molecule.

The group represented by Z is preferably a group which can be represented by general formula (III), (IV) or (V) shown below:

$$*\text{—}S\text{—}R_{31}\text{—}\{(X_1)_r\text{—}R_{32}\}_i\text{—}Y_2 \qquad (Y_1)_j$$

General Formula (III)

$$*\text{—}S\text{—}X_2\text{—}\{(X_1)_r\text{—}R_{32}\}_i\text{—}Y_2 \qquad (Y_1)_j$$

General Formula (IV)

$$*\text{—}S\text{—}X_3\text{—}\{(X_1)_r\text{—}R_{32}\}_j\text{—}Y_2 \qquad (Y_1)_k$$

General Formula (V)

In these formulae, * indicates the position to which A-$(L_1)_l$- is bonded thereto, $R_{31}$ represents a divalent aliphatic group which has from 1 to 8, and preferably from 1 to 5, carbon atoms, $R_{32}$ is a group which has the same meaning as $R_{31}$, a divalent aromatic group which has from 6 to 10 carbon atoms or a three-to eight-membered, and preferably five-or six-membered, divalent heterocyclic group. $X_1$ represents —O—, —S—, —COO—, —$SO_2$—, $$-\underset{\underset{R_{33}}{|}}{N}-,\ -\underset{\underset{R_{33}}{|}}{N}-CO-,\ -\underset{\underset{R_{33}}{|}}{N}-SO_2-,$$

-continued $$-S-\underset{\underset{O}{\|}}{C}-,\ -\underset{\underset{O}{\|}}{C}-,\ -\underset{\underset{R_{33}}{|}}{N}COO-,$$

$$-\underset{\underset{R_{34}}{|}}{N}=C-,\ -\underset{\underset{R_{33}}{|}}{N}CO-\underset{\underset{R_{34}}{|}}{N}-\ \text{or}\ -\underset{\underset{R_{33}}{|}}{N}SO_2\underset{\underset{R_{34}}{|}}{N}-,$$

$X_2$ represents an aromatic group which has from 6 to 10 carbon atoms, $X_3$ represents a three-to eight-membered, and preferably five-or six-membered, heterocyclic group which has at least one carbon atom which is bonded to S in the ring, $Y_1$ represents a carboxyl group or a salt thereof, a sulfo group or a salt thereof, a hydroxyl group, a phosphonic acid group or a salt thereof, an amino group (which may be substituted with aliphatic groups which have from 1 to 4 carbon atoms), an $—NHSO_2—R_{35}$ group or an $—SO_2NH—R_{35}$ group (where a "salt" signifies a sodium salt, a potassium salt or an ammonium salt), $Y_2$ represents a group which has the same meaning as those described for $Y_1$ or a hydrogen atom, r represents 0 or 1, i represents an integer of 0 to 4, j represents an integer of 1 to 4, and k represents an integer of 1 to 4. However, the j $Y_1$ groups are bonded to the substitutable positions of $R_{31}$-$\{(X_1)_r$-$R_{32}\}_i$ and $X_2$-$\{(X_1)_r$-$R_{32}\}_i$ and the k $Y_1$ groups are bonded to the substitutable positions of $X_3$-$\{(X_1)_r$-$R_{32}\}_i$, and when k and j are 2 or more, the k and j $Y_1$ groups may be the same or different, and when i is 2 or more, the i $(X_1)_r$-$R_{32}$ groups may be the same or different. Here, $R_{33}$, $R_{34}$ and $R_{35}$ each represent a hydrogen atom or an aliphatic group which has from 1 to 8, and preferably from 1 to 5, carbon atoms. In those cases where $R_{31}$–$R_{35}$ are aliphatic groups, they may be chain like or cyclic, linear chain or branched, saturated or unsaturated, substituted or unsubstituted aliphatic groups. Unsubstituted groups are preferred but, for example, halogen atoms, alkoxy groups (for example, methoxy, ethoxy) and alkylthio groups (for example, methylthio, ethylthio) can be cited as substituent groups.

The aromatic groups represented by $X_2$ and the aromatic groups when $R_{32}$ represents an aromatic group may have substituent groups. For example, the aforementioned aliphatic group substituent groups can be cited as such substituent groups.

The heterocyclic groups represented by $X_3$ and the heterocyclic groups when $R_{32}$ represents a heterocyclic group are saturated or unsaturated, substituted or unsubstituted heterocyclic groups which have oxygen, sulfur or nitrogen atoms as hetero atoms. Examples include a pyridine ring, an imidazole ring, a piperidine ring, an oxylane ring, the sulfolane ring, a imidazolidine ring, a thiazipine ring and a pyrazole ring. Those groups cited earlier as aliphatic group substituent groups, for example, can be cited as substituent groups.

Specific examples of groups which can be represented by general formula (III) include those shown below:

$-SCH_2CH_2CO_2H$, (1)

$-SCH_2CO_2H$, (2)

$-SCH_2CH_2N(CH_3)_2$, (3)

$-SCH_2CH(OH)CH_2OH$ (4)

-continued $-SCH_2CH_2NH_2$, (5)

$-SCH_2CH(NH_2)CO_2H$, (6)

$-S(CH_2)_2C(=O)CH_2OH$, (7)

$-SCH_2CH_2NHCOCH_3$, (8)

$-S(CH_2)_4CO_2H$, (9)

$-SCH_2CO_2H$, $CH_3$ (10)

$-SCH_2CH_2OH$, (11)

$-SCH_2CONHCH_2CO_2H$, (12)

$-SCH_2CH_2OCH_2CO_2H$, (13)

$-SCH_2COOCH_2CH_2OH$, (14)

$-SCH_2CH_2OCH_2CH_2OCH_2CH_2OH$, (15)

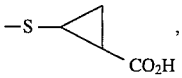
(16)

$-SCH_2-CH(OH)-CH_3$, (17)

$-SCH_2CH_2SCH_2CO_2H$, (18)

$-SCH_2CH_2CH_2CO_2H$, and (19)

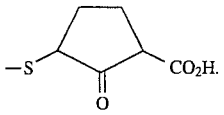
(20)

Specific examples of groups which can be represented by general formula (IV) include those shown below:

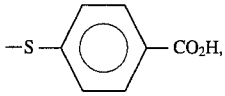
(1)

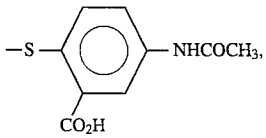
(2)

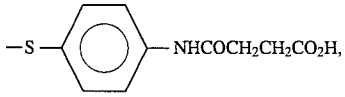
(3)

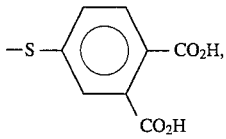
(4)

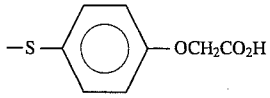
(5)

Specific examples of groups which can be represented by general formula (V) include those shown below:

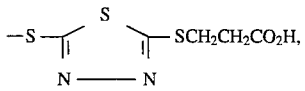
(1)

-continued
(2)
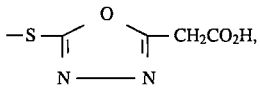
(3)
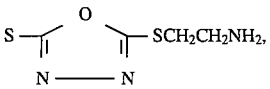
(4)
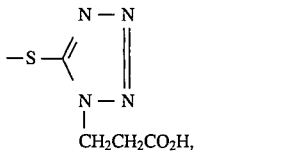
(5)
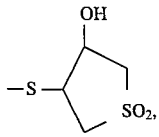
(6)
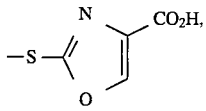
(7)
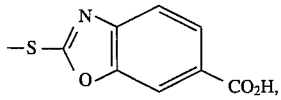
(8)
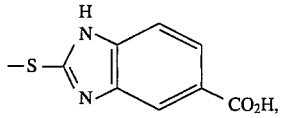
(9)
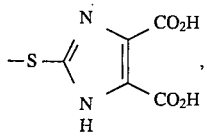
-continued
(10)
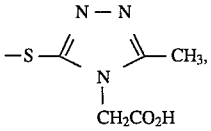
(11)
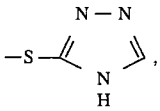
(12)
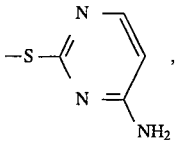
(13)
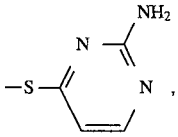
(14)
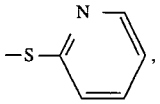
(15)
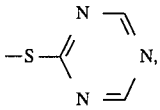
Specific examples of compounds which release bleaching agents which are preferably used in this invention are shown below, but these compounds are not limited by these examples:
B-(1)
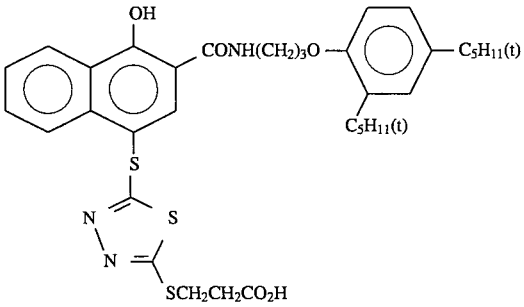
B-(2)
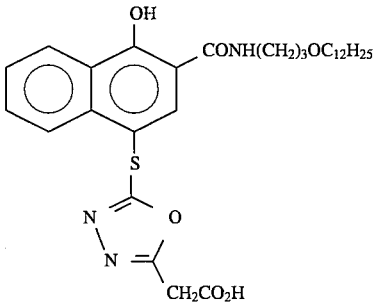

-continued
B-(3)
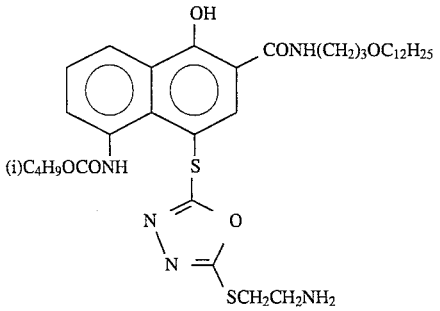
B-(4)
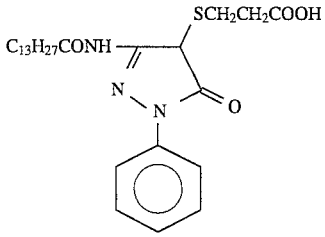
B-(5)
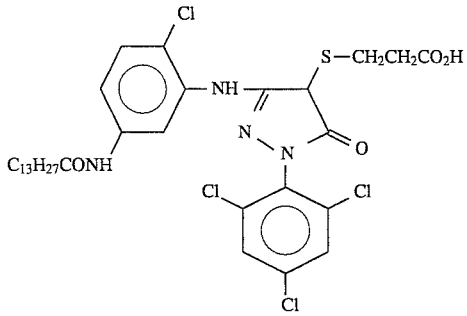
B-(6)
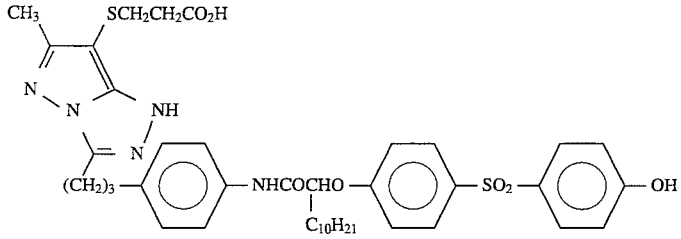
B-(7)
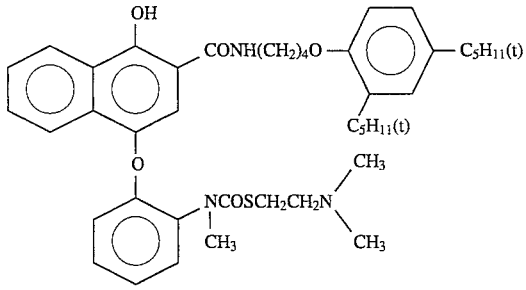
B-(8)
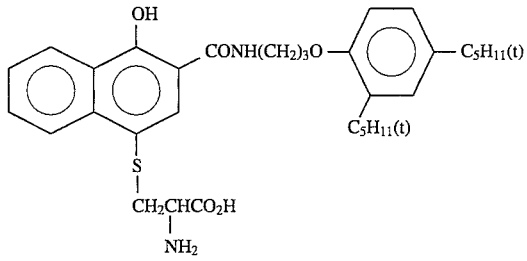

-continued
B-(9)
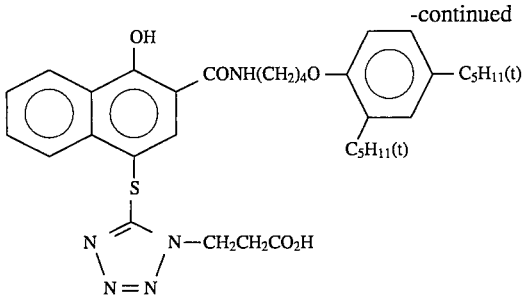
B-(10)
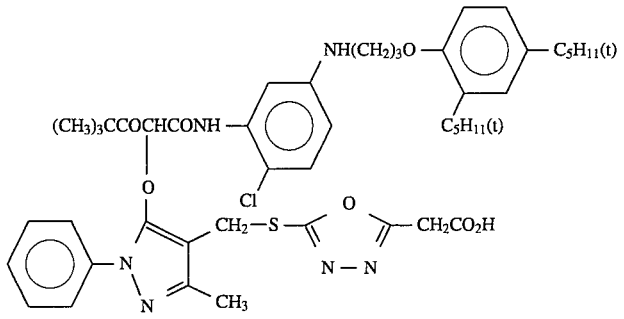
B-(11)
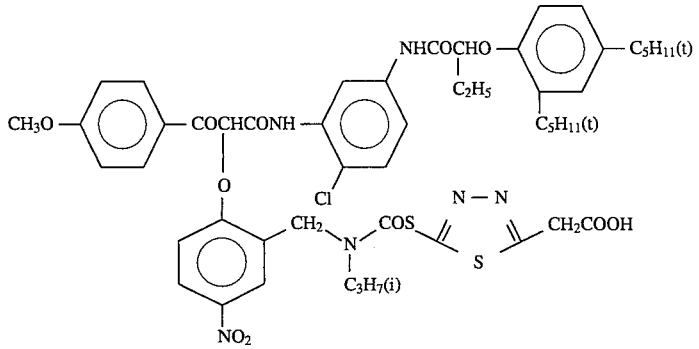
B-(12)
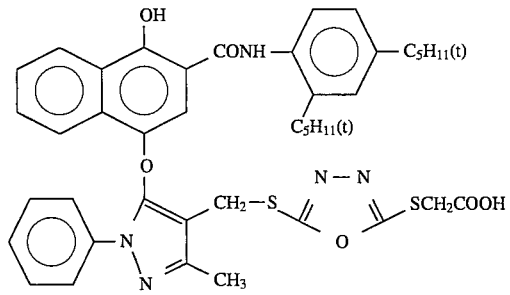
B-(13)
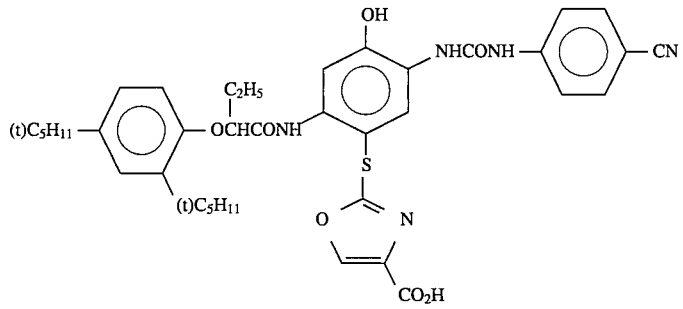

-continued
B-(14)
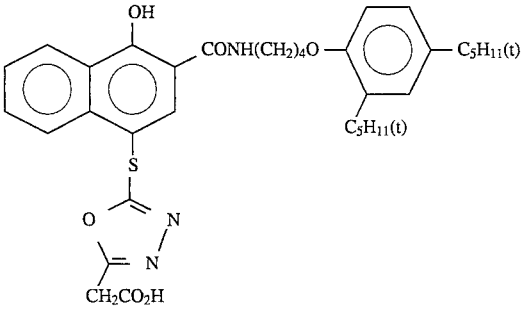
B-(15)
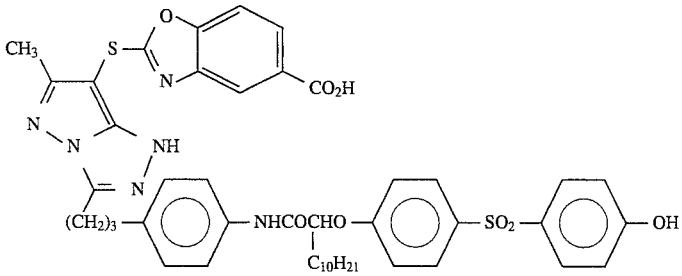
B-(16)
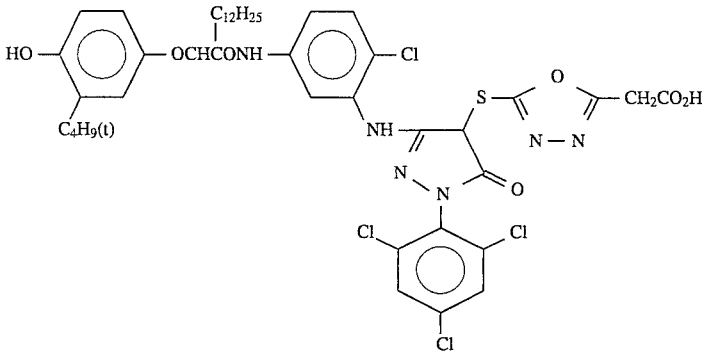
B-(17)
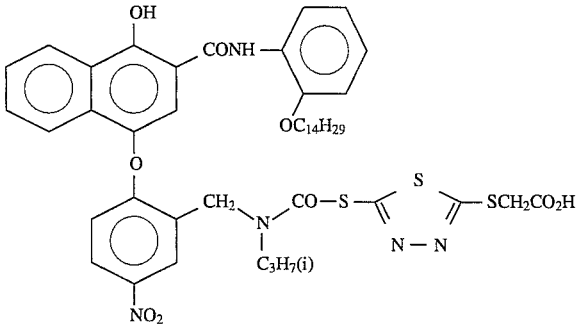
B-(18)
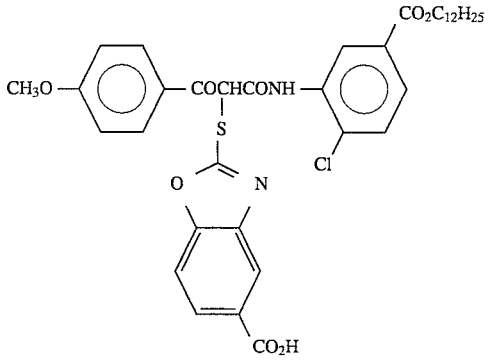

-continued
B-(19)
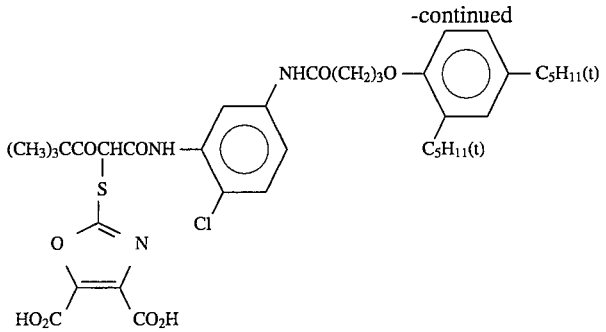
1-(20)
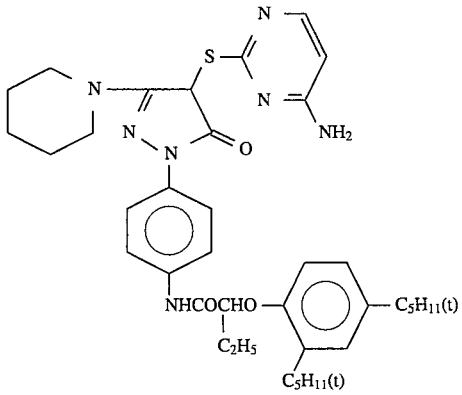
B-(21)
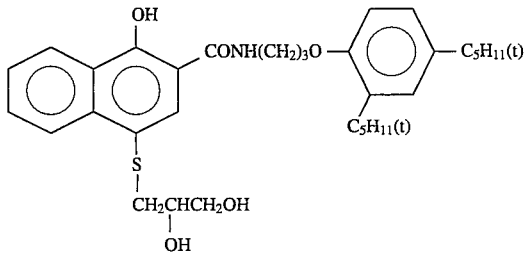
B-(22)
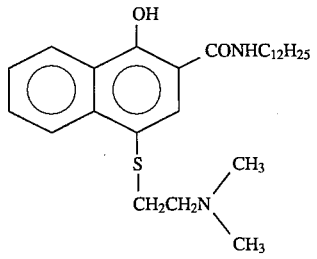
B-(23)
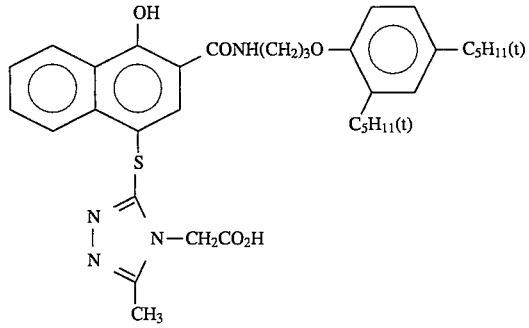

-continued
B-(24)
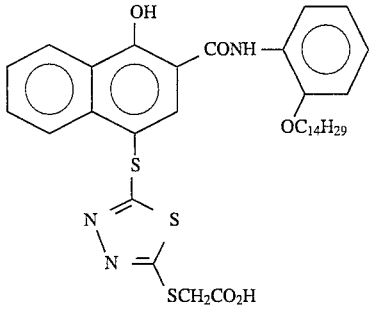
B-(25)
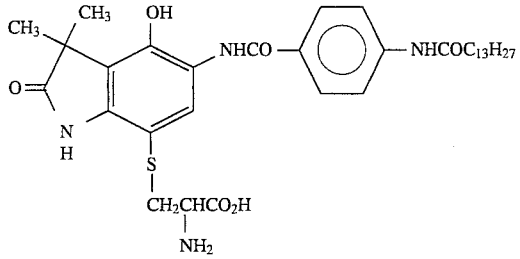
B-(26)
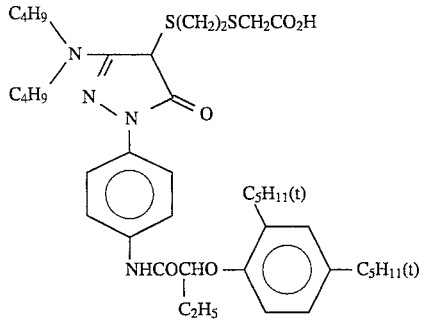
B-(27)
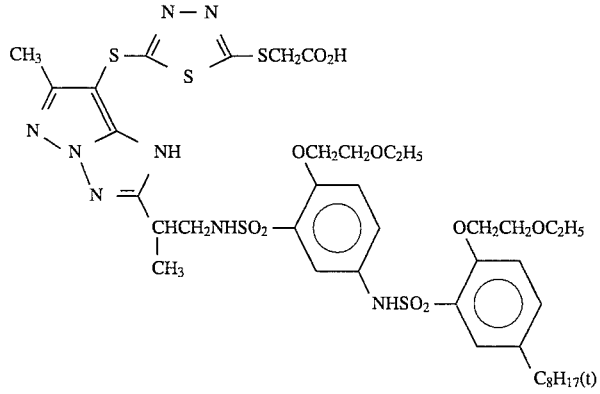
B-(28)
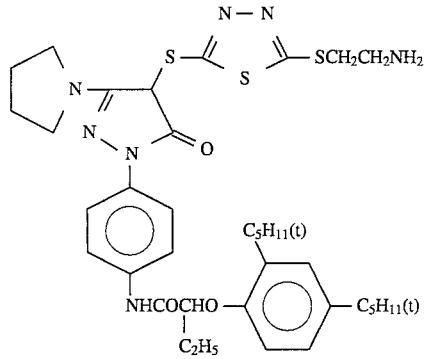

-continued
B-(29)
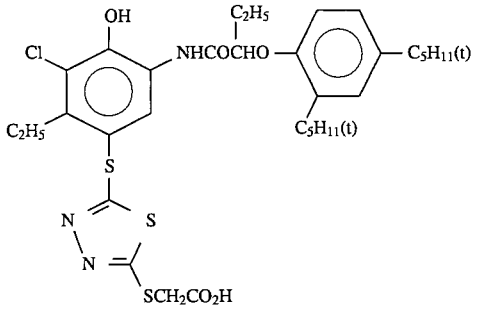
B-(30)
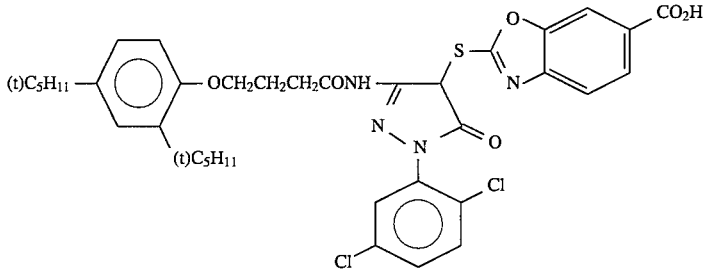
B-(31)
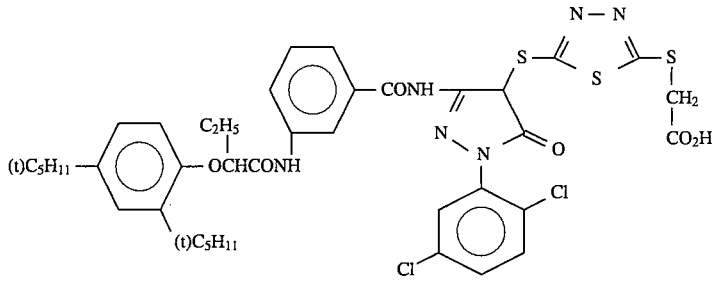
B-(32)
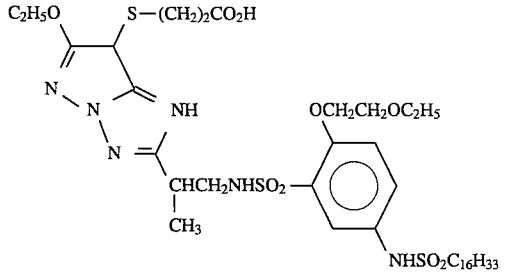
B-(33)
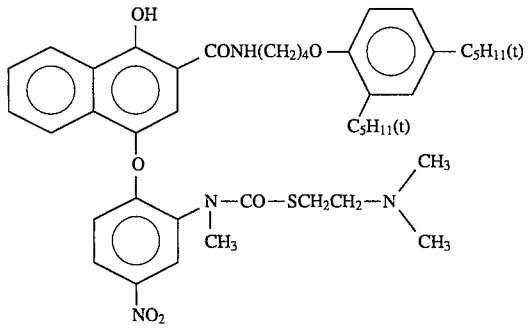
B-(34)
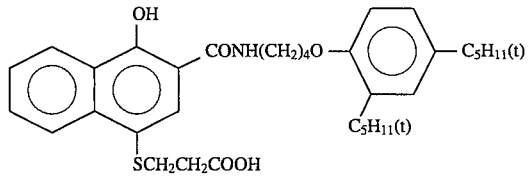

-continued
B-(35)
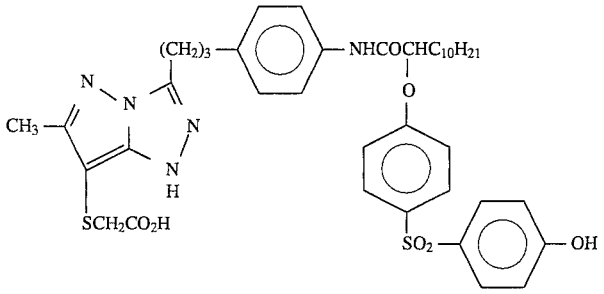
B-(36)
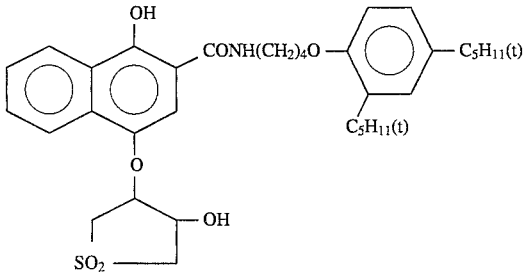
B-(37)
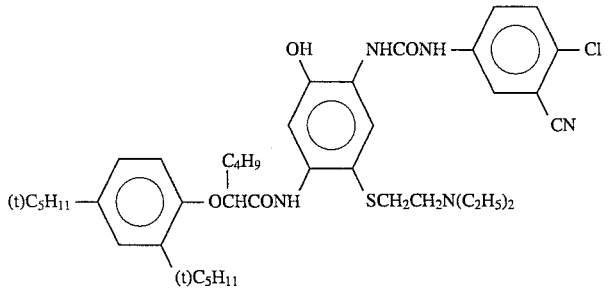
B-(38)
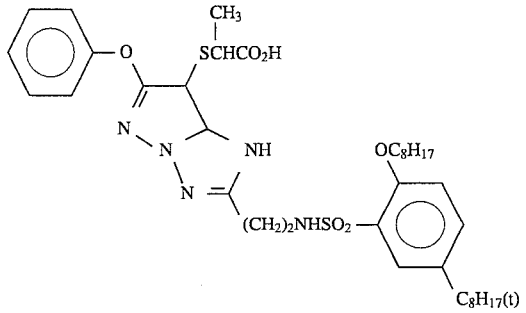
B-(39)
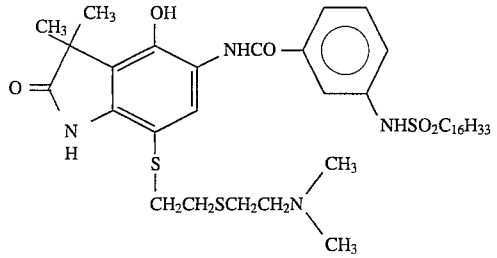

-continued
B-(40)
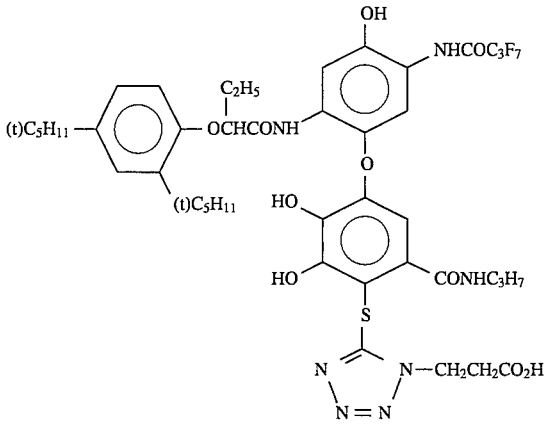
B-(41)
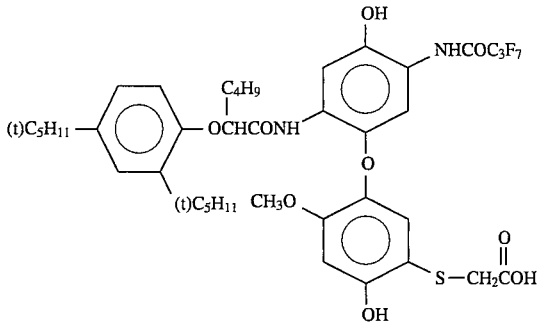
B-(42)
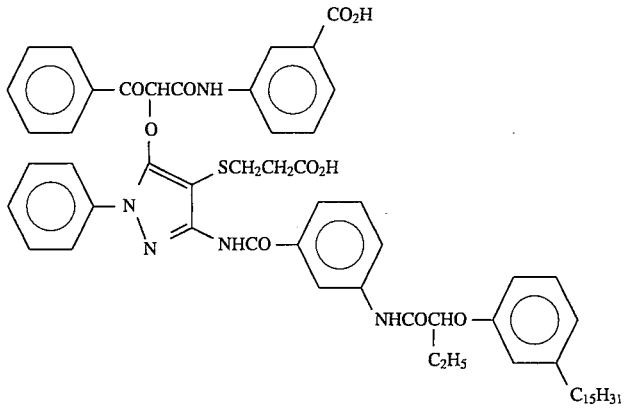
B-(43)
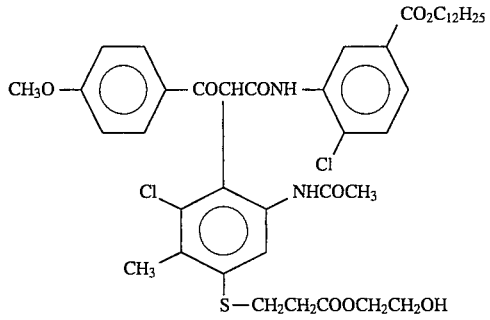

-continued
B-(44)
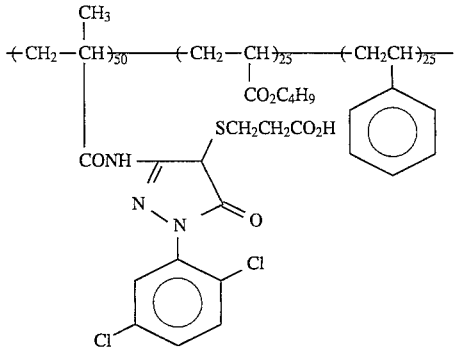
Molecular Weight: Approx 40,000
B-(45)
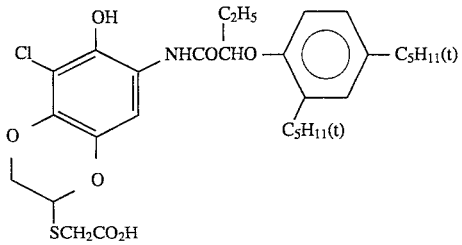
B-(46)
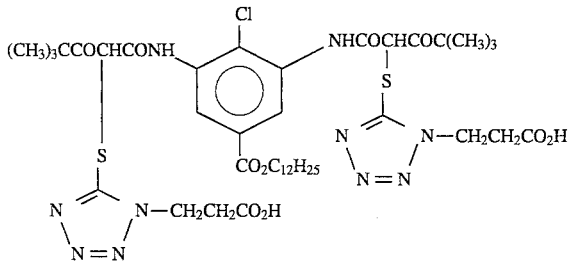
B-(47)
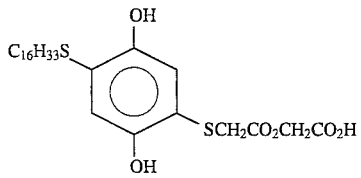
B-(48)
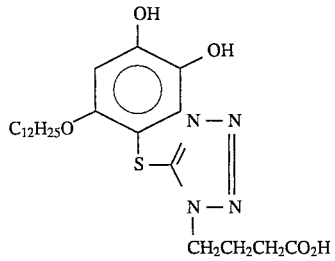
B-(49)
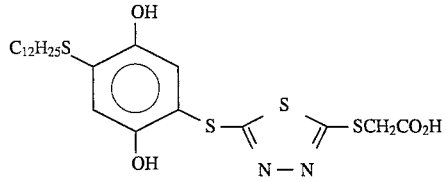

-continued
B-(50)
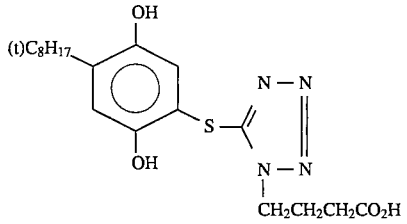
B-(51)
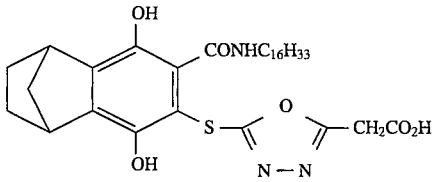
B-(52)
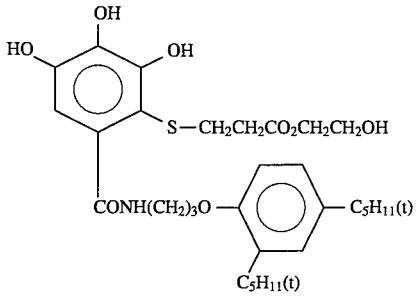
B-(53)
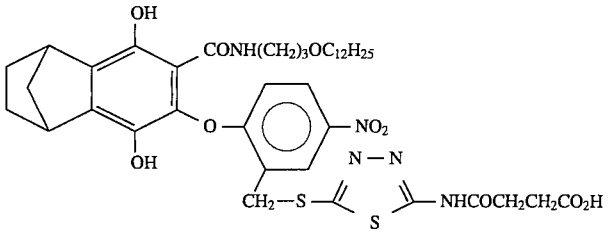
B-(54)
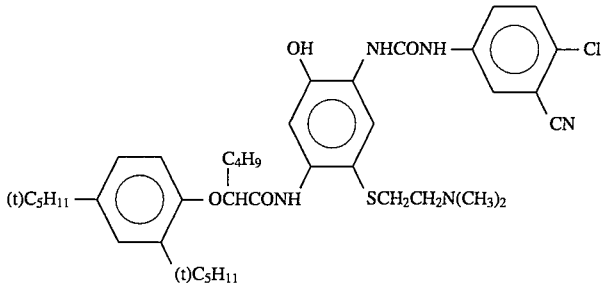
B-(55)
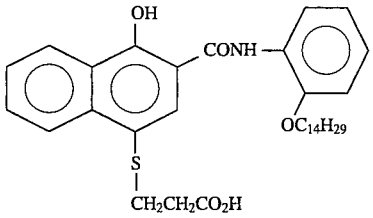

-continued
B-(56)
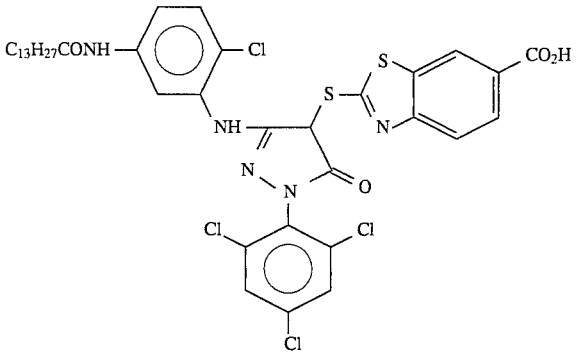
B-(57)
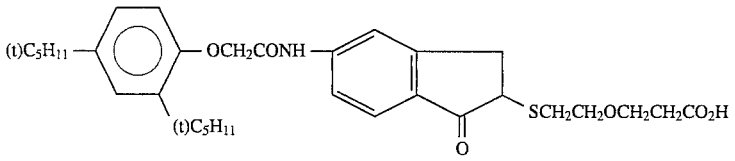
B-(58)
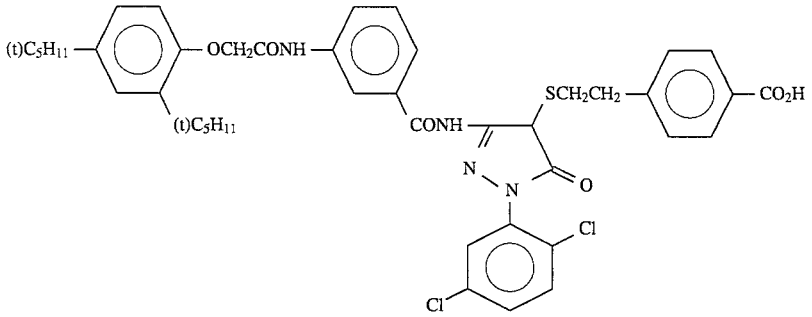
B-(59)
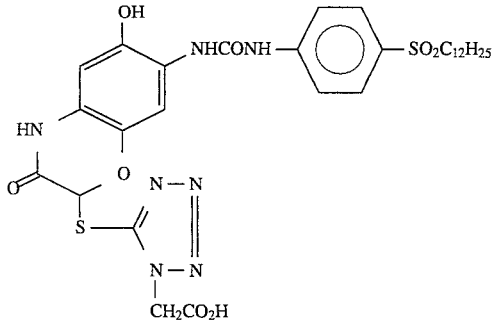
B-(60)
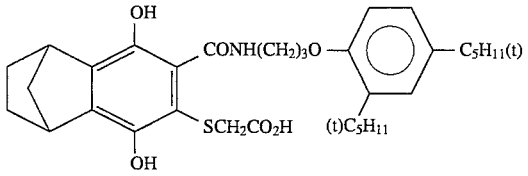
B-(61)
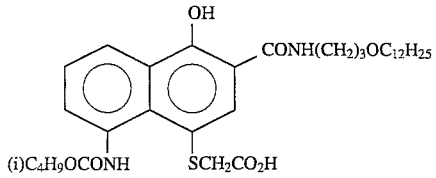

-continued
B-(62)
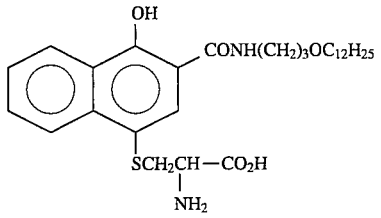
B-(63)
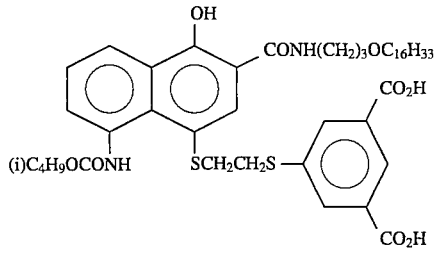
B-(64)
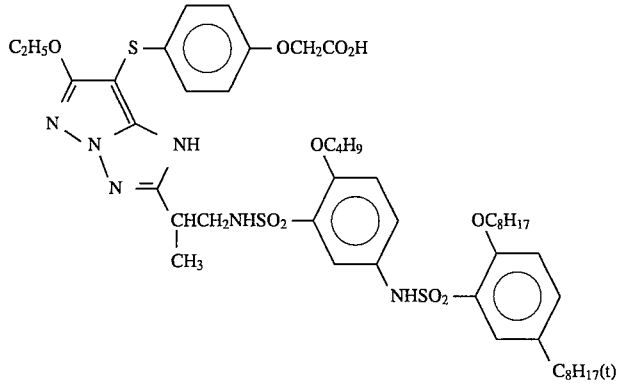
B-(65)
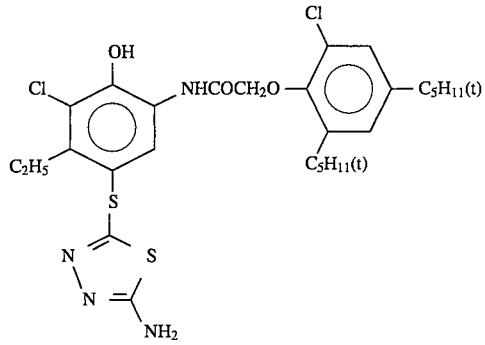
B-(66)
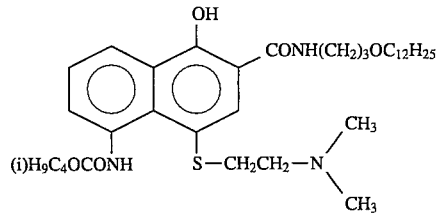
B-(67)
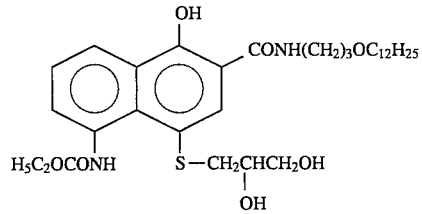

-continued

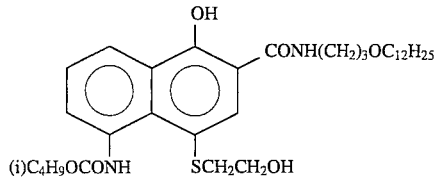

B-(68)

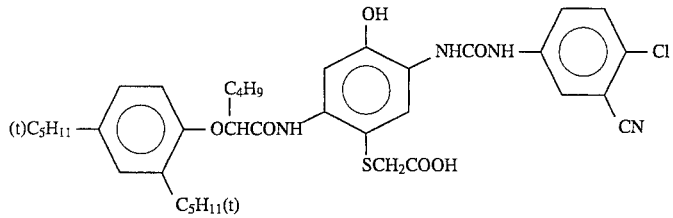

B-(69)

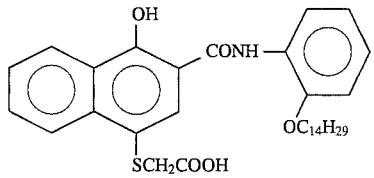

B-(70)

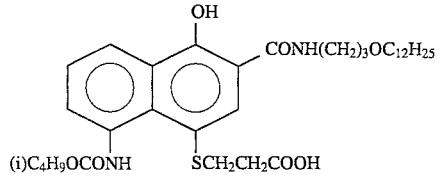

B-(71)

The compounds disclosed in *Research Disclosure* Item Nos. 24241 and 11449, JP-A-61-201247 and Japanese Patent Applications 61-252847, 61-268870 and 61-2688721 can also be used as the bleaching agent releasing compound.

Furthermore, the bleaching accelerator releasing compounds which are used in this invention can be prepared easily by the methods disclosed in the aforementioned patent specifications.

The amount of a compound of general formula (B) which is added differs according to the structure of the compound, but it is added preferably in an amount of from $1\times10^{-5}$ to 1 mol, and most desirably in an amount of from $1\times10^{-4}$ to 0.5 mol, per mol of silver which is present in the same layer or in the adjacent layer.

It is possible to obtain color photographic materials which have superior graininess, sharpness, color reproduction and de-silvering properties by using color photographic materials of this invention which have been obtained in the way described above. But a further improvement in sharpness and color reproduction can be achieved by including compounds with the structure indicated below which can be represented by general formula (D) in the above mentioned color photographic materials:

general formula (D)

$$A\text{-}(L_1)_v\text{-}B\text{-}(L_2)_w\text{-}DI$$

In this formula, A represents a group which cleaves $(L_1)_v$-B-$(L_2)_w$-DI on reaction with the oxidized form of a developing agent, $L_1$ represents a linking group for which the bond with B is cleaved after cleavage of the bond with A, B represents a group which cleaves $(L_2)_w$-DI on reaction with the oxidized form of a developing agent, $L_2$ represents a group which cleaves DI after cleavage of the bond with B, DI represents a development inhibitor, v and w each represents an integer of 0 to 2, and when v, or w is 2, the two $L_1$ or $L_2$ groups may be the same or different.

The compounds which can be represented by general formula (D) are described in detail below.

The compounds represented by general formula (D) cleave DI via the reaction pathway indicated below during development.

$$A-(L_1)_v-B-(L_2)_w-DI \xrightarrow{QDI}$$

$$(L_1)_v-B-(L_2)_w-DI \longrightarrow$$

$$B-(L_2)_w-DI \xrightarrow{QDI} (L_2)_w-DI \longrightarrow DI$$

In these equations, A, $L_1$, v, B, $L_2$, w and DI have the same significance as those described in connection with general formula (D), and QDI represents the oxidized form of a developing agent.

Typical examples of the groups represented by B in general formula (D) are shown below. Here, * represents the position which is bonded to A-$(L_1)_v$ in general formula (D) and ** indicates the position which is bonded to $(L_2)_w$-DI.

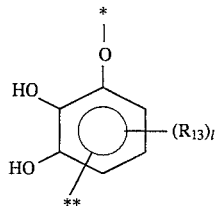

(B-1)

(B-2)

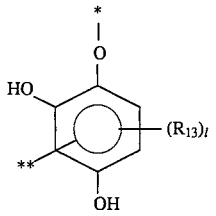

(B-3)

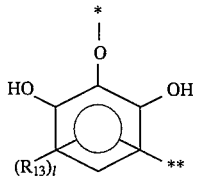

(B-4)

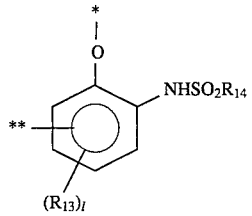

(B-5)

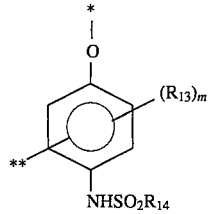

(B-6)

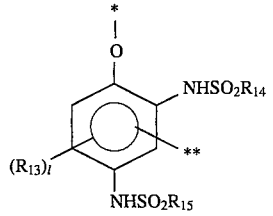

(B-7)

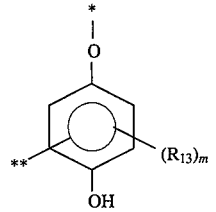

(B-8)

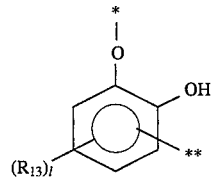

(B-9)

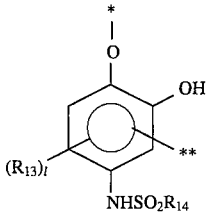

(B-10)

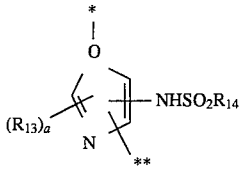

In these formulae, $R_{13}$ has the same meaning as $R_{63}$ described earlier, $R_{14}$ and $R_{15}$ each have the same meaning as $R_{41}$ described earlier, l represents an integer of 0 to 2, m represents an integer of 0 to 3, and a represents an integer of 0 or 1.

Specific examples of cases in which B is eliminated and becomes a compound which exhibits a reducing action include the reducing agents disclosed, for example, in U.S. Pat. Nos. 4,741,994 and 4,477,560, JP-A-61-102646, JP-A-61-107245, JP-A-61-113060, JP-A-64-13547, JP-A-64-13548 and JP-A-64-73346.

The conventionally known development inhibitors, for example, can be used for the group represented by DI in general formula (D). For example, a heterocyclic mercapto group or a 1-indazolyl group or triazolyl group is preferred. In practice, the tetrazolylthio group, the thiadiazolylthio group, the oxadiazolylthio group, the triazolylthio group, the benzoxazolylthio group, the benzothiazolylthio group, the benzimidazolylthio group, the 1-(or 2-)benzotriazolyl group, the 1,2,4-triazol-1-(or -4-)yl group or the 1-indazolyl group may be cited as examples. When these groups have substituent groups, they may be substituted with aliphatic groups, aromatic groups, heterocyclic groups or the substituent groups cited earlier as substituent groups for aromatic groups.

Methods for the preparation of compounds which can be represented by general formula (D) have been disclosed in U.S. Pat. Nos. 4,618,571 and 4,770,982, JP-A-63-284159, JP-A-60-203943 and JP-A-63-23152.

Specific examples of compounds of formula (D) of this invention are indicated below, but these compounds are not limited by these examples.

(I-1)
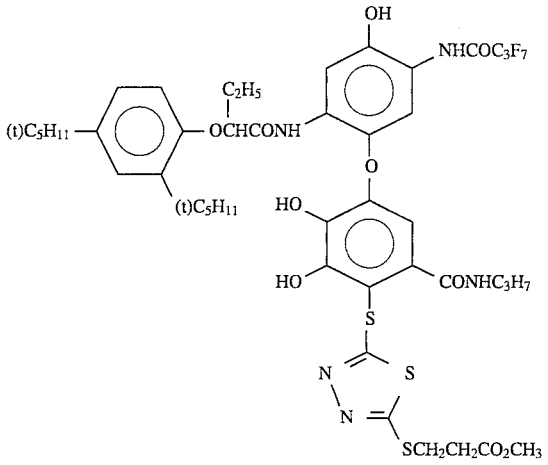
(I-2)
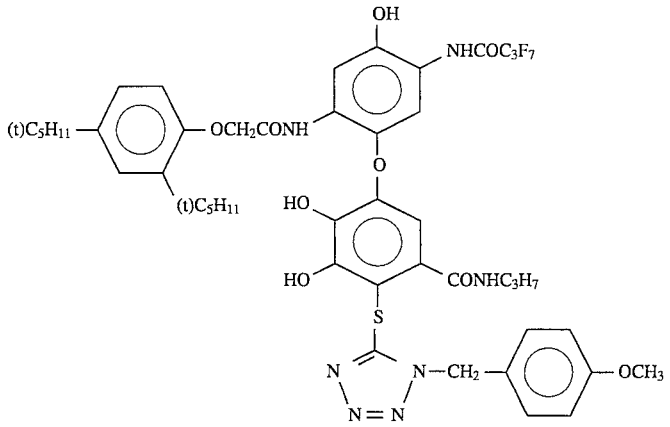
(I-3)
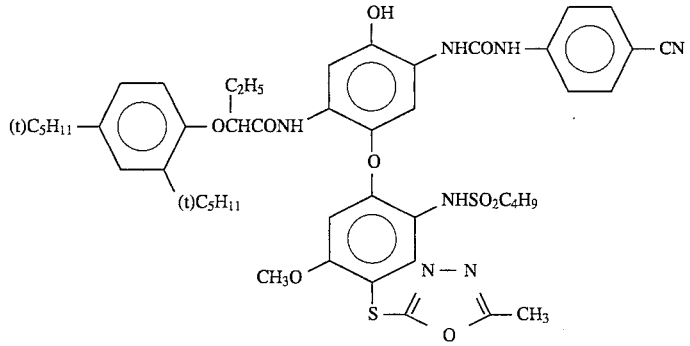
(I-4)
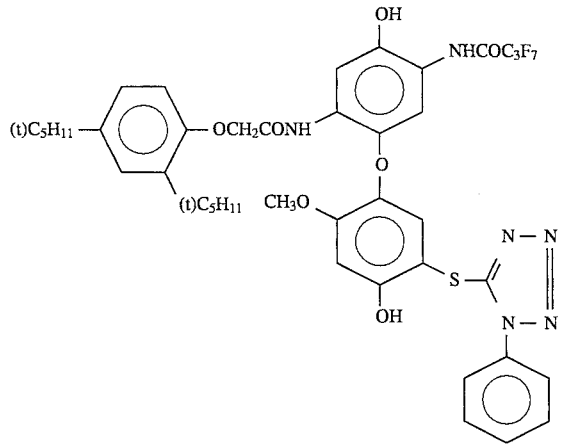

-continued
(I-5)
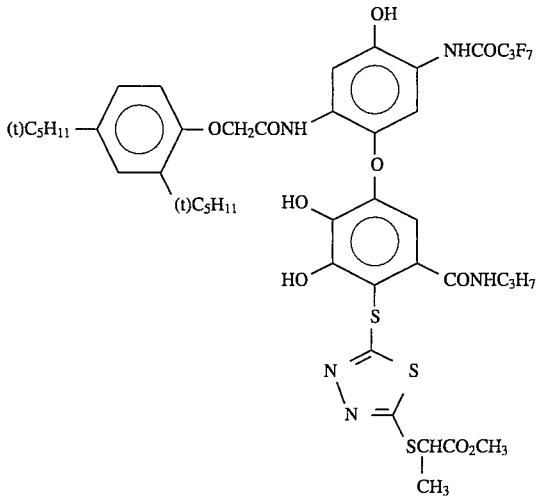
(I-6)
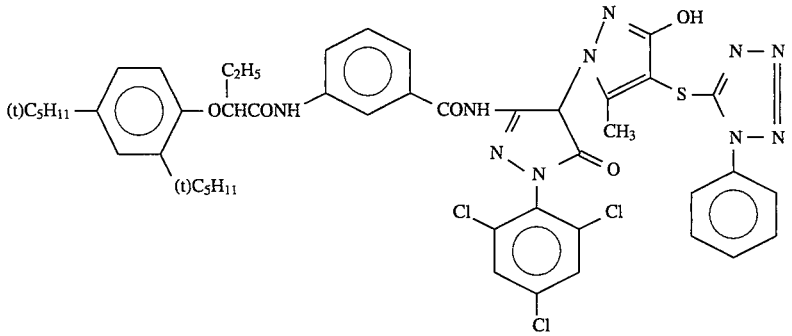
(I-7)
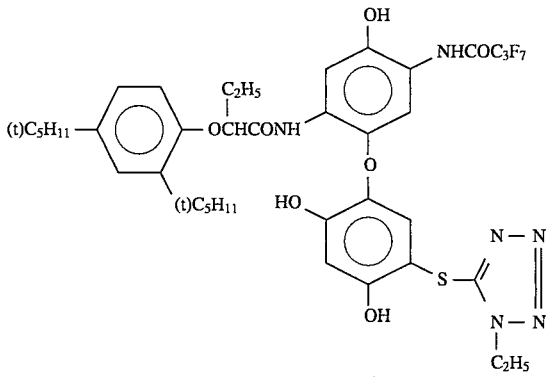
(I-8)
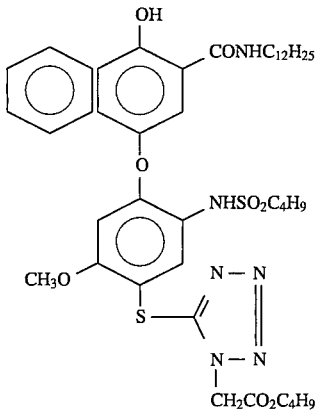

-continued
(I-9)
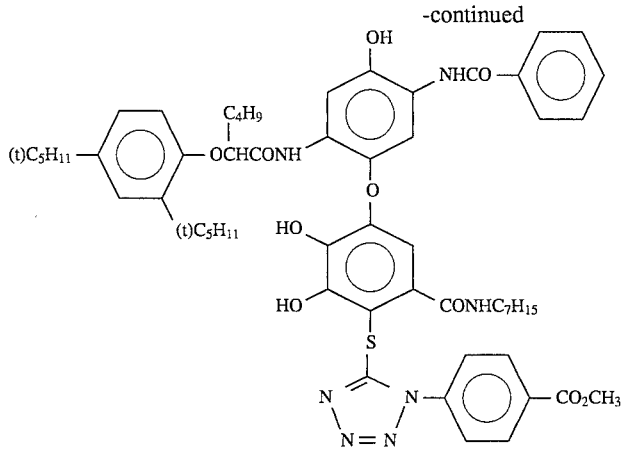
(I-10)
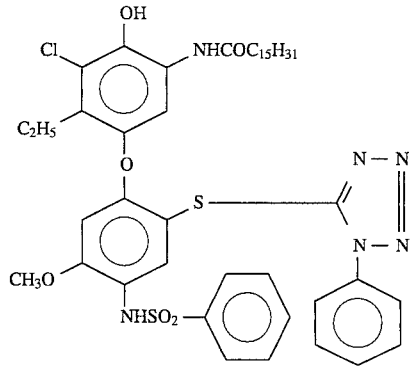
(I-11)
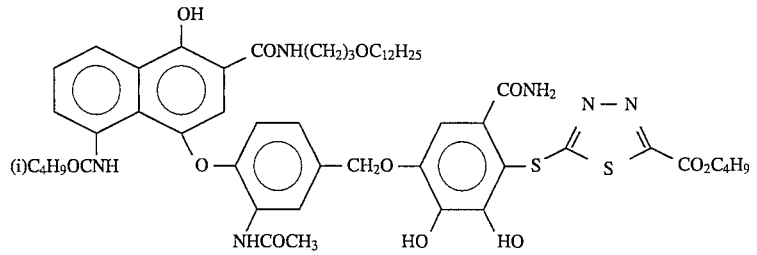
(I-12)
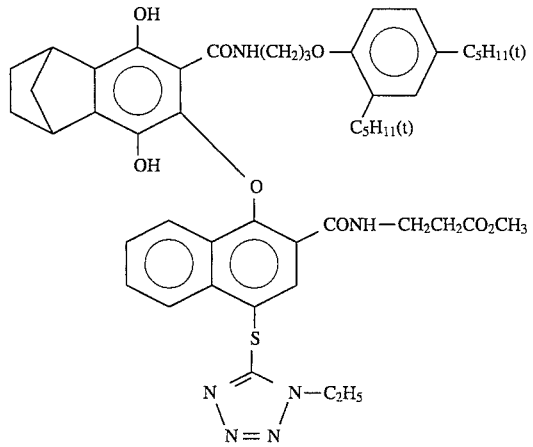

-continued
(I-13)
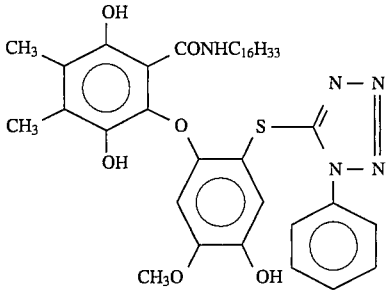
(I-14)
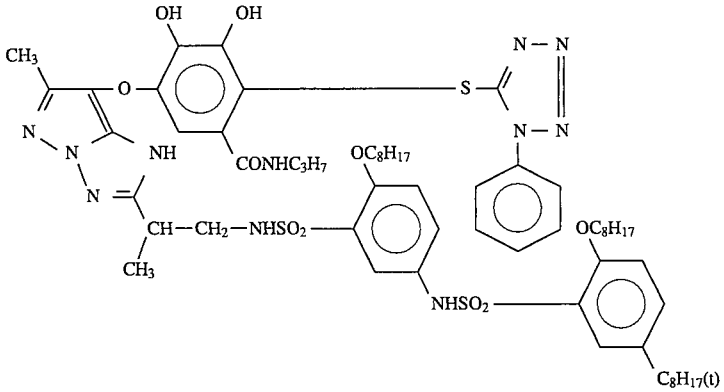
(I-15)
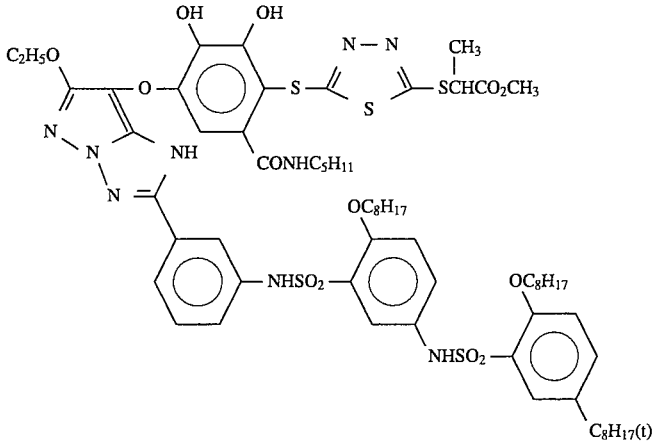
(I-16)
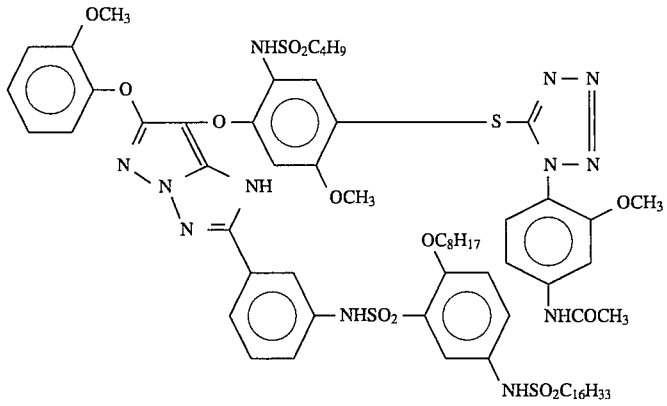

-continued
(I-17)
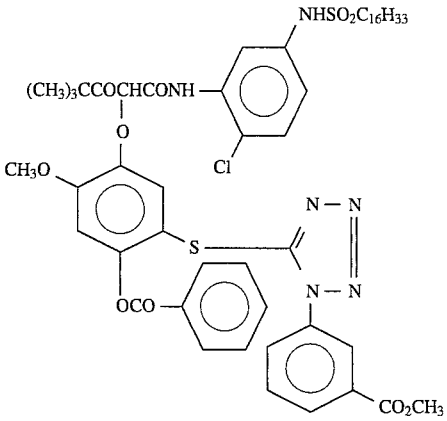
(I-18)
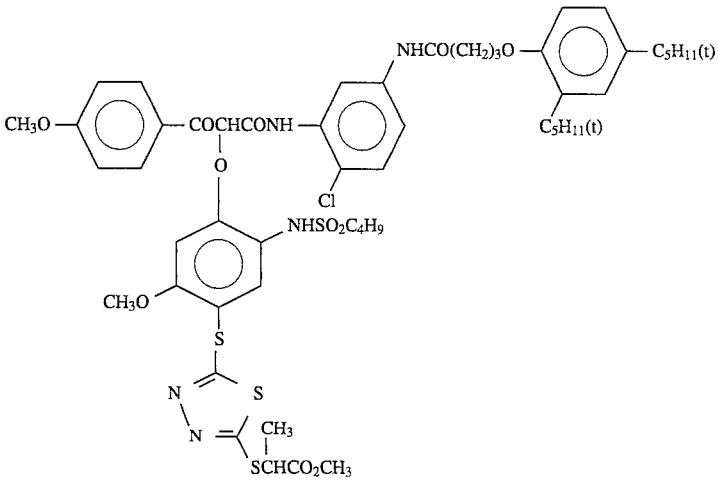
(I-21)
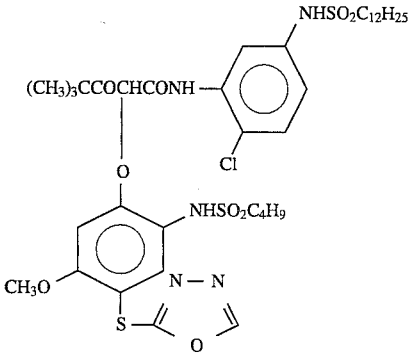
(I-22)
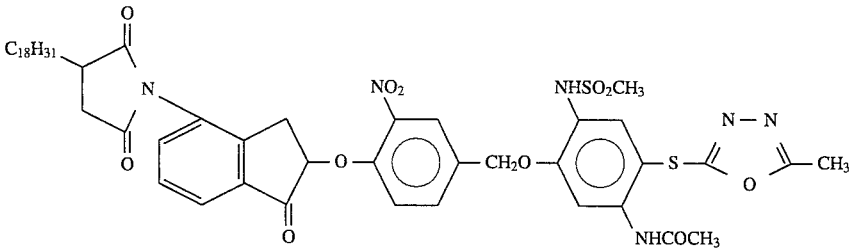

-continued
(I-19)
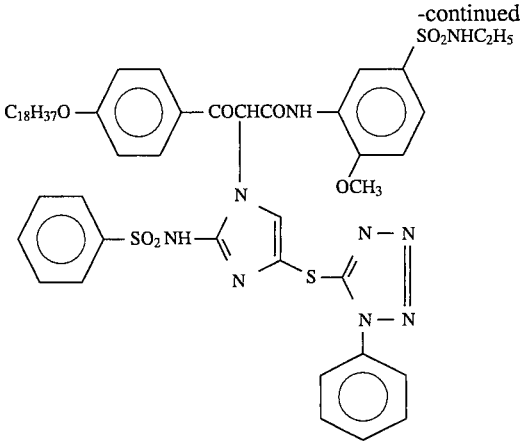
(I-20)
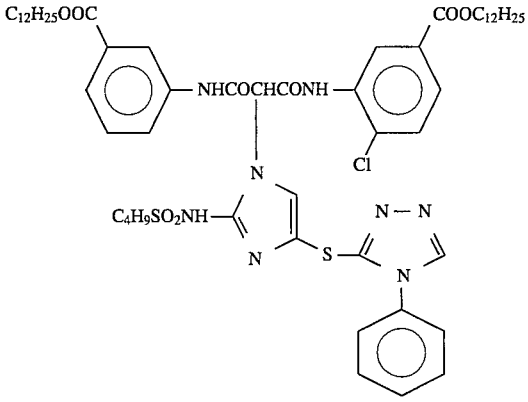
(I-23)
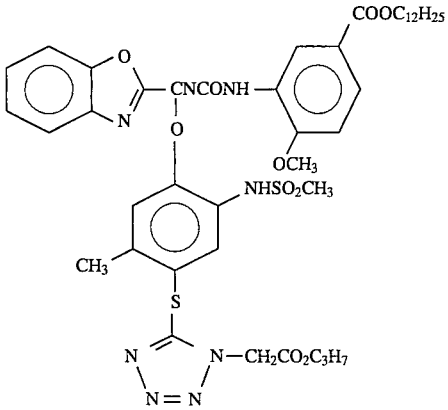
(I-24)
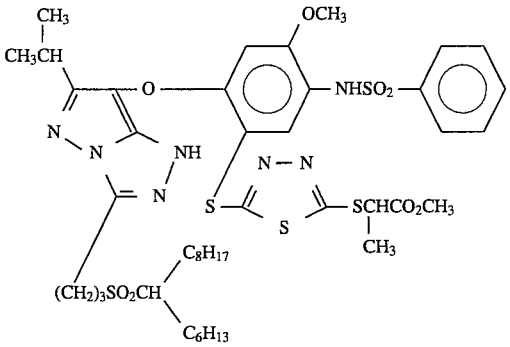

-continued (I-25)

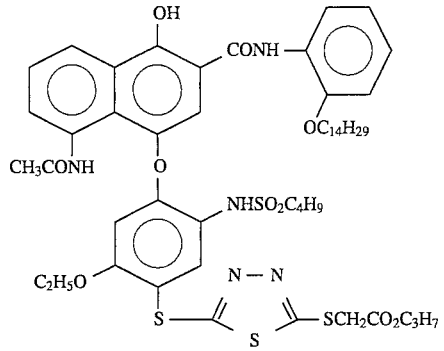

The compounds represented by general formula (D) of this invention are preferably added to a photosensitive silver halide emulsion layer or a layer adjacent thereto in the photosensitive material. The amount to be added is from $1\times10^{-6}$ to $1\times10^{-3}$ mol/m2, preferably from $3\times10^{-6}$ to $5\times10^{-4}$ mol/m$^2$, and most desirably from $1\times10^{-5}$ to $2\times10^{-4}$ mol/m$^2$.

A photosensitive material of this invention should have positioned on a support at least one blue sensitive silver halide emulsion layer, at least one green sensitive silver halide emulsion layer, and at least one red sensitive silver halide emulsion layer. But no particular limitation is imposed upon the number or order of the silver halide emulsion layers and the non-photosensitive layers. Typically, a silver halide photographic material has, on a support, at least one photosensitive layer comprised of a plurality of silver halide emulsion layers which have essentially the same color sensitivity but different photographic speeds, the photosensitive layer being a unit photosensitive layer which is color sensitive to blue light, green light or red light. In a multi-layer silver halide color photographic material, the arrangement of the unit photosensitive layers generally involves their position in the order, from the support side, of a red sensitive layer, a green sensitive layer, and a blue sensitive layer. However, this order may be reversed, as required, and the layers may be arranged in such a way that a layer which has a different color sensitivity is sandwiched between layers which have the same color sensitivity.

Various non-photosensitive layers, such as intermediate layers for example, may be established between the above mentioned silver halide photosensitive layers, and as the uppermost and lowermost layers.

The intermediate layers may contain couplers and DIR compounds for example such as those disclosed in the specifications of JP-A-61-43748, JP-A-59-113438, JP-A-59-113440, JP-A-61-20037 and JP-A-61-20038, and they may also contain the commonly used anti-color mixing compounds.

The plurality of silver halide emulsion layers constituting each unit photosensitive layer is preferably a double layer structure comprised of a high speed emulsion layer and a low speed emulsion layer, as disclosed in West German Patent 1,121,470 or British Patent 923,045. Generally, arrangements in which the photographic speed is lower in the layer closer to the support are preferred, and non-photosensitive layers may be established between each of the silver halide emulsion layers. Furthermore, the low speed layer may be arranged on the side furthest away from the support and the high speed layer may be arranged on the side closest to the support as disclosed, for example, in JP-A-57-112751, JP-A-62-200350, JP-A-62-206541 and JP-A-62-206543.

In practical terms, the arrangement may be, from the side furthest from the support, a low speed blue sensitive layer (BL)/a high speed blue sensitive layer (BH)/a high speed green sensitive layer (GH)/a low speed green sensitive layer (GL)/a high speed red sensitive layer (RH)/a low speed red sensitive layer (RL), or BH/BL/GL/GH/RH/RL, or BH/BL/GH/GL/RL/RH.

Furthermore, the layers can be arranged in the order, from the side furthest from the support, of blue sensitive layer/GH/RH/GL/RL as disclosed in JP-B-55-34932. Furthermore, the layers can also be arranged in the order, from the side furthest away from the support, of blue sensitive layer/GL/RL/GH/RH, as disclosed in the specifications of JP-A-56-25738 and JP-A-62-63936.

Furthermore, there are arrangements in which there are three layers which have different speeds with the photosensitivity falling towards the support and with the silver halide emulsion layer of the highest photosensitivity at the top, a silver halide emulsion layer which has a lower photosensitivity than the aforementioned layer as an intermediate layer and a silver halide emulsion layer which has a lower photosensitivity than the intermediate layer as a bottom layer, as disclosed in JP-B-49-15495. In the case of structures of this type which have three layers with different photosensitivities, the layers in a layer of the same color sensitivity may be arranged in the order, from the side furthest from the support, of intermediate speed emulsion layer/high speed emulsion layer/low speed emulsion layer, as disclosed in the specification of JP-A-59-202464.

Furthermore, the layers can be arranged in the order high speed emulsion layer/low speed emulsion layer/intermediate speed emulsion layer, or low speed emulsion layer/intermediate speed emulsion layer/high speed emulsion layer, for example.

Furthermore, the arrangement may be varied in the ways indicated above in cases where there are four or more layers.

As described above, various layer structures and arrangements can be selected respectively according to the intended purpose of the photosensitive material.

The preferred silver halides for inclusion in the photographic emulsion layers of a photographic material used in this invention are silver iodobromides, silver iodochlorides or silver iodochlorobromides which contain not more than about 30 mol % of silver iodide. Most desirably, the silver halide is a silver iodobromide or silver iodochlorobromide which contains from about 2 mol % to about 10 mol % of silver iodide.

The silver halide grains in the photographic emulsion may have a regular crystalline form such as a cubic, octahedral or tetradecahedral form, an irregular crystalline form such as a spherical or plate-like form, a form which has crystal defects such as twinned crystal planes, or a form which is a composite of these forms.

The grain size of the silver halide may be very fine at less that about 0.2 microns, or large with a projected area diameter of up to about 10 microns, and the emulsions may be poly-disperse emulsions or mono-disperse emulsions.

Silver halide photographic emulsions which can be used in this invention can be prepared, for example, using the methods disclosed in *Research Disclosure* (RD) No. 17643 (December, 1978), pages 22–23, "I. Emulsion Preparation and Types", *Research Disclosure* No. 18716 (November 1979), page 648, and *Research Disclosure,* No. 307105 (November 1989), pages 863–865, by P. Glafkides in *Chimie et Physique Photographique,* published by Paul Montel, 1967, by G. F. Duffin in *Photographic Emulsion Chemistry,* published by Focal Press, 1966, and by V. L. Zelikmann et al. in *Making and Coating Photographic Emulsions,* published by Focal Press, 1964.

The mono-disperse emulsions disclosed, for example, in U.S. Pat. Nos. 3,574,628 and 3,655,394, and in British Patent 1,413,748, are also desirable.

Furthermore, tabular grains which have an aspect ratio of at least about 3 can also be used in this invention. Tabular grains can be prepared easily using the methods described, for example, by Gutoff in *Photographic Science and Engineering,* Volume 14, pages 248–257 (1970), and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions, or the grains may have a layer-like structure. Moreover, silver halides which have different compositions may be joined with an epitaxial junction or they may be joined with compounds other than silver halides, such as silver thiocyanate or lead oxide, for example. Furthermore, mixtures of grains which have various crystalline forms may be used.

The above mentioned emulsions may be of the surface latent image type with which the latent image is formed principally on the surface, of the internal latent image type in which the latent image is formed within the grains, or of a type with which the latent image is formed both at the surface and within the grains, but a negative type emulsion is necessary. From among the internal latent image types, the emulsion may be a core/shell internal latent image type emulsion as disclosed in JP-A-63-264740. A method for the preparation of such a core/shell internal latent image type emulsion has been disclosed in JP-A-59-133542. The thickness of the shell of the emulsion differs according to development processing for example, but it is preferably from 3 to 40 nm, and most desirably from 5 to 20 nm.

The silver halide emulsions used have generally been subjected to physical ripening, chemical ripening and spectral sensitization. Additives which are used in such processes have been disclosed in *Research Disclosure* Nos. 17643, 18716 and 307105, and the locations of these disclosures are summarized in the table provided hereinafter.

Two or more different types of emulsions which differ in terms of at least one characteristic such as grain size, grain size distribution or halogen composition of the photosensitive silver halide emulsion, the grain form or photographic speed, can be used in the form of a mixture in the same layer in a photosensitive material of this invention.

The use of essentially non-photosensitive hydrophilic colloid layers and/or photosensitive silver halide emulsion layers containing silver halide grains in which the grain surface has been fogged as disclosed in U.S. Pat. No. 4,082,553, silver halide grains in which the grain interior has been fogged as disclosed in U.S. Pat. No. 4,626,498 and JP-A-59-214852, or colloidal silver is desirable. Silver halide grains in which the grain interior or surface has been fogged are grains which can be developed uniformly (not in the form of the image) irrespective of whether they are in an unexposed part or an exposed part of the photosensitive material. Methods for the preparation of silver halide grains of which the interior or surface of the grains has been fogged have been disclosed in U.S. Pat. No. 4,626,498 and JP-A-59-214852.

The silver halide which forms the internal nuclei of the core/shell type silver halide grains in which the interior has been fogged may have the same halogen composition or a different halogen composition. The silver halide in which the interior or surface of the grains has been fogged may be silver chloride, silver chlorobromide, silver iodobromide or silver chloroiodobromide. No particular limitation is imposed upon the grain size of these fogged silver halide grains, but an average grain size of from 0.01 to 0.75 μm, and especially of from 0.05 to 0.6 μm, is preferred. Furthermore, no particular limitation is imposed upon the form of the grains and they may be regular grains, and they may be poly-disperse emulsions. But mono-disperse emulsions (in which at least 95% in terms of the weight or number of silver halide grains have a grain size within ±40% of the average grain size) are preferred.

The use of non-photosensitive fine grained silver halides is desirable in this invention. Non-photosensitive fine grained silver halides are fine grained silver halides which are not photosensitive at the time of the imagewise exposure for obtaining the dye image and which undergo essentially no development during development processing, and those which have not been pre-fogged are preferred.

The fine grained silver halide has a silver bromide content from 0 to 100 mol % and may contain silver chloride and/or silver iodide as required. Those which have a silver iodide content of from 0.5 to 10 mol % are preferred.

The fine grained silver halide has an average grain size (the average value of the diameters of the circles corresponding to the projected areas) preferably of from 0.01 to 0.5 μm, and most desirably of from 0.02 to 0.2 μm.

The fine grained silver halide can be prepared using the same methods as used in general for the preparation of photosensitive silver halides. In this case, the surface of the silver halide grains does not need to be optically sensitized and neither is there any need for spectral sensitization. However, the pre-addition of known stabilizers such as triazole, azaindene, benzothiazolium or mercapto based compounds or zinc compounds before the addition to the coating liquid is desirable. Colloidal silver can also be included desirably in the layer which contains these fine grained silver halide grains.

The coated weight of silver in a photosensitive material of this invention is preferably not more than 6.0 g/m$^2$, and most desirably not more than 4.5 g/m$^2$.

Known photographically useful additives which can be used in this present invention have been disclosed in the three *Research Disclosures* referred to above, and the locations of these disclosures are indicated in the table below.

| Type of Additive | RD17643 (December 1978) | RD18716 (November 1979) | RD307105 (November 1989) |
|---|---|---|---|
| 1. Chemical Sensitizers | Page 23 | Page 648, right hand column | Page 866 |
| 2. Speed Increasing Agents | | Page 648, right hand column | |
| 3. Spectral | Pages | Page 648 right | Pages 866–868 |

-continued

| Type of Additive | RD17643 (December 1978) | RD18716 (November 1979) | RD307105 (November 1989) |
|---|---|---|---|
| Sensitizers, Super-Sensitizers | 23–24 | hand column–page 649 right hand column | |
| 4. Bleaching Agents | Page 24 | Page 647, right hand column | Page 868 |
| 5. Anti-foggants, Stabilizers | Pages 24–25 | Page 649, right hand column | Pages 868–870 |
| 6. Light Absorbers, Filter Dyes and Ultra-violet absorbers | Pages 25–26 | Page 649, right hand column–page 650, left hand column | Page 873 |
| 7. Anti-staining Agents | Page 25, right hand column | Page 650, left hand column–right hand column | Page 872 |
| 8. Dye Image Stabilizers | Page 25 | page 650, left hand column | Page 872 |
| 9. Film Hardening Agents | Page 26 | Page 651, left hand column | Pages 874–875 |
| 10. Binders | Page 26 | Page 651, left hand column | Pages 873–874 |
| 11. Plasticizers, Lubricants | Page 27 | Page 650, right hand column | Page 876 |
| 12. Coating promotors Surfactants | Pages 26–27 | Page 650, right hand column | Pages 875–876 |
| 13. Anti-static agents | Page 27 | Page 650, right hand column | Pages 876–877 |
| 14. Matting Agents | | | Pages 878–879 |

Furthermore, addition of the compounds which can react with and fix formaldehyde, disclosed in U.S. Pat. Nos. 4,411,987 and 4,435,503, to the photosensitive material is desirable for preventing deterioration of photographic performance due to formaldehyde gas.

Various color couplers can be used in this invention, and examples have been disclosed in the patents cited in the aforementioned Research Disclosure No. 17643, sections VII-C–G and *Research Disclosure* No. 307105, sections VII-C–G.

Those disclosed, for example, in U.S. Pat. Nos. 3,933,501, 4,022,620, 4,326,02.4, 4,401,752 and 4,248,961, JP-B-58-10739, British Patents 1,425,020 and 1,467,760, U.S. Pat. Nos. 3,973,968, 4,314,023 and 4,511,649, and European Patent 249,473A are preferred as yellow couplers.

The couplers disclosed, for example, in U.S. Pat. Nos. 4,310,619 and 4,351,897, European Patent 73,636, U.S. Pat. Nos. 3,061,432 and 3,725,067, JP-A-60-35730, JP-A-55-118034, JP-A-60-185951, U.S. Pat. No. 4,556,630 and International Patent laid open WO88/04795 are especially desirable as magenta couplers as well as those represented by general formula (M) of this invention.

Phenol and naphthol based couplers can be cited as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent laid open 3,329,729, European Patents 121,365A and 49,453A, U.S. Pat. Nos. 3,446,622, 4,333,999, 4,775,616, 4,451,559, 4,427,767, 4,690,889, 4,254,212 and 4,296,199, and JP-A-61-42658 are preferred.

Typical examples of polymerized dye forming couplers have been disclosed, for example, in U.S. Pat. Nos. 3,451,820, 4,080,211, 4,367,282, 4,409,320 and 4,576,910, British Patent 2,102,137, and European Patent 341,188A.

The couplers disclosed in U.S. Pat. No. 4,366,237, British Patent 2,125,570, European Patent 96,570 and West German Patent (Laid Open) 3,234,533 are preferred as couplers of which the colored dyes have a suitable degree of diffusibility.

The colored couplers for correcting the unwanted absorptions of colored dyes disclosed, for example, in section VII-G of *Research Disclosure* No. 17643, section VII-G of *Research Disclosure* No. 307105, U.S. Pat. No. 4,163,670, JP-B-57-39413, U.S. Pat. Nos. 4,004,929 and 4,138,258, and British Patent 1,146,368 are desirable. Furthermore, the use of couplers which correct the unwanted absorption of colored dyes by means of fluorescent dyes which are released on coupling as disclosed in U.S. Pat. No. 4,774,181, and couplers which have, as leaving groups, dye precursor groups which can form dyes on reaction with the developing agent as disclosed in U.S. Pat. No. 4,777,120 is also desirable.

The use of compounds which release photographically useful residual groups on coupling is also desirable in this invention. The DIR couplers which release development inhibitors disclosed in the patents cited in section VII-F of the aforementioned *Research Disclosure* 17643 and section VII-F of *Research Disclosure* No. 307105, JP-A-57-151944, JP-A-57-154234, JP-A-60-184248, JP-A-63-37346, JP-A-63-37350 and U.S. Pat. Nos. 4,248,962 and 4,782,012 are preferred.

The couplers disclosed in British Patents 2,097,140 and 2,131,188, JP-A-59-157638 and JP-A-59-170840 are preferred as couplers which release nucleating agents or development accelerators in the form of the image during development.

Other compounds which can be used in photosensitive materials of this invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the DIR redox compound releasing couplers, DIR coupler releasing couplers, DIR coupler releasing redox compounds or DIR redox releasing redox compounds disclosed, for example, in JP-A-60-85950 and JP-A-62-24252, the couplers which release dyes of which the color is restored after elimination disclosed in European Patents 173,302A and 313,308A, the bleaching accelerator releasing couplers disclosed, for example, in *Research Disclosure* Nos. 11449 and 24241 and JP-A-61-201247, the ligand releasing couplers disclosed, for example, in U.S. Pat. No. 4,555,477, the leuco dye releasing couplers disclosed in JP-A-63-75747, and the couplers which release fluorescent dyes disclosed in U.S. Pat. No. 4,774,181.

The couplers used in this invention can be introduced into the photosensitive material using various known methods of dispersion.

Examples of high boiling point solvents which can be used in the oil in water dispersion method have been disclosed, for example, in U.S. Pat. No. 2,322,027.

Examples of high boiling point organic solvents which have a boiling point of at least 175° C. at normal pressure which can be used in the oil in water dispersion method include phthalic acid esters (for example, dibutyl phthalate, dicyclohexyl phthalate, di-2-ethylhexyl phthalate, decyl phthalate, bis(2,4-di-tert-amylphenyl)phthalate, bis(2,4-di-tert-amylphenyl) isophthalate and bis(1,1-diethylpropyl)phthalate), phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexyl phenyl phosphonate), benzoic acid esters (for example, 2-ethylhexyl benzoate, dodecyl benzoate, 2-ethylhexyl p-hydroxybenzoate), amides (for example, N,N-diethyl-dodecanamide, N,N-diethyl-laurylamide and N-tetradecylpyrrolidone), alcohols or phenols (for example, iso-stearyl alcohol and 2,4-di-tert-amylphenol), aliphatic carboxylic acid esters (for example, bis(2-ethyl-hexyl)sebacate, dioctyl azelate, glycerol tributyrate, iso-stearyl lactate and trioctyl citrate), aniline derivatives (for example, N,N-dibutyl-2-butoxy-5-tert-octylaniline) and hydrocarbons (for example, paraffins, dodecylbenzene and di-isopropylnaphthalene).

Furthermore, organic solvents which have a boiling point above about 30° C., and preferably of at least 50° C., but below about 160° C. can be used as auxiliary solvents, and typical examples of these solvents include ethyl acetate, butyl acetate, ethyl propionate, methyl ethyl ketone, cyclohexanone, 2-ethoxyethyl acetate and dimethylformamide.

The processes and effects of the latex dispersion method and examples of latexes for loading purposes have been disclosed, for example, in U.S. Pat. Nos. 4,199,363, and in West German Patent Applications (OLS) 2,541,274 and 2,541,230.

The addition to the color photosensitive materials of this invention of various fungicides and biocides such as phenethyl alcohol and 1,2-benzisothiazolin-3-one, n-butyl p-hydroxybenzoate, phenol, 4-chloro-3,5-dimethylphenol, 2-phenoxyethanol and 2-(4-thiazolyl)benzimidazole for example as disclosed in JP-A-63-257747, JP-A-62-272248 and JP-A-1-80941 is desirable.

This invention can be applied to various types of color photosensitive material. Typical examples include color negative films for general and cinematographic purposes, color reversal films for slides and television purposes, color papers, color positive films and color reversal papers.

Suitable supports which can be used in this invention have been disclosed, for example, on page 28 of the aforementioned *Research Disclosure* No. 17643, from the right hand column of page 647 to the left hand column of page 648 of *Research Disclosure* No. 18716, and on page 879 of *Research Disclosure* No. 307105

The photosensitive materials of this invention are such that the total film thickness of all the hydrophilic colloid layers on the side where the emulsion layers are located is preferably not more than 28 μm, more desirably not more than 23 μm, even more desirably not more than 18 μm, and most desirably not more than 16 μm. Furthermore, the film swelling rate $T_{1/2}$ is preferably not more than 30 seconds and most desirably not more than 20 seconds. Here, the film thickness signifies the film thickness measured under conditions of 25° C., 55% relative humidity (2 days) and the film swelling rate $T_{1/2}$ is that measured using the methods well known to those in the industry. For example, measurements can be made using a swellometer of the type described by A. Green in *Photogr. Sci. Eng.*, Volume 19, Number 2, pages 124–129, and $T_{1/2}$ is defined as the time taken to reach half the saturated film thickness, taking 90% of the maximum swelled film thickness reached on processing the material for 3 minutes 15 seconds in a color developer at 30° C. as the saturated film thickness.

The film swelling rate $T_{1/2}$ can be adjusted by adding film hardening agents to the gelatin which is used as a binder, or by changing the ageing conditions after coating. Furthermore, a swelling factor of from 150% to 400% is preferred. The swelling factor can be calculated from the maximum swelled film thickness obtained under the conditions described above using the expression (maximum swelled film thickness minus film thickness)/film thickness.

Color photographic materials which are in accordance with this invention can be developed and processed using the general methods disclosed on pages 28–29 of the aforementioned *Research Disclosure* No. 17643, from the left hand column to the right hand column of page 615 of the aforementioned *Research Disclosure* No. 18716, and on pages 880 to 881 of *Research Disclosure* No. 307105.

The color developers used for the development processing of photosensitive materials of this invention are preferably aqueous alkaline solutions which contain a primary aromatic amine based color developing agent as the principal component. Aminophenol based compounds are also useful, but the use of p-phenylenediamine based compounds as color developing agents is preferred. Typical examples include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline and the sulfate, hydrochloride and p-toluenesulfonate salts of these compounds. Among these compounds, 3-methyl-4-amino-N-ethyl-N-β-hydroxyethylaniline sulfate is especially desirable. Two or more of these compounds can be used conjointly, as required.

The color developer generally contains pH buffers such as alkali metal carbonates, borates or phosphates, and development inhibitors or anti-foggants such as chloride, bromide, iodide, benzimidazoles, benzothiazoles or mercapto compounds. They may also contain, as required, various preservatives such as hydroxylamine, diethylhydroxylamine, sulfite, hydrazines such as N,N-biscarboxymethylhydrazine, phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, dye forming couplers, competitive couplers, auxiliary developing agents such as 1-phenyl-3-pyrazolidone, thickeners and various chelating agents as typified by aminopolycarboxylic acids, aminopolyphosphonic acids, alkylphosphonic acids and phosphonocarboxylic acids. Typical examples of which include ethylenediamine tetra-acetic acid, nitrilotriacetic acid, diethylenetriamine penta-acetic acid, cyclohexanediamine tetra-acetic acid, hydroxyethyliminodiacetic acid, 1-hydroxy-ethylidene-1,1-diphosphonic acid, nitrilo-N,N,N-trimethylene-phosphonic acid, ethylenediamine-N,N,N,N-tetramethylene-phosphonic acid, ethylenediamine-di(o-hydroxyphenylacetic acid) and salts of these acids.

Furthermore, color development is carried out after normal black and white development in the case of reversal processing. Known black and white developing agents including dihydroxybenzenes such as hydroquinone, 3-pyrazolidones such as 1-phenyl-3-pyrazolidone and aminophenols such as N-methyl-p-aminophenol, for example, can be used individually, or in combination, in the black and white developer.

The pH of these color developers and black and white developers is generally from 9 to 12. Furthermore, the replenishment rate for these developers depends on the color photographic material which is being processed but, in general, it is not more than 3 liters per square meter of photosensitive material, and it can be set to not more than 500 ml by reducing the bromide ion concentration in the replenisher. In those cases where the replenishment rate is low, it is desirable that evaporation and aerial oxidation of the liquid should be prevented by minimizing the area of contact with the air in the processing tank.

The contact area between the air and the photographic processing bath in a processing tank can be represented by the open factor which is defined below.
Thus:

$$\text{Open Factor} = \frac{\text{Processing Bath and Air Contact Area (cm}^2\text{)}}{\text{Processing Bath Volume (cm}^3\text{)}}$$

The above mentioned open factor is preferably not more than 0.1, and most desirably from 0.001 to 0.05. In addition to the establishment of a shielding material such as a floating lid for example on the surface of the photographic processing bath in the processing tank, the method involving a movable lid as disclosed in JP-A-1-82033 and the method involving slit development processing disclosed in JP-A-63-216050 can be used as a means of reducing the open factor. Reduction of the open factor is preferably applied not only to the processes of color development and black and white development but also to all the subsequent processes, such as the bleaching, bleach-fixing, fixing, water washing and stabilizing processes. Furthermore, the replenishment rate can be reduced by using some means of suppressing the accumulation of bromide ion in the development bath.

The color development processing time is generally between 2 and 5 minutes, but shorter processing times can be devised by increasing the pH or by increasing the concentration of the color developing agent.

The photographic emulsion layer is generally subjected to a bleaching process after color development. The bleaching process may be carried out at the same time as a fixing process (in a bleach-fix process) or it may be carried out separately. Moreover, methods in which a bleach-fix process is carried out after a bleaching process may be used in order to speed up processing. Moreover, processing can be carried out in two connected bleach-fix baths, a fixing process can be carried out before a bleach-fixing process or a bleaching process can be carried out after a bleach-fixing process, as required. Compounds of multi-valent metals, such as iron(III) for example, peracids, quinones and nitro compounds for example can be used as bleaching agents. Typical bleaching agents include organic complex salts of iron(III), for example complex salts with aminopolycarboxylic acids such as ethylenediamine tetra-acetic acid, diethylenetriamine penta-acetic acid, cyclohexanediamine tetra-acetic acid, methylimino diacetic acid, 1,3-diaminopropane tetra-acetic acid and glycol ether diamine tetra-acetic acid, or citric acid, tartaric acid or malic acid for example. Among these materials, the use of polyaminocarboxylic acid iron(III) complex salts, and principally ethylenediamine tetra-acetic acid iron(III) complex salts and 1,3-diaminopropane tetra-acetic acid iron(III) salts, is preferred from the point of view of both rapid processing and the prevention of environmental pollution. Moreover, the aminopolycarboxylic acid iron(III) complex salts are especially useful in both bleach baths and bleach-fix baths. The pH value of the bleach baths and bleach-fix baths in which these aminopolycarboxylic acid iron(III) salts are used is generally from 4.0 to 8, but lower pH values can be used in order to speed up processing.

Bleaching accelerators can be used, as required, in the bleach baths, bleach-fix baths or bleach or bleach-fix prebaths. Examples of useful bleach accelerators are the following: the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and Research Disclosure No. 17129 (July 1978); the thiazolidine derivatives disclosed in JP-A-50-140129; the thiourea derivatives disclosed in JP-B-45-8506, JP-A-52-20832, JP-A-53-32735 and U.S. Pat. No. 3,706,561, the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-40943, JP-A-49-59644, JP-A-53-94927, JP-A-54-35727, JP-A-55-26506 and JP-A-58-163940; and the bromide ion. Among these compounds, those which have a mercapto group or a disulfide group are preferred in view of their large accelerating effect, and the compounds disclosed in U.S. Pat. No. 3,893,858, West German Patent 1,290,812 and JP-A-53-95630 are especially desirable. Moreover, the compounds disclosed in U.S. Pat. No. 4,552,834 are also desirable. These bleaching accelerators may be added to the sensitive materials. These bleaching accelerators are especially effective when bleach-fixing camera color photosensitive materials.

The inclusion of organic acids as well as the compounds indicated above in the bleach baths and bleach-fix baths is desirable for preventing the occurrence of bleach staining. Compounds which have an acid dissociation constant (pKa) of from 2 to 5 are especially desirable for the organic acids, and in practice acetic acid and propionic acid, for example, are preferred.

Thiosulfate, thiocyanate, thioether based compounds, thioureas and large amounts of iodide can be used, for example, as the fixing agent which is used in a fixer or bleach-fixer, but thiosulfate is generally used, and ammonium thiosulfate in particular can be used in the widest range of applications. Furthermore, the conjoint use of thiosulfate and thiocyanate, thioether compounds, thiourea, etc. , is also desirable. Sulfite, bisulfite, carbonyl/bisulfite addition compounds or the sulfinic acid compounds disclosed in European Patent 294,769A are preferred as preservatives for fixers and bleach-fixers. Moreover, the addition of various aminopolycarboxylic acids and organophosphonic acids to the fixing baths and bleach-fixing baths is desirable for stabilizing these baths.

The addition of compounds of a pKa from 6.0 to 9.0 and preferably imidazoles such as imidazole, 1-methylimidazole, 1-ethylimidazole and 2-methylimidazole in amounts of from 0.1 to 10 mol/liter to the fixer or bleach-fixer is desirable in this invention.

A shorter total de-silvering processing time within the range where de-silvering failure does not occur is preferred. The de-silvering time is preferably from 1 to 3 minutes, and most desirably from 1 to 2 minutes. Furthermore, the processing temperature is from 25° C. to 50° C., and preferably from 35° C. to 45° C. The de-silvering rate is increased and the occurrence of staining after processing is effectively prevented within the preferred temperature range.

As much agitation as possible is desirable during the de-silvering process. Examples of methods of strong agitation include the methods in which a jet of processing liquid impinges on the emulsion surface of the photosensitive material as disclosed in JP-A-62-183460, the method in which the agitation effect is increased using a rotary device as disclosed in JP-A-62-183461, the method in which the photosensitive material is moved with a wiper blade which is established in the bath in contact with the emulsion surface and the agitation effect is increased by the generation of turbulence at the emulsion surface, and the method in which the circulating flow rate of the processing bath as a whole is increased. These means of increasing agitation are effective in bleach baths, bleach-fix baths and fixing baths. It is thought that increased agitation increases the rate of supply of bleaching agent and fixing agent to the emulsion film and consequently increases the de-silvering rate. Furthermore, the aforementioned means of increasing agitation are more effective in cases where a bleaching accelerator is used, and they sometimes provide a marked increase in the accelerating effect and eliminate the fixer inhibiting action of the bleaching accelerator.

The automatic processors which are used for photosensitive materials of this invention preferably have photosensitive material transporting devices as disclosed in JP-A-60-191257, JP-A-60-191258 or JP-A-60-191259. With such a transporting device, for example that disclosed in the aforementioned JP-A-60-191257, the carry-over of processing liquid from one bath to the next is greatly reduced, and this is very effective for preventing deterioration in processing bath performance. These effects are especially useful for shortening the processing time in each process and for reducing the replenishment rate of each processing bath.

The silver halide color photographic materials of this invention are generally subjected to a water washing process and/or stabilizing process after the de-silvering process. The amount of wash water used in the washing process can be fixed within a wide range, depending on the application and the nature of the photosensitive material (depending on the materials such as couplers which have been used for example), the wash water temperature, the number of water washing tanks (the number of water washing stages) and the replenishment system, i.e., whether a counter flow or a sequential flow system is used, and various other conditions. The relationship between the amount of water used and the number of washing tanks in a multi-stage counter-flow system can be obtained using the method outlined on pages 248–253 of the *Journal of the Society of Motion Picture and Television Engineers,* Volume 64 (May 1955).

The amount of wash water used can be greatly reduced by using the multi-stage counter-flow system noted in the aforementioned references, but bacteria proliferate due to the increased residence time of the water in the tanks and problems arise with the suspended matter which is produced becoming attached to the photosensitive material. The method in which the calcium ion and magnesium ion concentrations are reduced, disclosed in JP-A-62-288838, is very effective as a means of overcoming this problem when processing color photosensitive materials of this invention. Furthermore, the isothiazolone compounds and thiabendazoles disclosed in JP-A-57-8542, the chlorine based disinfectants such as chlorinated sodium isocyanurate, and benzotriazole, for example, and the disinfectants disclosed in *The Chemistry of Biocides and Fungicides* by Horiguchi, (1986, Sanko Shuppan), in *Killing Micro-organisms, Biocidal and Fungicidal Techniques* (1982) published by the Health and Hygiene Technology Society, and in *A Dictionary of Biocides and Fungicides* (1986) published by the Japanese Biocide and Fungicide Society, can also be used in this connection.

The pH value of the washing water for processing photosensitive materials of this invention is from 4 to 9, and preferably from 5 to 8. The washing water temperature and the washing time can be set variously in accordance with the nature and application of the photosensitive material but, in general, washing conditions of from 20 seconds to 10 minutes at a temperature of from 15° C. to 45° C., and preferably of from 30 seconds to 5 minutes at a temperature of from 25° C. to 40° C., are selected. Moreover, the photosensitive materials of this invention can be processed directly in a stabilizing bath instead of being subjected to a water wash as described above. The known methods disclosed in JP-A-57-8543, JP-A-58-14834 and JP-A-60-220345 can be used for a stabilization process of this type.

Furthermore, there are also cases in which a stabilization process is carried out following the aforementioned water washing process. Stabilizing baths which contain dye stabilizing agents and surfactants which are used as final baths with camera color photosensitive materials are an example of such a process. Aldehydes such as formaldehyde and glutaraldehyde, N-methylol compounds, hexamethylenetetramine and aldehyde/sulfurous acid adducts can be used, for example, as dye stabilizing agents.

Various chelating agents and fungicides can also be added to these stabilizing baths.

The overflow which accompanies replenishment of the above mentioned water washing and/or stabilizing baths can be reused in other processes such as the de-silvering process.

Concentration correction with the addition of water is desirable in cases where the above mentioned processing baths become concentrated due to evaporation when processing in an automatic processor for example.

Color developing agents may be incorporated into a silver halide color photosensitive material of this invention with a view to simplifying and speeding up processing. The incorporation of various color developing agent precursors is preferred. For example, the indoaniline-based compounds disclosed in U.S. Pat. No. 3,342,597, the Shiff's base type compounds disclosed in U.S. Pat. No. 3,342,599, *Research Disclosure* No. 14850 and *Research Disclosure* No. 15159, the aldol compounds disclosed in *Research Disclosure* No. 13924, the metal complex salts disclosed in U.S. Pat. No. 3,719,492 and the urethane based compounds disclosed in JP-A-53-135628 can be used for this purpose.

Various 1-phenyl-3-pyrazolidones may be incorporated, as required, into a silver halide color photosensitive material of this invention to accelerate color development. Typical compounds have been disclosed, for example, in JP-A-56-64339, JP-A-57-144547 and JP-A-58-115438.

The various processing baths in this invention are used at a temperature of from 10° C. to 50° C. The standard temperature is generally from 33° C. to 38° C., but accelerated processing and shorter processing times can be realized at higher temperatures while, on the other hand, increased picture quality and improved processing bath stability can be achieved at lower temperatures.

Furthermore, the silver halide photosensitive materials of this invention can also be used as the heat developable photosensitive materials disclosed, for example, in U.S. Pat. No. 4,500,626, JP-A-60-133449, JP-A-59-218443, JP-A-61-238056 and European Patent 210,660A2.

ILLUSTRATIVE EXAMPLES

The invention is described in detail below by means of illustrative examples, but the invention is not limited by these examples.

EXAMPLE 1

Sample 101, a multi-layer color photosensitive material, was prepared by the lamination coating of layers having the compositions indicated below on a cellulose triacetate film support on which an underlayer had been established.

Photosensitive Layer Composition

The numerical value corresponding to each component indicates the coated weight in units of g/m$^2$, the coated weight being shown as the calculated weight of silver in the case of the silver halides. Furthermore, in the case of the sensitizing dyes the coated weight is indicated in units of mol per mol of silver halide in the same layer.

Sample 101:

| | |
|---|---|
| **First Layer (Anti-halation Layer)** | |
| Black colloidal silver | as silver 0.18 |
| Gelatin | 1.40 |
| **Second Layer (Intermediate Layer)** | |
| 2,5-Di-tert-pentadecylhydroquinone | 0.18 |
| EX-1 | 0.070 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| **Third Layer (First Red Sensitive Emulsion Layer)** | |
| Emulsion A | as silver 0.25 |
| Emulsion B | as silver 0.25 |
| Sensitizing Dye I | $1.0 \times 10^{-4}$ |
| Sensitizing Dye II | $2.7 \times 10^{-5}$ |
| Sensitizing Dye III | $4.7 \times 10^{-4}$ |
| EX-2 | 0.34 |
| Illustrative Compound (I-5) | 0.025 |
| EX-10 | 0.020 |
| U-1 | 0.070 |
| U-2 | 0.050 |
| U-3 | 0.070 |
| HBS-1 | 0.060 |
| Gelatin | 0.87 |
| **Fourth Layer (Second Red Sensitive Emulsion Layer** | |
| Emulsion G | as silver 0.70 |
| Emulsion B | as silver 0.30 |
| Sensitizing Dye I | $7.7 \times 10^{-5}$ |
| Sensitizing Dye II | $2.1 \times 10^{-5}$ |
| Sensitizing Dye III | $3.5 \times 10^{-4}$ |
| EX-2 | 0.40 |
| EX-3 | 0.050 |
| EX-10 | 0.015 |
| U-1 | 0.070 |
| U-2 | 0.050 |
| U-3 | 0.070 |
| Gelatin | 1.30 |
| **Fifth Layer (Third Red Sensitive Emulsion Layer)** | |
| Emulsion D | as silver 1.30 |
| Emulsion C | as silver 0.30 |
| Sensitizing Dye I | $8.1 \times 10^{-5}$ |
| Sensitizing Dye II | $2.1 \times 10^{-5}$ |
| Sensitizing Dye II | $3.6 \times 10^{-4}$ |
| EX-2 | 0.097 |
| EX-3 | 0.010 |
| EX-4 | 0.080 |
| Illustrative Compound (I-5) | 0.015 |
| HBS-1 | 0.22 |
| HBS-2 | 0.10 |
| Gelatin | 1.63 |
| **Sixth Layer (Intermediate Layer)** | |
| EX-6 | 0.040 |
| HBS-1 | 0.020 |
| Gelatin | 0.80 |
| **Seventh Layer (First Green Sensitive Emulsion Layer)** | |
| Emulsion A | as silver 0.15 |
| Emulsion B | as silver 0.15 |
| Sensitizing Dye IV | $4.5 \times 10^{-5}$ |

-continued

Sample 101:

| | |
|---|---|
| Sensitizing Dye V | $1.5 \times 10^{-4}$ |
| Sensitizing Dye VI | $5.7 \times 10^{-4}$ |
| EX-1 | 0.080 |
| EX-6 | 0.26 |
| EX-7 | 0.0055 |
| Coupler of this invention (59) | 0.015 |
| Illustrative Compound (I-5) | 0.013 |
| HBS-1 | 0.050 |
| HBS-3 | 0.010 |
| Gelatin | 0.63 |
| **Eighth Layer (Second Green Sensitive Emulsion Layer)** | |
| Emulsion C | as silver 0.35 |
| Emulsion E | as silver 0.10 |
| Sensitizing Dye IV | $3.2 \times 10^{-5}$ |
| Sensitizing Dye V | $1.1 \times 10^{-4}$ |
| Sensitizing Dye VI | $3.9 \times 10^{-4}$ |
| EX-6 | 0.094 |
| EX-7 | 0.0095 |
| Coupler of this invention (59) | 0.012 |
| Illustrative Compound (I-5) | 0.017 |
| HBS-1 | 0.080 |
| HBS-3 | $8.0 \times 10^{-3}$ |
| Gelatin | 0.50 |
| **Ninth Layer (Third Green Sensitive Emulsion Layer)** | |
| Emulsion E | as silver 1.00 |
| Emulsion D | as silver 0.20 |
| Sensitizing Dye IV | $5.3 \times 10^{-5}$ |
| Sensitizing Dye V | $1.2 \times 10^{-4}$ |
| Sensitizing Dye VI | $4.5 \times 10^{-4}$ |
| EX-1 | 0.025 |
| EX-11 | 0.10 |
| EX-13 | 0.015 |
| Coupler of this invention (59) | 0.010 |
| HBS-1 | 0.10 |
| HBS-2 | 0.10 |
| Gelatin | 1.54 |
| **Tenth Layer (Yellow Filter Layer)** | |
| Yellow colloidal silver | as silver 0.050 |
| EX-5 | 0.080 |
| HBS-1 | 0.030 |
| Gelatin | 0.95 |
| **Eleventh Layer (First Blue Sensitive Emulsion Layer)** | |
| Emulsion A | as silver 0.080 |
| Emulsion B | as silver 0.070 |
| Emulsion F | as silver 0.070 |
| Sensitizing Dye VII | $3.5 \times 10^{-4}$ |
| EX-8 | 0.042 |
| EX-9 | 0.72 |
| HBS-1 | 0.28 |
| Gelatin | 1.10 |
| **Twelfth Layer (Second Blue sensitive Emulsion Layer)** | |
| Emulsion G | as silver 0.35 |
| Emulsion F | as silver 0.10 |
| Sensitizing Dye VII | $3.2 \times 10^{-4}$ |
| EX-9 | 0.15 |
| EX-10 | $7.0 \times 10^{-3}$ |
| HBS-1 | 0.050 |
| Gelatin | 0.78 |
| **Thirteenth Layer (Third Blue sensitive Emulsion Layer)** | |
| Emulsion G | as silver 0.15 |
| Emulsion H | as silver 0.65 |
| Sensitizing Dye VII | $3.3 \times 10^{-4}$ |
| EX-9 | 0.20 |
| HBS-1 | 0.070 |
| Gelatin | 0.69 |
| **Fourteenth Layer (First Protective Layer)** | |

-continued

| Sample 101: | |
|---|---|
| Emulsion I | as silver 0.20 |
| U-4 | 0.11 |
| U-5 | 0.17 |
| HBS-1 | $5.0 \times 10^{-2}$ |
| Gelatin | 1.00 |
| Fifteenth Layer (Second Protective Layer) | |
| H-1 | 0.40 |
| B-1 (Diameter 1.7 μm) | $5.0 \times 10^{-2}$ |
| B-2 (Diameter 1.7 μm) | 0.10 |
| B-3 | 0.10 |
| S-1 | 0.20 |
| Gelatin | 1.20 |

Furthermore, W-1, W-2, W-3, B-4, B-5, F-1, F-2, F-3, F-4, F-5, F-6, F-7, F-8, F-9, F-10, F-11, F-12, F-13 and iron salts, lead salts, gold salts, platinum salts, iridium salts and rhodium salts were included in all of the layers with a view to improving storage properties, processing properties, pressure resisting properties, fungicidal and biocidal properties, antistatic properties and coating properties.

Sample 102

Sample 102 was obtained by replacing the magenta coupler EX-6 in the seventh and eighth layers of sample 1 with an equimolar amount of M-1 of this invention and replacing the coupler of this invention (59) in the seventh, eighth and nineth layers with 0.8 mol times the amount of EX-8.

Samples 103–105

Sample 103 was obtained by replacing the EX-8 in the seventh, eighth and nineth layers of Sample 102 with 1.2 mol times the amount of EX-14 and the M-1 with an equimolar amount of M-7. Sample 104 was obtained by replacing the EX-8 in the sixth, seventh and eighth layers of Sample 102 with 0.6 mol times the amount of EX-15 and the M-1 with an equimolar amount of M-22, and Sample 105 was obtained by replacing the EX-8 in the sixth, seventh and eighth layers of sample 102 with 2.5 mol times the amount of EX-16 and the M-1 with an equimolar amount of M-7.

Samples 106–114

Samples 106 to 114 were prepared by replacing the magenta coupler EX-6 in the seventh and eighth layers of Sample 101 and the coupler (59) in the seventh, eighth and nineth layers of sample 101 with equimolar amounts respectively of couplers of this invention as shown in Table 1.

Samples 115, 116

Sample 115 was obtained by adding 0.030 g/m$^2$ of B-(34), the use of which is desirable, to each of the third and fourth layer of sample 114. Sample 116 was obtained by adding 0.050 g/m$^2$ of B-(60) to each of the sixth and tenth layers of Sample 115.

Samples 117, 118

Sample 117 was prepared by replacing the (I-5) used in the third, fifth, seventh and eighth layers of Sample 114 with an equimolar amount of (I-2), and in Sample 118 the (I-5) was omitted.

These samples were subjected to a green imagewise exposure and then to a uniform blue exposure (in such a way that the yellow density of the red unexposed part of sample 101 was 1.8), after which they were processed using the procedure outlined below. The extent of color mixing was determined as the value obtained by subtracting the yellow density in the magenta fog part from the yellow density at a point which gave a magenta density of 2.0. Sharpness was evaluated by processing in the same way as described above, making measurements with the general MTF (modulation transfer function) method and obtaining the MTF value for a magenta image of 20 cycles/mm.

Furthermore, the samples were exposed for 5 luxseconds to white light and then processed in the way outlined below except that the bleaching time was set at 2 minutes 15 seconds and 30 minutes, and then magenta density measurements were made. The value obtained by subtracting the density after 30 minutes bleaching from the magenta density after 2 minutes 15 seconds bleaching is shown in Table 1 as the De-Silvering Failure. Moreover, the extent of color mixing was obtained with a bleaching time of 2 minutes 15 seconds.

Processing was carried out using the procedure outlined below with an automatic processor. (Processing was carried out until the total bath replenishment was three times the parent bath capacity.)

Processing Operations

| Process | Processing Time | Processing Temp. | Replenisher | Tank Capacity |
|---|---|---|---|---|
| Color Development | 3 min 15 sec | 38° C. | 33 ml | 20 liters |
| Bleach | 6 min 30 sec | 38° C. | 25 ml | 40 liters |
| Water Wash | 2 min 10 sec | 24° C. | 1200 ml | 20 liters |
| Fix | 4 min 20 sec | 38° C. | 25 ml | 30 liters |
| Water Wash (1) | 1 min 05 sec | 24° C. | Counter-flow system from (2) to (1) | 10 liters |
| Water Wash (2) | 1 min 00 sec | 24° C. | 1200 ml | 10 liters |
| Stabilization | 1 min 05 sec | 38° C. | 25 ml | 10 liters |
| Drying | 4 min 20 sec | 55° C. | | |

(Replenishment rate per meter length of 35 mm wide material).

The composition of each processing bath is indicated below:

| | Parent Bath (grams) | Replenisher (grams) |
|---|---|---|
| Color developer | | |
| Diethylenetriamine penta-acetic acid | 1.0 | 1.1 |
| 1-Hydroxyethylidene-1,1-di-phosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-Ethyl-N-β-hydroxy-ethylamino]-2-methylaniline sulfate | 4.5 | 5.5 |
| Water to make up to | 1.0 liter | 1.0 liter |
| pH | 10.05 | 10.10 |
| Bleach | | |
| Ethylenediamine tetra-acetic | 100.0 | 120.0 |

-continued

| | Parent Bath (grams) | Replenisher (grams) |
|---|---|---|
| acid, ferric sodium salt, tri-hydrate | | |
| Ethylenediamine tetra-acetic acid, di-sodium salt | 10.0 | 10.0 |
| Ammonium bromide | 140.0 | 160.0 |
| Ammonium nitrate | 30.0 | 35.0 |
| Aqueous ammonia (27%) | 6.5 ml | 4.0 ml |
| Water to make up to | 1.0 liter | 1.0 liter |
| pH | 6.0 | 5.7 |
| Fixer | | |
| Ethylenediamine tetra-acetic acid, di-sodium salt | 0.5 | 0.7 |
| Sodium sulfite | 7.0 | 8.0 |
| Sodium bisulfite | 5.0 | 5.5 |
| Aqueous ammonium thiosulfate solution (70%) | 170.0 ml | 200.0 ml |
| Water to make up to | 1.0 liter | 1.0 liter |
| pH | 6.7 | 6.6 |
| Stabilizer | | |
| Formaldehyde (37%) | 2.0 ml | 3.0 ml |
| Polyoxyethylene p-mono-nonylphenyl ether (average degree of polymerization 10) | 0.3 | 0.45 |
| Ethylenediamine tetra-acetic acid, di-sodium salt | 0.05 | 0.08 |
| Water to make up to | 1.0 liter | 1.0 liter |
| pH | 5.0–8.0 | 5.0–8.0 |

Furthermore, it is clear on comparing Sample 114 with Samples 117 and 118 that the use of compounds represented by general formula (D) is desirable for sharpness and color reproduction.

TABLE 1

| Sample | DIR Coupler in 7th, 8th & 9th Layers | Magenta Coupler in 7th & 8th Layers | MTF Value | Extent of Color Mixing | With A Short Bleaching Time De-silvering Extent of Failure | Color Mixing |
|---|---|---|---|---|---|---|
| 101 (Comp)[1)] | (59) | EX-6 | 0.72 | 0.13 | 0.09 | 0.17 |
| 102 (Comp)[2)] | EX-8 | M-1 | 0.71 | 0.12 | 0.13 | 0.16 |
| 103 (Comp)[3)] | EX-14 | M-7 | 0.72 | 0.02 | 0.11 | 0.10 |
| 104 (Comp)[4)] | EX-15 | M-22 | 0.68 | 0.10 | 0.10 | 0.15 |
| 105 (Comp)[5)] | EX-16 | M-7 | 0.73 | 0.09 | 0.13 | 0.15 |
| 106 (Inv.) | (1) | M-1 | 0.77 | 0.01 | 0.05 | 0.03 |
| 107 (Inv.) | (3) | M-1 | 0.76 | 0.02 | 0.06 | 0.04 |
| 108 (Inv.) | (7) | M-1 | 0.76 | 0.02 | 0.05 | 0.03 |
| 109 (Inv.) | (45) | M-1 | 0.77 | 0.00 | 0.05 | 0.03 |
| 110 (Inv.) | (45) | M-7 | 0.76 | 0.01 | 0.04 | 0.03 |
| 111 (Inv.) | (45) | M-22 | 0.77 | 0.01 | 0.04 | 0.03 |
| 112 (Inv.) | (45) | M-6 | 0.76 | 0.02 | 0.04 | 0.04 |
| 113 (Inv.) | (45) | M-11 | 0.76 | 0.02 | 0.05 | 0.04 |
| 114 (Inv.) | (45) | M-12 | 0.77 | 0.01 | 0.05 | 0.03 |
| 115 (Inv.) | (45) | M-12 | 0.77 | 0.02 | 0.02 | 0.02 |
| 116 (Inv.) | (45) | M-12 | 0.78 | 0.02 | 0.00 | 0.00 |
| 117 (Inv.) | (45) | M-12 | 0.77 | 0.02 | 0.05 | 0.04 |
| 118 (Inv) | (45) | M-12 | 0.75 | 0.06 | 0.04 | 0.08 |

[1)]Proposed in JP-A-1-154057
[2)]Proposed in JP-A-60-262158
[3)]Proposed in JP-A-62-151850
[4)]Proposed in JP-A-63-74058
[5)]Proposed in JP-A-1-251032

It is clear from Table 1 that the samples of this invention are superior in terms of sharpness as represented by the MTF value, color reproduction as represented by the degree of color mixing, and de-silvering properties.

Furthermore, it is clear on comparing Sample 114 with Samples 115 and 116 that de-silvering properties and color reproduction are further improved by the addition of de-silvering accelerator releasing compounds.

| Emulsion | Average AgI Content (%) | Average Grain Size (μm) | Variation Coefficient of the Grain Size (%) | Diameter/ Thickness Ratio | Silver Weight Ratio (AgI Content %) |
|---|---|---|---|---|---|
| A | 4.0 | 0.25 | 27 | 1.0 | Core/Shell = 1/3 (13/1), double structure grains |
| B | 8.9 | 0.55 | 14 | 4.0 | Core/Shell = 3/7 (25/2), double structure grains |
| C | 10 | 0.55 | 18 | 4.0 | Core/Shell = 1/2 (24/3), double structure grains |
| D | 16 | 0.80 | 19 | 7.5 | Core/Shell = 4/6 (40/0), double structure grains |
| E | 10 | 0.80 | 17 | 7.0 | Core/Shell = 1/2 (24/3), double structure grains |
| F | 4.0 | 0.15 | 15 | 1.0 | Core/Shell = 1/3 (13/1), double structure grains |
| G | 14.0 | 0.50 | 17 | 5.0 | Core/Shell = 1/2 (42/0), double structure grains |
| H | 14.5 | 1.10 | 20 | 7.0 | Core/Shell = 37/63 (34/3), double structure grains |
| I | 1 | 0.07 | 15 | 1 | Uniform grains |

EX-1

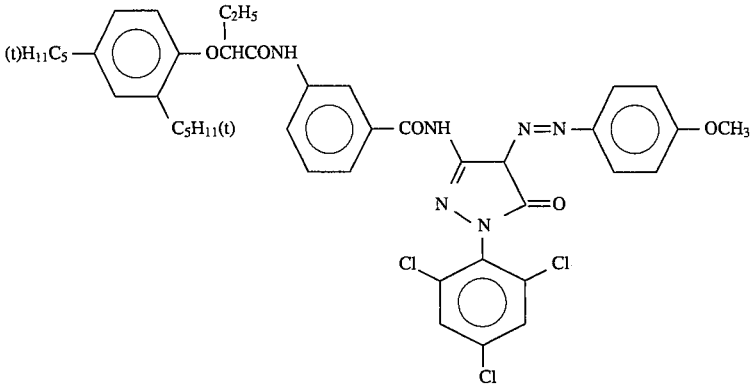

EX-2

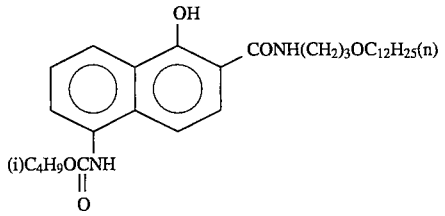

EX-3

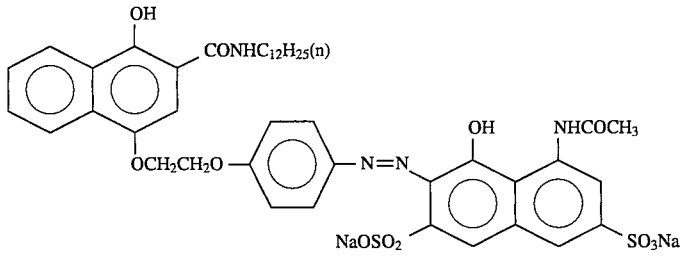

EX-4

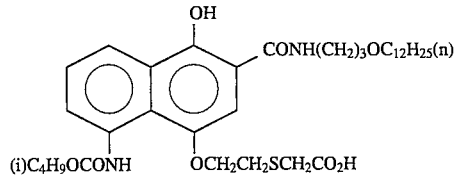

-continued
EX-5
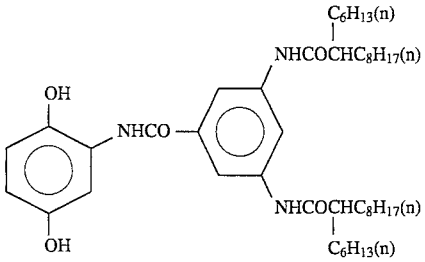
EX-6
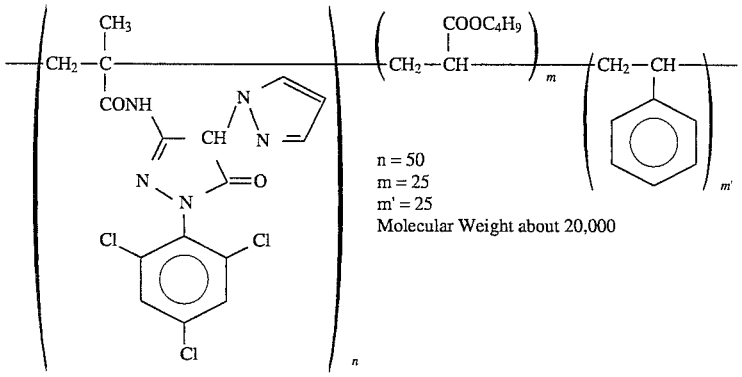
EX-7
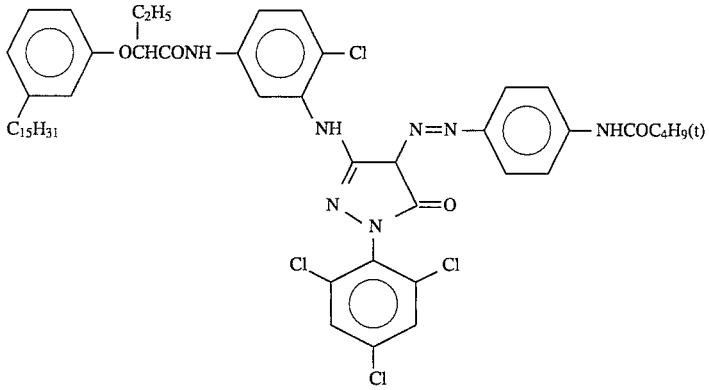
EX-8
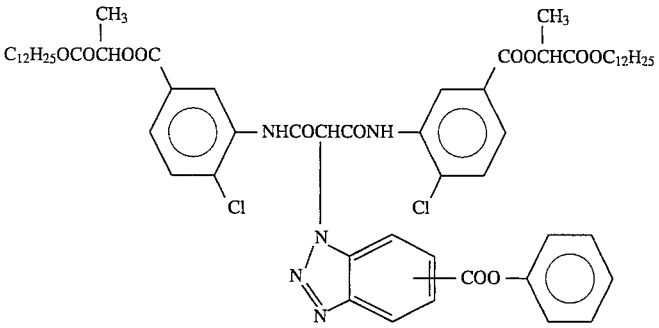
EX-9

-continued
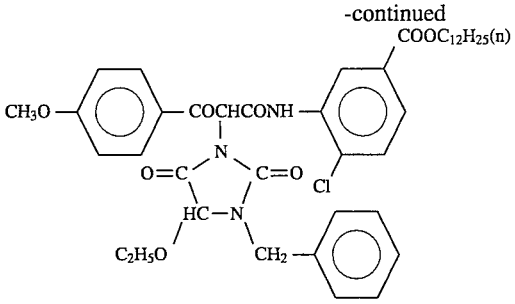
EX-10
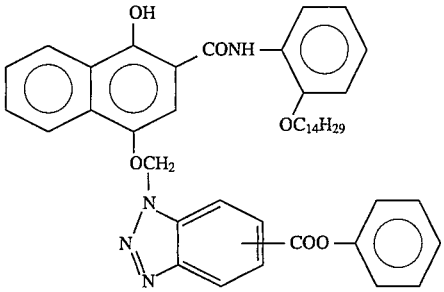
EX-11
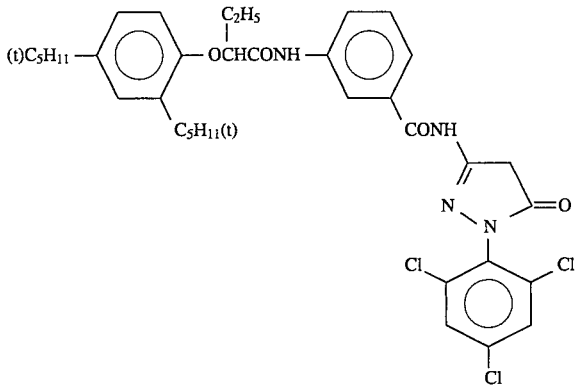
EX-12
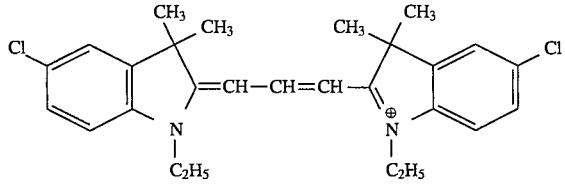
$C_2H_5OSO_3^{\ominus}$
EX-13
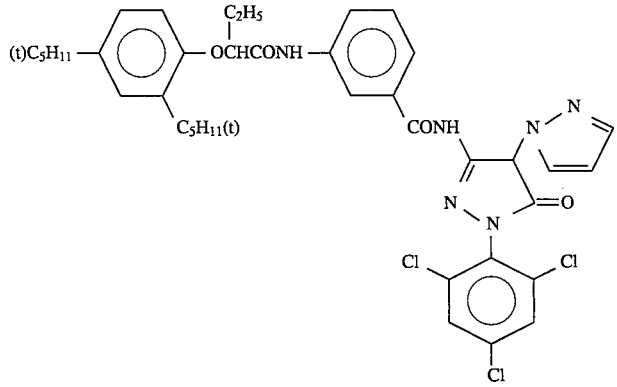

-continued
U-1
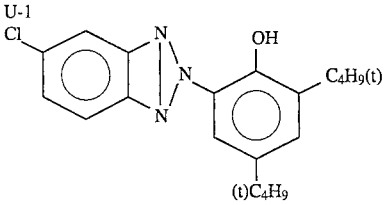
U-2
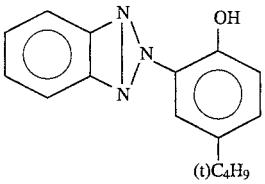
U-3
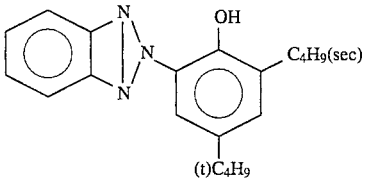
U-4
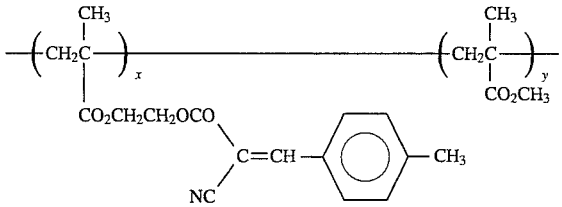
x:y = 70:30 (wt%)
U-5
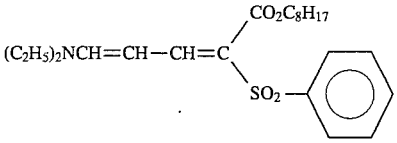
HBS-1
Tricresyl phosphate
HBS-2
Di-n-butyl phthalate
HBS-3
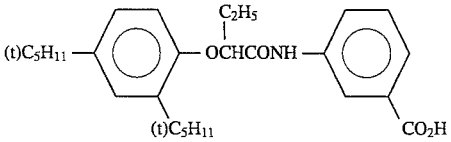
Sensitizing Dye I
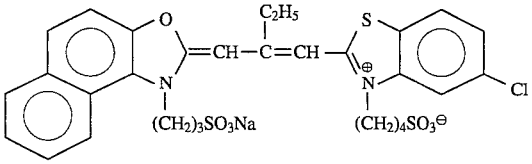
Sensitizing Dye II -continued
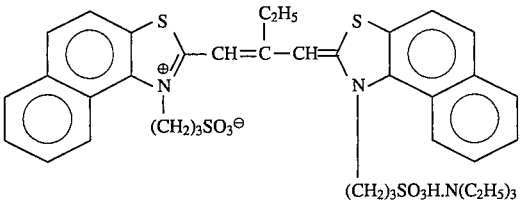
Sensitizing Dye III
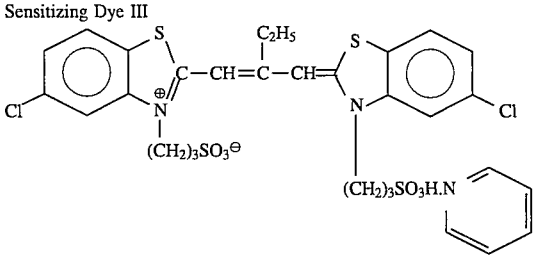
Sensitizing Dye IV
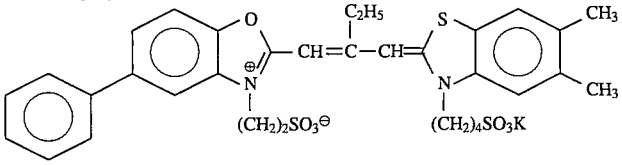
Sensitizing Dye V
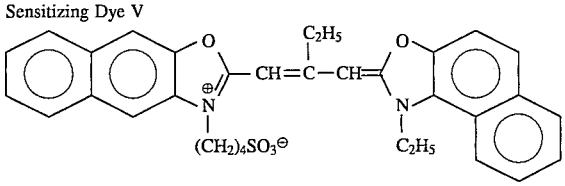
Sensitizing Dye VI
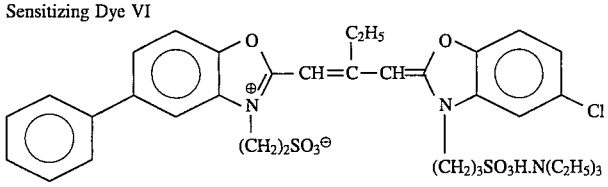
Sensitizing Dye VII
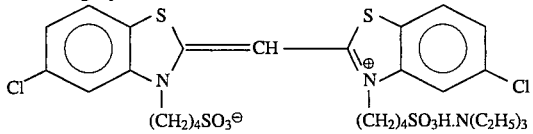
S-1
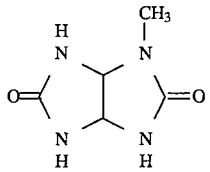
H-1
$CH_2{=}CH{-}SO_2{-}CH_2{-}CONH{-}CH_2$
$CH_2{=}CH{-}SO_2{-}CH_2{-}CONH{-}CH_2$
B-1
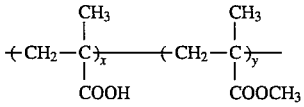
x/y = 10/90
B-2

-continued
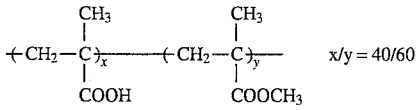
x/y = 40/60
B-3
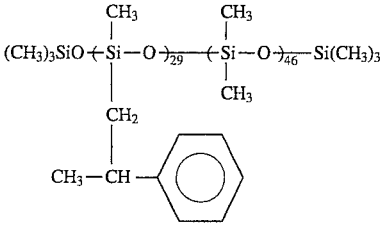
B-4
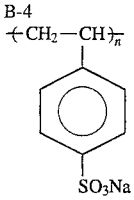
B-5
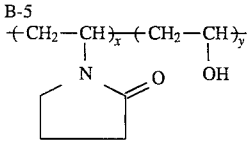
x/y = 70/30
W-1
$C_8F_{17}SO_2NHCH_2CH_2CH_2OCH_2CH_2\overset{\oplus}{N}(CH_3)_3$
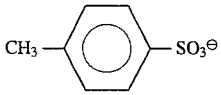
W-2
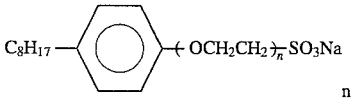
n = 2~4
W-3
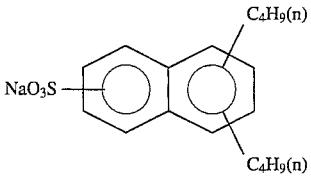
F-1
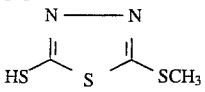
F-2
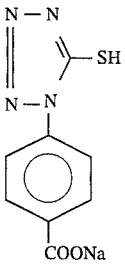
F-3

-continued
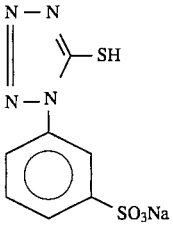
F-4
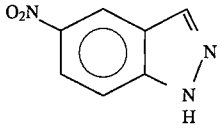
F-5
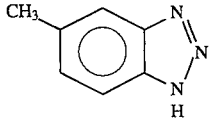
F-6
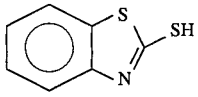
F-7
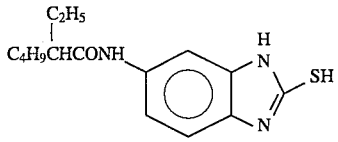
F-8
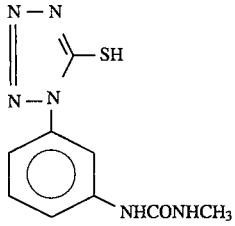
F-9
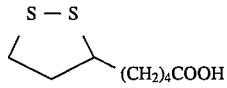
F-10
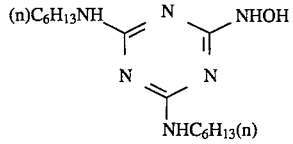
F-11
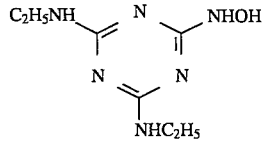
F-12

-continued
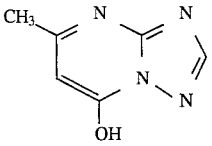
F-13
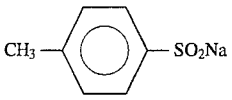
EX-14 (Compound (9) of JP-A-62-151850)
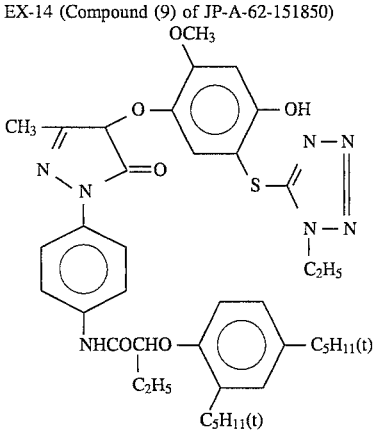
EX-15 (Coupler D-1 of JP-A-63-74058)
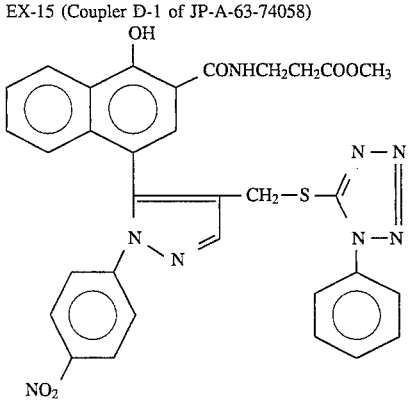
EX-16 (Compound (4) of JP-A-1-251032)

-continued

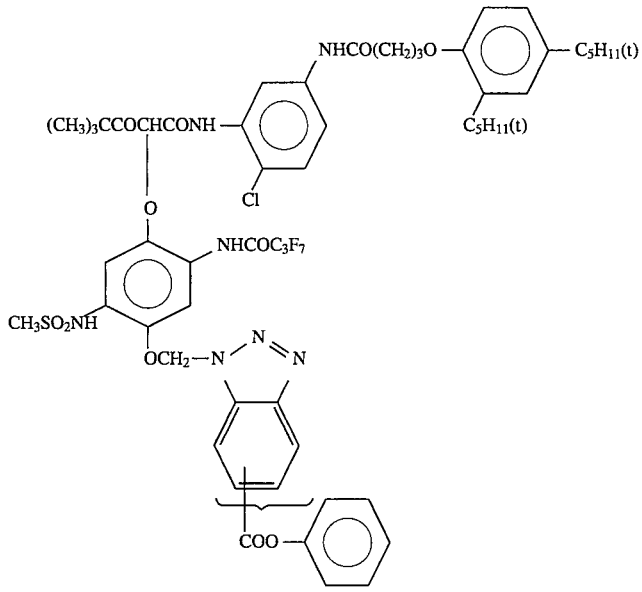

EXAMPLE 2

Sample 201 was prepared by replacing the EX-8 in the sixth layer of Sample 101 in JP-A-2-96747 with an equimolar amount of M-6 of this invention and adding 0.011 g/m$^2$ of the coupler (45) of this invention to the third, sixth and seventh layers.

Samples were evaluated in the same way as described in Example 1, and Sample 201 of this invention had excellent color reproduction and sharpness, and excellent de-silvering properties.

TABLE 2

| | | Extent of Color | With a short bleaching time De-silvering extent of | |
|---|---|---|---|---|
| Sample | MFT Value | Mixing | Failure | Color Mixing |
| 101* | 0.74 | 0.10 | 0.10 | 0.14 |
| 201 | 0.80 | 0.03 | 0.06 | 0.05 |

While the invention has been described in detail and with reference to specific embodiments thereof, it will be apparent to one skilled in the art that various changes and modifications can be made thereto without departing from the spirit and scope thereof.

What is claimed is:

1. A silver halide color photographic material comprising a support having thereon at least one photosensitive silver halide emulsion layer, and a pyrazoloazole based magenta coupler, the material further comprising a coupler which contains a plurality of photographically useful groups or precursors thereof in an atomic grouping which forms a timing group, the photographically useful groups or precursors thereof being capable of being released from different atoms on said timing group by a coupling reaction with the oxidized product of a color developing agent without further reacting with another oxidized product of the color developing agent.

2. A silver halide color photographic material as in claim 1, wherein the coupler which has a plurality of photographically useful groups is in said photosensitive silver halide emulsion layer.

3. A silver halide color photographic material as in claim 1, wherein the magenta coupler is a 1H-imidazo[1,2-b]-pyrazole, a 1H-pyrazolo[1,5-b]-[1,2,4]-triazole, a 1H-pyrazolo[5,1-c][1,2,4]-triazole or a 1H-pyrazolo[1,5-d]-tetrazole.

4. A silver halide color photographic material as in claim 1, wherein the material further comprises a compound represented by general formula (D):

$$A\text{-}(L_1)_v\text{-}B\text{-}(L_2)_w\text{-}DI \qquad (D)$$

wherein A represents a group which cleaves $(L_1)_v$-B-$(L_2)_w$-DI on reaction with the oxidized form of a developing agent, $L_1$ represents a linking group for which the bond with B is cleaved after cleavage of the bond with A, B represents a group which cleaves $(L_2)_w$-DI on reaction with the oxidized form of a developing agent, $L_2$ represents a group which cleaves DI aftercleavage of the bond with B, DI represents a development inhibitor, v and w each represents an integer of 0 to 2, and when v or w is 2, the two $L_1$ or $L_2$ groups may be the same or different.

5. A silver halide color photographic material as in claim 1, wherein the coupler which has a plurality of photographically useful groups is represented by the following formula (I);

$$A\text{-}(L_1)_l\text{-}(L_2)_m[(L_1)_n\text{-}PUG]_s$$

wherein A represents a coupler residual group, $L_1$ represents a divalent timing group, $L_2$ represents a timing group with a bond valency of 3 or more and PUG represents a photographically useful group, l and n each individually represents 0, 1 or 2, m represents 1 or 2, and s represents a number obtained by subtracting 1 from the valency of $L_2$ and is an integer of at least 2; and wherein two or more groups of $[(L_1)_n\text{–PUG}]_s$ are respectively connected to different atoms in a group of $(L_2)_m$.

6. A silver halide color photographic material of claim 5, wherein the material further comprises a bleaching accelerator releasing compound.

7. A silver halide color photographic material as in claim 6, wherein bleaching accelerator releasing compound is represented by general formula (B):

$$A\text{-}(L_1)_1\text{-}Z \qquad (B)$$

wherein A represents a group which reacts with the oxidized form of a developing agent and cleaves $(L_1)_1$-Z, $L_1$ represents a group which cleaves Z after cleavage of the bond with A, 1 represents 0 or 1, and Z represents a bleaching accelerator.

8. A silver halide color photographic material as in claim 5, wherein the material further comprises a compound which cleaves a development inhibitor as a result of a compound which has been cleaved after reaction with the oxidized form of a primary aromatic amine developing agent reacting again with another molecule of the oxidized form of the developing agent.

9. A silver halide color photographic material as in claim 5, wherein PUG represents a development inhibitor.

10. A silver halide color photographic material as in claim 5, wherein $L_1$ in formula (I) represents a group represented by formula (T-1);

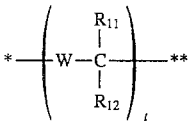

(T-1)

wherein W represents an oxygen atom, a sulfur atom, or an

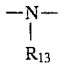

group ($R_{13}$ represents a substituent group), $R_{11}$ and $R_{12}$ each represent hydrogen atoms or substituent groups, t represents 1 or 2, and marks * and ** indicate the position bonded to A, $L_1$ or $L_2$ and $L_1$, $L_2$ or PUG in formula (I), respectively.

11. A silver halide color photographic material as in claim 5, wherein $L_1$ in formula (I) represent a group represented by formula (T-2);

$$*\text{-Nu-Link-E-}** \qquad (T\text{-}2)$$

wherein Nu represents a nucleophilic group, E represents an electrophilic group and Link is a linking group, and marks * and ** indicate the position bonded to A, $L_1$ or $L_2$ and $L_1$, $L_2$ or PUG in formula (I), respectively.

12. A silver halide color photographic material as in claim 5, wherein $L_1$ in formula (I) represents a group represented by formula (T-3);

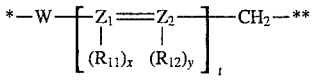

(T-3)

wherein $Z_1$ and $Z_2$ each represent a carbon atom or nitrogen atom, x and y represent 0 or 1, and marks * and * *, W, $R_{11}$, $R_{12}$ and t are as defined in claim 10.

13. A silver halide color photographic material as in claim 5, wherein $L_1$ in formula (I) represents a group represented by formula (T-4) or (T-5);

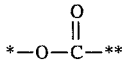

(T-4)

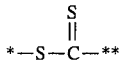

(T-5)

wherein marks * and  are as defined in claim 10**.

14. A silver halide color photographic material as in claim 5, wherein $L_2$ in formula (I) represents a group represented by formula (T-$L_2$);

(T-$L_2$)

wherein marks , and , W, $Z_1$, $Z_2$, $R_{11}$, $R_{12}$, x, y and t are as defined in claims 10 and 12** provided that at least one of the plurality of $R_{11}$ and $R_{12}$ groups represents —$CH_2$-($L_1$)— wherein this ($L_1$) is bonded to a photographically useful group.

15. A silver halide color photographic material comprising a support having thereon at least one photosensitive silver halide emulsion layer, and a pyrazoloazole based magenta coupler, the material further comprising a coupler which contains a plurality of photographically useful groups or precursors thereof in an atomic grouping which forms a timing group, the photographically useful groups or precursors thereof being capable of being released from different atoms on said timing group by a single coupling reaction with the oxidized product of a color developing agent.

* * * * *